US007690996B2

(12) United States Patent
Iddings et al.

(10) Patent No.: US 7,690,996 B2
(45) Date of Patent: Apr. 6, 2010

(54) SERVER BASED GAMING SYSTEM AND METHOD FOR PROVIDING ONE OR MORE TOURNAMENTS AT GAMING TABLES

(75) Inventors: Cara L. Iddings, Henderson, NV (US); Anthony J. Baerlocher, Reno, NV (US); Richard J. Schneider, Las Vegas, NV (US)

(73) Assignee: IGT, Reno, NV (US)

( * ) Notice: Subject to any disclaimer, the term of this patent is extended or adjusted under 35 U.S.C. 154(b) by 389 days.

(21) Appl. No.: 11/556,919

(22) Filed: Nov. 6, 2006

(65) Prior Publication Data

US 2008/0108404 A1 May 8, 2008

(51) Int. Cl.
*A63F 1/18* (2006.01)

(52) U.S. Cl. ..... 463/42; 463/9; 463/10; 463/11; 463/12; 463/13

(58) Field of Classification Search ..... 463/42
See application file for complete search history.

(56) References Cited

U.S. PATENT DOCUMENTS

| | | | |
|---|---|---|---|
| 4,531,187 | A | 7/1985 | Uhland |
| 4,814,589 | A | 3/1989 | Storch et al. |
| 5,083,271 | A | 1/1992 | Thacher et al. |
| 5,166,502 | A | 11/1992 | Rendleman et al. |
| 5,242,163 | A | 9/1993 | Fulton |
| 5,265,874 | A | 11/1993 | Dickinson et al. |
| 5,288,081 | A | 2/1994 | Breeding |
| 5,344,144 | A | 9/1994 | Canon |
| 5,361,885 | A | 11/1994 | Modler |
| 5,362,053 | A | 11/1994 | Miller |
| 5,406,264 | A | 4/1995 | Plonsky et al. |
| 5,417,430 | A | 5/1995 | Breeding |

(Continued)

FOREIGN PATENT DOCUMENTS

| | | |
|---|---|---|
| EP | 1 672 567 | 6/2006 |

(Continued)

OTHER PUBLICATIONS

Advantage Casino System Bonusing Brochure, written by IGT, published prior to Nov. 6, 2006.

(Continued)

*Primary Examiner*—Ronald Laneau
*Assistant Examiner*—Justin Myhr
(74) *Attorney, Agent, or Firm*—K&L Gates LLP

(57) ABSTRACT

A gaming system and method that enables tournament table games and non-tournament table games to be played simultaneously at a same gaming table with a processor automatically determining the results of the tournament. The players at a gaming table may play a tournament game simultaneously with other tournament players, may play the tournament at different times with tournament players on gaming tables simultaneously playing tournament games as other players play non-tournament games on a same gaming table and a single player may simultaneously or sequentially play tournament and non-tournament games at a gaming table with suitable chip identification devices. During the tournament the gaming system tracks at least the tournament players' wagers wins, losses, and chip totals and/or chip values with suitable chip identification devices and automatically determines the results of the tournament based on the chip identification.

43 Claims, 27 Drawing Sheets

U.S. PATENT DOCUMENTS

| | | | | |
|---|---|---|---|---|
| 5,544,892 | A | 8/1996 | Breeding | |
| 5,605,334 | A | 2/1997 | McCrea, Jr. | |
| 5,613,912 | A * | 3/1997 | Slater | 463/25 |
| 5,651,548 | A | 7/1997 | French et al. | |
| 5,695,400 | A | 12/1997 | Fennell et al. | |
| 5,707,287 | A | 1/1998 | McCrea, Jr. | |
| 5,735,525 | A | 4/1998 | McCrea, Jr. | |
| 5,735,742 | A | 4/1998 | French | |
| 5,755,621 | A | 5/1998 | Marks et al. | |
| 5,769,716 | A | 6/1998 | Saffari et al. | |
| 5,770,533 | A | 6/1998 | Franchi | |
| 5,781,647 | A | 7/1998 | Fishbine et al. | |
| 5,785,321 | A | 7/1998 | van Putten et al. | |
| 5,803,808 | A | 9/1998 | Strisower | |
| 5,806,045 | A | 9/1998 | Biorge et al. | |
| 5,809,482 | A | 9/1998 | Strisower | |
| 5,820,460 | A | 10/1998 | Fulton | |
| 5,833,536 | A | 11/1998 | Davids et al. | |
| 5,851,148 | A | 12/1998 | Brune et al. | |
| D404,436 | S | 1/1999 | McGahn et al. | |
| 5,890,717 | A | 4/1999 | Rosewarne et al. | |
| 5,902,983 | A | 5/1999 | Crevelt et al. | |
| 5,911,418 | A | 6/1999 | Adams | |
| 5,911,626 | A | 6/1999 | McCrea, Jr. | |
| 5,919,090 | A | 7/1999 | Mothwurf | |
| 5,941,769 | A | 8/1999 | Order | |
| 5,947,820 | A | 9/1999 | Morro et al. | |
| 5,957,776 | A | 9/1999 | Hoehne | |
| 5,970,143 | A | 10/1999 | Schneier et al. | |
| 5,984,310 | A | 11/1999 | English | |
| 6,019,374 | A | 2/2000 | Breeding | |
| 6,039,648 | A | 3/2000 | Guinn et al. | |
| 6,039,650 | A | 3/2000 | Hill | |
| 6,093,103 | A | 7/2000 | McCrea, Jr. | |
| 6,117,012 | A | 9/2000 | McCrea, Jr. | |
| 6,165,069 | A | 12/2000 | Sines et al. | |
| 6,186,895 | B1 | 2/2001 | Oliver | |
| 6,254,484 | B1 | 7/2001 | McCrea, Jr. | |
| 6,267,671 | B1 | 7/2001 | Hogan | |
| 6,287,202 | B1 * | 9/2001 | Pascal et al. | 463/42 |
| 6,299,534 | B1 * | 10/2001 | Breeding et al. | 463/25 |
| 6,299,536 | B1 | 10/2001 | Hill | |
| 6,313,871 | B1 | 11/2001 | Schubert | |
| 6,346,044 | B1 | 2/2002 | McCrea, Jr. | |
| 6,454,649 | B1 | 9/2002 | Mattice et al. | |
| 6,460,848 | B1 | 10/2002 | Soltys et al. | |
| 6,464,584 | B2 | 10/2002 | Oliver | |
| 6,488,585 | B1 | 12/2002 | Wells et al. | |
| 6,514,140 | B1 | 2/2003 | Storch | |
| 6,517,435 | B2 | 2/2003 | Soltys et al. | |
| 6,530,837 | B2 | 3/2003 | Soltys et al. | |
| 6,533,276 | B2 | 3/2003 | Soltys et al. | |
| 6,533,662 | B2 | 3/2003 | Soltys et al. | |
| 6,561,897 | B1 | 5/2003 | Bourbour et al. | |
| 6,579,180 | B2 | 6/2003 | Soltys et al. | |
| 6,579,181 | B2 | 6/2003 | Soltys et al. | |
| 6,581,747 | B1 | 6/2003 | Charlier et al. | |
| 6,582,301 | B2 | 6/2003 | Hill | |
| 6,595,857 | B2 | 7/2003 | Soltys et al. | |
| 6,609,710 | B1 | 8/2003 | Order | |
| 6,612,928 | B1 | 9/2003 | Bradford et al. | |
| 6,619,662 | B2 | 9/2003 | Miller | |
| 6,626,757 | B2 | 9/2003 | Oliveras | |
| 6,629,019 | B2 | 9/2003 | Legge et al. | |
| 6,629,591 | B1 | 10/2003 | Griswold et al. | |
| 6,629,889 | B2 | 10/2003 | Mothwurf | |
| 6,638,161 | B2 | 10/2003 | Soltys et al. | |
| 6,652,378 | B2 | 11/2003 | Cannon et al. | |
| 6,652,379 | B2 | 11/2003 | Soltys et al. | |
| 6,659,861 | B1 | 12/2003 | Faris et al. | |
| 6,659,875 | B2 | 12/2003 | Purton | |
| 6,663,490 | B2 | 12/2003 | Soltys et al. | |
| 6,671,358 | B1 | 12/2003 | Seidman et al. | |
| 6,672,589 | B1 * | 1/2004 | Lemke et al. | 273/236 |
| 6,685,564 | B2 | 2/2004 | Oliver | |
| 6,685,568 | B2 | 2/2004 | Soltys et al. | |
| 6,688,979 | B2 | 2/2004 | Soltys et al. | |
| 6,690,673 | B1 | 2/2004 | Jarvis | |
| 6,709,333 | B1 | 3/2004 | Bradford et al. | |
| 6,712,696 | B2 | 3/2004 | Soltys et al. | |
| 6,733,388 | B2 | 5/2004 | Mothwurf | |
| 6,747,560 | B2 | 6/2004 | Stevens, III | |
| 6,758,751 | B2 | 7/2004 | Soltys et al. | |
| 6,834,251 | B1 | 12/2004 | Fletcher | |
| 6,843,725 | B2 | 1/2005 | Nelson | |
| 6,848,994 | B1 | 2/2005 | Knust et al. | |
| 6,860,810 | B2 | 3/2005 | Cannon et al. | |
| 6,884,168 | B2 | 4/2005 | Wood et al. | |
| 6,967,563 | B2 | 11/2005 | Bormaster | |
| 7,011,309 | B2 | 3/2006 | Soltys et al. | |
| 7,017,805 | B2 | 3/2006 | Meehan | |
| 7,018,291 | B1 | 3/2006 | Lemke et al. | |
| 7,114,718 | B2 | 10/2006 | Grauzer et al. | |
| 7,152,045 | B2 | 12/2006 | Hoffman | |
| 7,172,507 | B2 | 2/2007 | Fujimoto et al. | |
| 2002/0028707 | A1 | 3/2002 | Pascal et al. | |
| 2002/0039923 | A1 | 4/2002 | Cannon et al. | |
| 2002/0042298 | A1 | 4/2002 | Soltys et al. | |
| 2002/0042299 | A1 | 4/2002 | Soltys et al. | |
| 2002/0068625 | A1 | 6/2002 | Soltys et al. | |
| 2002/0072405 | A1 | 6/2002 | Soltys et al. | |
| 2002/0072407 | A1 | 6/2002 | Soltys et al. | |
| 2002/0147042 | A1 | 10/2002 | Vuong et al. | |
| 2002/0151342 | A1 | 10/2002 | Tracy et al. | |
| 2002/0160825 | A1 | 10/2002 | Nicastro et al. | |
| 2002/0177480 | A1 | 11/2002 | Rowe | |
| 2003/0003997 | A1 * | 1/2003 | Vuong et al. | 463/42 |
| 2003/0060264 | A1 * | 3/2003 | Chilton et al. | 463/20 |
| 2003/0087696 | A1 | 5/2003 | Soltys et al. | |
| 2003/0130041 | A1 | 7/2003 | Pascal et al. | |
| 2003/0151194 | A1 | 8/2003 | Hessing et al. | |
| 2003/0162588 | A1 | 8/2003 | Brosnan et al. | |
| 2003/0171142 | A1 | 9/2003 | Kaji et al. | |
| 2003/0176219 | A1 | 9/2003 | Manfredi et al. | |
| 2003/0186745 | A1 | 10/2003 | Nguyen et al. | |
| 2003/0199321 | A1 | 10/2003 | Williams | |
| 2004/0029631 | A1 | 2/2004 | Duhamel | |
| 2004/0142743 | A1 | 7/2004 | Oliver | |
| 2004/0204226 | A1 | 10/2004 | Foster et al. | |
| 2004/0224777 | A1 | 11/2004 | Smith et al. | |
| 2004/0229700 | A1 * | 11/2004 | Cannon et al. | 463/42 |
| 2004/0251630 | A1 | 12/2004 | Sines et al. | |
| 2005/0005127 | A1 | 1/2005 | Rowe et al. | |
| 2005/0026680 | A1 | 2/2005 | Gururajan | |
| 2005/0026683 | A1 | 2/2005 | Fujimoto | |
| 2005/0043072 | A1 | 2/2005 | Nelson | |
| 2005/0043088 | A1 | 2/2005 | Nguyen et al. | |
| 2005/0043089 | A1 | 2/2005 | Nguyen et al. | |
| 2005/0043094 | A1 | 2/2005 | Nguyen et al. | |
| 2005/0051963 | A1 | 3/2005 | Snow | |
| 2005/0054408 | A1 | 3/2005 | Steil et al. | |
| 2005/0082750 | A1 | 4/2005 | Grauzer et al. | |
| 2005/0119048 | A1 | 6/2005 | Soltys et al. | |
| 2005/0212214 | A1 | 9/2005 | Pfeiffer et al. | |
| 2005/0215300 | A1 * | 9/2005 | Oliveras | 463/13 |
| 2005/0219599 | A1 | 10/2005 | White et al. | |
| 2005/0221882 | A1 | 10/2005 | Nguyen et al. | |
| 2005/0225080 | A1 | 10/2005 | Wicker | |
| 2005/0233794 | A1 | 10/2005 | Cannon et al. | |
| 2005/0282622 | A1 | 12/2005 | Lindquist | |
| 2006/0001211 | A1 | 1/2006 | Lewis et al. | |
| 2006/0019739 | A1 | 1/2006 | Soltys et al. | |
| 2006/0027970 | A1 | 2/2006 | Kyrychenko | |
| 2006/0058082 | A1 | 3/2006 | Crawford, III et al. | |

2006/0058083 A1 3/2006 Crawford, III et al.
2006/0058084 A1 3/2006 Crawford, III et al.
2006/0058085 A1 3/2006 White et al.
2006/0058086 A1 3/2006 White et al.
2006/0058087 A1 3/2006 White et al.
2006/0058088 A1 3/2006 Crawford, III et al.
2006/0058089 A1 3/2006 White et al.
2006/0058090 A1 3/2006 Crawford, III et al.
2006/0058091 A1 3/2006 Crawford, III et al.
2006/0058092 A1 3/2006 Crawford, III et al.
2006/0058093 A1 3/2006 White et al.
2006/0066052 A1 3/2006 White et al.
2006/0068498 A1 3/2006 White et al.
2006/0068864 A1 3/2006 White et al.
2006/0068865 A1 3/2006 White et al.
2006/0068866 A1 3/2006 White et al.
2006/0068868 A1 3/2006 Crawford, III et al.
2006/0068869 A1 3/2006 White et al.
2006/0068870 A1 3/2006 Crawford, III et al.
2006/0068871 A1 3/2006 Crawford, III et al.
2006/0068879 A1 3/2006 Crawford, III et al.
2006/0068899 A1 3/2006 White et al.
2006/0128453 A1 6/2006 Hoffman
2006/0128472 A1 6/2006 Beavers
2006/0135238 A1 6/2006 Lancaster et al.
2006/0138728 A1 6/2006 Gordon et al.
2006/0148565 A1 7/2006 Gauselmann et al.
2006/0157934 A1 7/2006 Yoseloff et al.
2006/0160600 A1 7/2006 Hill et al.
2006/0160608 A1 7/2006 Hill et al.
2006/0165254 A1 7/2006 Fujimoto et al.
2006/0177109 A1 8/2006 Storch
2006/0178185 A1 8/2006 Weis
2006/0183540 A1 8/2006 Grauzer et al.
2006/0202422 A1 9/2006 Bahar
2006/0214372 A1 9/2006 Picken
2006/0223638 A1 10/2006 Koyama et al.
2006/0226605 A1 10/2006 Kenny
2006/0232012 A1 10/2006 Boyer
2006/0252521 A1 11/2006 Gururajan et al.
2006/0252554 A1 11/2006 Gururajan et al.
2006/0258427 A1 11/2006 Rowe et al.
2006/0258442 A1 11/2006 Ryan
2006/0264252 A1 11/2006 White et al.
2006/0287066 A1 12/2006 Crawford, III et al.
2006/0287067 A1 12/2006 White et al.
2006/0287101 A1 12/2006 Crawford, III et al.
2006/0287102 A1 12/2006 White et al.
2006/0287103 A1 12/2006 Crawford, III et al.
2006/0287104 A1 12/2006 White et al.
2006/0293099 A1 12/2006 Cooper
2007/0026204 A1 2/2007 Caulley et al.
2007/0029394 A1 2/2007 Wicker et al.
2007/0035399 A1 2/2007 Hecht et al.
2007/0057469 A1 3/2007 Grauzer et al.
2007/0060311 A1 3/2007 Rowe et al.
2007/0077977 A1 4/2007 Grauzer et al.
2007/0077987 A1 4/2007 Gururajan et al.
2007/0087823 A1 4/2007 Walker et al.
2007/0173318 A1* 7/2007 Abbott ..... 463/25

FOREIGN PATENT DOCUMENTS

| | | |
|---|---|---|
| EP | 1 672 596 | 6/2006 |
| EP | 1 672 602 | 6/2006 |
| EP | 1 710 000 | 10/2006 |
| EP | 1 532 594 | 11/2006 |
| GB | 2 423 356 | 8/2006 |
| WO | WO 98/00210 | 1/1998 |
| WO | WO 00/22585 | 4/2000 |
| WO | WO 2004/021294 | 3/2004 |
| WO | WO 2004/112923 | 12/2004 |
| WO | WO 2005/009563 | 2/2005 |
| WO | WO 2005/025696 | 3/2005 |
| WO | WO 2005/025701 | 3/2005 |
| WO | WO 2005/037385 | 4/2005 |
| WO | WO 2005/102480 | 11/2005 |
| WO | WO 2005/123203 | 12/2005 |
| WO | WO 2006/037220 | 4/2006 |
| WO | WO 2006/041655 | 4/2006 |
| WO | WO 2006/096752 | 9/2006 |
| WO | WO 2006/106192 | 10/2006 |
| WO | WO 2006/127128 | 11/2006 |
| WO | WO 2007/006002 | 1/2007 |

OTHER PUBLICATIONS

Advantage Casino System Brochure, Mobile Data Access, written by IGT, published prior to Nov. 6, 2006.
Advantage Casino System Brochure, NexGen Interactive Touch Screen Display, written by IGT, published prior to Nov. 6, 2006.
Advantage Casino System Marketing Brochure, written by IGT, published prior to Nov. 6, 2006.
Advantage Casino System Table Touch Brochure, written by IGT, published in 2004.
Diamond Dash Web Page http://www.arcadeplanet.com/images/diamond_dash.jpg written by Arcade Planet, Inc., printed on Mar. 31, 2004.
Frequently Asked Questions about the Table iD System Article, written by IGT, published in 2006.
Reel 'Em In-Big Bass Bucks Article, published by Strictly Slots in Aug. 2005.
Tournamania Advertisement, written by Atronic Casino Technology, Ltd., published in 2005.
IGT Gaming Systems Brochure, written by IGT, published in 2002.
International Search Report for Macau Patent No. I/000623 (972), issued on Feb. 7, 2009.
Office Action dated Oct. 1, 2008 for U.S. Appl. No. 11/337,176.
Office Action dated Sep. 3, 2009 for U.S. Appl. No. 11/337,176.

* cited by examiner

FIG. 5

144

| Chip Number | Associated Value |
|---|---|
| 876543 | $1 |
| 876544 | $1 |
| 876545 | $5 |
| 876546 | $5 |
| 876547 | $10 |
| 876548 | $10 |

FIG. 7A

160

| Player Station # 1 | Player Station # 2 | Player Station # 3 |
|---|---|---|
| A | F | K |
| B | G | L |
| C | H | M |
| D | I | N |
| E | J | O |

FIG. 7D

160

| Player Station # 1 | Player Station # 2 | Player Station # 3 |
|---|---|---|
| A | H | K |
| B | I | L |
| C | J | M |
| D | | N |
| E | | O |
| F | | G |
| P | | Q |

FIG. 12

Table of Possible Elements of Player Qualification for the Tournament

206

| | |
|---|---|
| Player Qualifier | Selection of player qualifiers the player must meet in order to qualify for the tournament, such as the amount of credits wagered, an amount credits won, a jackpot win or a specific game outcome, such as a bonus win on a gaming machine player tracking information which may include but not limited to the Player's Ranking, the Player's Birthday, the Player's Anniversary or if the Player is a New Member |
| Player Qualifier Schedule | Selection of the Date Range, the Days of Week, and the Hour Range in a day for the tournament. |
| Tournament Available | Determine the time after qualifying that the player can play the tournament session. The gaming system may enable the player to immediately play in the tournament, to play in the tournament a certain or predetermined amount of time after qualifying for the tournament or at a scheduled tournament time. |
| Time Period for Accruing Tournament Qualifiers | Determine if a player may accrue qualifiers over a certain time period or if the qualifier is only limited to a single event. |

FIG. 17

264

Congratulations - you qualify for our multi-round tournament.

A limit of 5 rounds may be played in the next week. You may play a round each day, at your own pace upon qualification that day. Each round includes 5 poker hands.

To qualify to play a tournament round that day, you must earn 50 points that day.

Upon qualification, proceed to a kiosk to receive your tournament chips. Each of these 5 rounds will count towards your final preliminary round score.The top fifteen players and five randomly chosen players will qualify to play a final round to determine a winner.

This final round determines the big prize winner! The winner wins $150,000, with two $30,000 prizes for the total preliminary round winners. Best of luck !

FIG. 18

266

| | SCORES | | |
|---|---|---|---|
| DATE | PLAYER A | PLAYER B | PLAYER C |
| May 1st | 20 | | |
| May 2nd | | | 54 |
| May 3rd | 65 | | |
| May 4th | | **90** | 67 |
| May 5th | 59 | | |
| May 6th | | | 58 |
| May 7th | 41 | | |
| May 8th | | 45 | **95** |
| May 9th | 28 | | |
| May 10th | | | **110** |
| May 11th | 36 | **156** | |
| May 12th | 58 | | |
| May 13th | **68** | | 50 |
| May 14th | | 25 | |
| May 15th | | | 45 |
| May 16th | 11 | | |
| May 17th | 12 | **87** | 13 |
| May 18th | **98** | | |
| May 19th | | | |
| May 20th | 5 | | 12 |
| May 21th | **125** | | |
| May 22th | | | |
| May 23th | 60 | | 29 |
| May 24th | 54 | | |
| May 25th | 28 | | |
| May 26th | | | |
| May 27th | 45 | | |
| May 28th | | | |
| May 29th | 67 | | |
| May 30th | 18 | | |
| May 31th | 15 | | **79** |
| SCORE | **291** | **333** | **284** |

SERVER BASED GAMING SYSTEM AND METHOD FOR PROVIDING ONE OR MORE TOURNAMENTS AT GAMING TABLES

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming establishments strive to make wagering as enjoyable, entertaining and exciting as possible for players. Gaming tournaments are exciting for certain players and are a widely used form of casino promotion. Frequently, tournaments are conducted at a bank or group of gaming machines such as slot machines as a form of promotion.

Certain tournaments are conducted at casino tables such as blackjack or poker tables. These tournaments, sometimes called table tournaments, enable players to play table games such as blackjack, baccarat or poker as part or all of a tournament. Known table tournaments are a manual process. The player is manually registered. The progress of the tournament is manually monitored and the outcome is manually determined.

In certain manual table tournaments, the players must register with casino personnel. Each player may be required to pay an entry fee. Upon completion of these steps, the casino provides the registered players chips to use in the tournament. The casino manually sets up the tournament. For example, the table tournament may have a certain number of rounds, a certain number hands or a time limit. The winner of the tournament is determined by which player has the most chips or highest value of chips at the end. The chips and the chip values are counted manually. The outcome of a "number of hands" table tournament is solely based on the number or value of chips the players each have after a designated number of hands. The outcome of a "total time" tournament is solely based on the number or value of chips the players each have after a certain amount of time has passed.

Certain known table tournaments include a checkpoint, such as a point after a designated number of hands, to assess the progress of the tournament. Results may be assessed and posted at this time. In table tournaments, manual monitoring and reporting is required. Casino personnel manually count each player's chips or chip values each time tournament progress needs to be assessed, such as at the end of the tournament, at the end of the round, or at a checkpoint. The casino personnel must go to every station of every player enrolled in the tournament and make an assessment of their chip total. After the progress report is generated (usually after the delay required to collect the data), the results are shown on a display for the players to view.

Additionally, these types of manual table tournaments are often required to be done at the same time and therefore limit player flexibility. Players participating in the table tournament are generally required to play at one location and complete the tournament at the same time because someone must count the players' chips at each assessment point of the tournament.

Dedicated gaming tables are dedicated for playing in a tournament and are therefore not played when a tournament is not in progress. That is, the dedicated tournament gaming tables are only active during tournament play and do not provide players the ability to play other non-tournament games on these dedicated tournament tables.

Thus, there are many drawbacks to dedicated gaming table tournaments. The manual nature is very time consuming. It takes a considerable amount of time for the casino personnel to count each player's chips. This is costly in both lost revenue opportunities for the time of the chip counting and the lost employee time. Additionally, the need for dedicated tables costs the casino in terms of space and lost play. That is, this gaming table dedication is costly to a casino because they take up space in the casino and because they are unoccupied or not played in a conventional manner for significant amounts of time.

Additionally, the manual table tournament process can be error-prone if not very carefully monitored. The human factor of manually counting each player's chips or chip values may lead to counting errors. A player may dispute a payout made by the dealer as inaccurate, such as being paid only 1:1 on a blackjack instead of 3:2 and dispute the results of the tournament.

Therefore, there is a need to provide a new tournament system to improve aspects of the configuration and implementation of table tournament game play.

SUMMARY

The present disclosure provides a gaming system and method that enables tournament table games and non-tournament table games or conventional games to be played simultaneously at a same gaming table where a processor, such as a central server, automatically tracks the tournament results and automatically determines the winners of the tournament. In one embodiment, all of the players at a gaming table play a tournament game at a same time with the gaming system identifying the players' total number of chips and/or chip values with suitable chip identification devices. In another embodiment, the gaming system enables certain players to play a tournament game at a gaming table while enabling certain other players at the same gaming table to simultaneously play non-tournament games while identifying at least the tournament players' total number of chips and/or chip values with suitable chip identification devices. In one such embodiment, a single player may play a non-tournament game at a gaming table and then sequentially play a tournament game at the same gaming table and then switch back to playing a non-tournament game at that same gaming table. In another embodiment, the gaming system enables a player to simultaneously or sequentially play tournament and non-tournament games at a gaming table with suitable chip identification devices. It should be appreciated that any suitable game or combinations of games may be employed as the tournament game or as the non-tournament game at the gaming table, including but not limited to blackjack, poker, baccarat, Let It Ride® poker, pai gow poker, roulette, craps or any other suitable table game. The table tournament may enable players to play a single table game (such as blackjack) or may enable players to play a plurality of different table games in the tournament.

The present system can be configured such that all chips in the gaming establishment where the tournament is conducted are tracked and monitored. In one embodiment, each of the chips includes a chip identification tag. The gaming system tracks and identifies all of the chips in the gaming establishment and at designated times certain of the chips are identified as or function as tournament chips and the other chips are identified as or function as regular or non-tournament chips by the gaming system. In one such embodiment, chips may be identified as tournament chips for a certain period of time, such as during a tournament. When the tournament is complete, the chips are then identified as or function as regular chips. Each tournament has parameters which determine when the tournament is being played. When a tournament is being played, the chips which are identified as or function as tournament chips are suitably tracked as tournament chips. It should be appreciated that the tournament chips may be identified in any suitable manner as discussed below.

The present system can alternatively be configured such that only certain chips in the gaming establishment are tracked and monitored. In one such embodiment, only the tournament chips include chip identification tags. In this embodiment, the gaming system only tracks or monitors designated tournament chips.

In various embodiments, the tournament tracking system includes an intelligent table system that tracks and identifies the tournament chips (or the chips functioning as tournament chips) using chip identification devices at or around the gaming tables that identify chip identification tags in the chips. The tournament tracking system or the tracking system includes a player tracking system which records the tournament chip information for each chip to players' specific accounts as discussed below. The intelligent table system includes any suitable type of chip reading technology to identify players' tournament chips. In different embodiments, the intelligent table system uses tournament chips to determine how much each player has won or lost and how many tournament chips each player has on the table. That is, the intelligent table system is able to track player wagers and wins for each and every tournament game played by each player. The intelligent table system may include (i) infra-red identification for the chips, (ii) optical technology to track and identify chips, (iii) radio frequency identification for the chips, and/or (iv) any other suitable chip identification devices or technology that is operable to determine player table game wagering activities.

In certain embodiments, the tournament chips do not have to be readily identifiable to other players. Rather certain chips are identified by the gaming system as tournament chips and certain chips are identified by the gaming system as non-tournament chips. In one embodiment, the chips are similar and the chips are operable to change identification based on game play. That is, each chip may be identified as a tournament chip or as a non-tournament chip.

In one embodiment, upon registration, players are provided tournament chips. The tournament chips are assigned, identified or tagged as tournament chips. One or more dealers have chips that are not yet assigned an identity. The non-assigned chips become assigned as tournament chips or non-tournament chips when they are played on the gaming table. The players have non-tournament chips and/or tournament chips. When a dealer presents a win to the player, the gaming system assigns the chip provided by the dealer to the player the same identification as the chip wagered.

For example, Player A wagers a tournament chip and Player B wagers a non-tournament chip. Both players win. The dealer takes a non-assigned chip and places it next to the tournament chip in Player A's wagering area. The gaming system then assigns the provided chip the identity of a tournament chip. The dealer takes a non-assigned chip and places it next to the tournament chip in Player B's wagering area. The gaming system then assigns the provided chip the identity of a non-tournament chip.

It should be appreciated that values may be assigned to tournament and non-tournament chips in any suitable manner. In one embodiment, each chip is worth a same value. That is, each tournament chip is a same denomination. For example, every player receives 100 one dollar chips at the start of the tournament. The intelligent table system then identifies the total number of chips that each player has by determining the placement or location of the chips and the gaming system stores total chip count for a player. In another embodiment, each tournament chip is associated with a designated value. In one embodiment, the gaming system suitably stores or associates the value of the chip with the player tracking account. In one embodiment, different denominations of chips are visually different, such as by having the value displayed on the chip. In one embodiment, each chip has an identification number and the central server maintains or stores the values associated with each chip through their identification number. The chip identifying devices of the intelligent table system provides the central controller with information of each chip through the identification numbers, and the central server provides the tournament tracking system the value associated with each chip such that the player tracking system may store the values of the chips.

The tournament tracking system is operable to work with any suitable type of tournament. In different embodiments, the tournaments may be scheduled as synchronized tournaments and self-scheduled tournaments.

In one embodiment, the table tournament is a synchronized table tournament where each of the players in the tournament plays the tournament game(s) simultaneously and wagers only with the tournament chips. In one such embodiment, the intelligent table system tracks and identifies at least one of: (a) the total number of chips in front of a player in a chip identification area, such as a chip holding area, of a player station at certain checkpoints to update tournament rankings; or (b) the chips wagered and won by the player at a chip identification area, such as a wagering area, of a player station.

In another embodiment, the table tournament is a self-scheduled table tournament. The self-scheduled tournament includes a plurality of players participating in a round of a tournament according to the tournament parameters that determine a time period to play the tournament such as within one or more ranges of designated times. That is, each player can individually participate in the tournament at a different time than the other players. If a tournament has more than one round, the gaming system may provide the participating players with a certain date/time by which to complete each of the rounds. The self-scheduled tournament provides players the flexibility of deciding when to play the tournament and what gaming table and player station to play the tournament on (within the range of allowable tables). In certain embodiments, the player may play a different portion of the tournament at different times. In certain embodiment, the players may be required to play the same type of table game, and in other embodiments the players may be allowed to play table games of their choice or choose from a selected list of table games. In other embodiments, the players may be required to play multiple designated different table games.

In one embodiment of a self-scheduled table tournament, the gaming system enables players in the tournament to play a tournament game at a gaming table while enabling certain other players at the same gaming table to simultaneously play non-tournament games while identifying the tournament chips. In one such embodiment, the player must choose to only wager tournament chips or non-tournament chips on a single game. That is, a player may not wager tournament chips and non-tournament chips on a same game. In one such embodiment, upon tournament registration, the gaming system or the gaming establishment provides each player playing the tournament a certain number of tournament chips. Each player may then play a tournament game with the tournament chips during the allotted time period to play the tournament at any participating gaming table. The player may also play non-tournament games and may wager with non-tournament chips when not playing a tournament game.

In another embodiment of a self-scheduled table tournament, the gaming system enables a player playing in the tournament to simultaneously wager tournament chips and non-tournament chips on a same game. That is, such players may play the same game as a tournament game and simultaneously play that same game as a non-tournament game. In one such embodiment, upon tournament registration, the gaming system or the gaming establishment provides the player a certain number of tournament chips. The players may then play the tournament game with the tournament chips during the allotted time period to play the tournament at any participating table. The players may also play non-tournament games and may wager with non-tournament chips while playing a tournament game.

In one embodiment, the gaming system includes one or a plurality of servers or sub-systems. That is, in certain embodiments, the gaming systems include a plurality of different systems to track, monitor and record tournament game play. One such sub-system is a tournament tracking system that includes an intelligent table system or a chip tracking system and a player tracking system. The player tracking system identifies players and records and saves the tournament information provided by the intelligent table system in player accounts. The central server, through the tournament tracking system, tracks a player's total number of tournament chips and/or the value of such tournament chips and/or other suitable information. At the end of the table tournament, the central server automatically determines the tournament results based on the information and data provided from the tournament tracking system. The tournament results are then provided to the players.

It should be appreciated that the present disclosure contemplates that one or more of a plurality of different methods of identifying the chips may be employed. In one embodiment, the tournament table is a normal gaming table. In one such embodiment, the chip identification devices are located above or below the table. In one such embodiment, the chip identification devices are attached to the gaming table or adjacent to the gaming table. In another embodiment, the chip identification devices are included in the gaming table. Therefore, gaming establishments may continue using the same gaming tables and install the intelligent table technology around one or more gaming tables.

In another embodiment, a gaming table includes a plurality of player stations. In one embodiment, each of the player stations includes or is associated with a player tracking input device. In one embodiment, each player station includes a chip identification area. In different embodiments, chip holding areas and wagering areas may be the chip identification areas.

More specifically, in one embodiment, the intelligent table system identifies all of the chips or the tournament chips in a player's chip holding area. For example, during tournament play, a player logs into the player tracking system via inserting their player card into a card slot at the player's player station at a gaming table. A player is required to have all tournament chips in that player's possession that are not in a wagering area in the chip holding area which includes one or more chip identification devices such as sensors or detectors. Upon a tournament checkpoint, throughout a player's play of a tournament or at the end of the tournament, the intelligent table system surveys and monitors each of the players' chip holding areas to identify the players' chips. The tournament chip information is sent to the central server and the gaming system determines a tournament result for each player.

In one embodiment, the gaming system includes one or more chip identification devices in each player's wagering area. A player may not necessarily place all of their chips in a chip holding area. The gaming system identifies the chips wagered and won by that player. For example, a player logs into the player tracking system via inserting their player card into a card slot at the player's player station at a gaming table. When a player places a tournament chip in the wagering area associated with that player station, the intelligent table system identifies that tournament chip. When a dealer provides a tournament chip to each player for a win, the intelligent table system identifies the provided tournament chips. The tournament chip information is used by the gaming system to determine the tournament winner.

In another embodiment, both the chip holding area and the wagering area include chip identification devices. Therefore, the gaming system double checks the players' gaming activity.

In another embodiment, each player station includes a tournament chip holding area and a non-tournament or regular chip holding area. The gaming system may include one or more chip identification devices in only the tournament chip holding area or in both the tournament chip holding area and the non-tournament chip holding area. In one embodiment, each player station includes a tournament wagering area and a non-tournament wagering area. The gaming system may include one or more chip identification devices in only the tournament chip wagering area or in both the tournament chip wagering area and the non-tournament chip wagering area.

In one embodiment, at the start of play, the intelligent table system in one embodiment associates any tracked data with the player's specific account.

Alternatively, in one embodiment, the gaming system determines the tournament winner by determining which player station has the most chips at the end of the tournament. That is, the gaming system does not associate any tracked data with the players' accounts. The gaming system enables players to play anonymously in a synchronized tournament at a tournament gaming table. The gaming system associates the chip count with player stations instead of specific players. The gaming system determines a tournament winner based on the player station that has the most chips or the highest value of chips.

For example, in one embodiment, the tournament is a synchronized tournament. In one embodiment, each player sits down at a player station of their choice or is assigned a player station. In one such embodiment, an account is associated with each player station. The players are all given a certain number of tournament chips which are associated with the player station accounts. For example, tournament chips 1, 2 and 3 are associated with Player Station #1 at the beginning of the tournament and tournament chips 4, 5 and 6 are associated with Player Station #2 at the beginning of the tournament. Each of the player stations includes a wagering area which includes one or more chip identification devices. The player at Player Station #1 wagers chip 1 and the player at Player Station #2 wagers chip 4 in the respective wagering areas. The first player wins and the second player loses. The dealer provides the first player with tournament chip 4 as payment for the win. The chip identification devices at the wagering area of the Player Station #1 detects tournament chip 4 and the gaming system now associates tournament chip 4 with Player Station #1 and disassociates tournament chip 4 with Player Station #2.

In one embodiment, the gaming system and/or the player tracking system tracks the participating player's gaming activity at each of the gaming tables the player plays. In one such embodiment, the gaming system, and/or the associated player tracking system timely tracks when a player initiates play of or logs onto a player station. The player may log onto the player station in any suitable manner such as by the insertion of their player tracking card, entering identifying information, such as a player number, or buying in to begin a gaming session. The gaming system, and/or the associated player tracking system also timely tracks when a player ends play of the gaming table and logs off the player tracking station such as by removal of the player tracking card or concluding play for that gaming session. That is, in one embodiment, the gaming system, the individual player station and/or the associated tracking system tracks a player logging onto the player station and a player logging off of the player station for each gaming session. During one or more gaming sessions of the gaming system, the individual player station and/or the associated player tracking system tracks any suitable information, such as any chips wagered, chip totals, amounts wagered, average wager amounts and/or the time wagers are placed. In different embodiments, for one or more players, the player tracking system includes the player's account number, the player's card number or other identification number, the player's first name, the player's surname, amount won and amount lost, chips won and chips lost, the player's preferred name or nickname, the player's player tracking ranking, any promotion status associated with the player's player tracking card, the player's address, the player's birthday, the player's anniversary, the player's recent gaming sessions, or any other suitable data. It should be appreciated that the player tracking data may be used for any suitable purpose in non-tournament game play and in tournament game play.

In one embodiment, at the start of play, the player inserts their player tracking card or otherwise identifies themselves at a player tracking input device associated with their player station or seat at the gaming table. The intelligent table system is then able to associate any tracked data with the player's specific account. Thus, in certain embodiments, tracking player activity at the gaming table is similar in accuracy and thoroughness to the tracking done at slot machines. Alternatively, the gaming system may enable a player to play anonymously and be associated with their current place at the table.

The implementation of the server based system to manage table games enables players to play in a tournament in a new way. The server based control of the table tournament may decrease or eliminate manual counting and the need for special tournament areas. The intelligent table system enables tournaments to easily be setup by the casino and played by the player on a gaming table at their choice of time. An accounting system associated with intelligent table system also expedites the tournament process, allowing for error-checking and handling, as well as real-time scoring.

Accordingly, by storing game programs, providing players with the tournament chips and monitoring the players' tournament games, the gaming system disclosed herein enables table tournament games to be played at gaming tables without manual counting and set-up.

Additional features and advantages are described in, and will be apparent from, the following Detailed Description and the figures.

BRIEF DESCRIPTION OF THE FIGURES

FIG. 5 is a table illustrating one embodiment of tournament chips being associated with different values.

FIGS. 7A and 7D are tables illustrating the gaming system associating certain chips with certain player stations of a gaming table.

FIG. 12 is a table of possible elements to be considered in player qualification for the tournament.

FIG. 17 is an enlarged exploded view of one embodiment of a display device displaying a player's invitation to play one of the embodiments of a multi-round synchronized tournament.

FIG. 18 is a table illustrating the results of one example of a self-scheduled multi-round tournament.

DETAILED DESCRIPTION

Systems

One or more embodiments of the present disclosure comprise a gaming system including a central server or controller, at least one gaming table and a tournament tracking system that enables players to play tournaments. Each of the gaming tables is operable with the central controller to provide a tournament game to the players in addition to one or more non-tournament games to the players. The tournament tracking system is configured to collect and store raw data relating to the wagering activities of players at a gaming table through chip reading technology. The present disclosure also includes methods of utilizing the obtained data to determine tournament results. In one embodiment, configured tournament criteria are applied to the obtained data to determine if a player qualifies to qualify for the tournament. Additionally, in some embodiments, the collected data is analyzed to determine a player's wagering history to determine whether or not the player is entitled to certain complimentary items.

Figure 1:
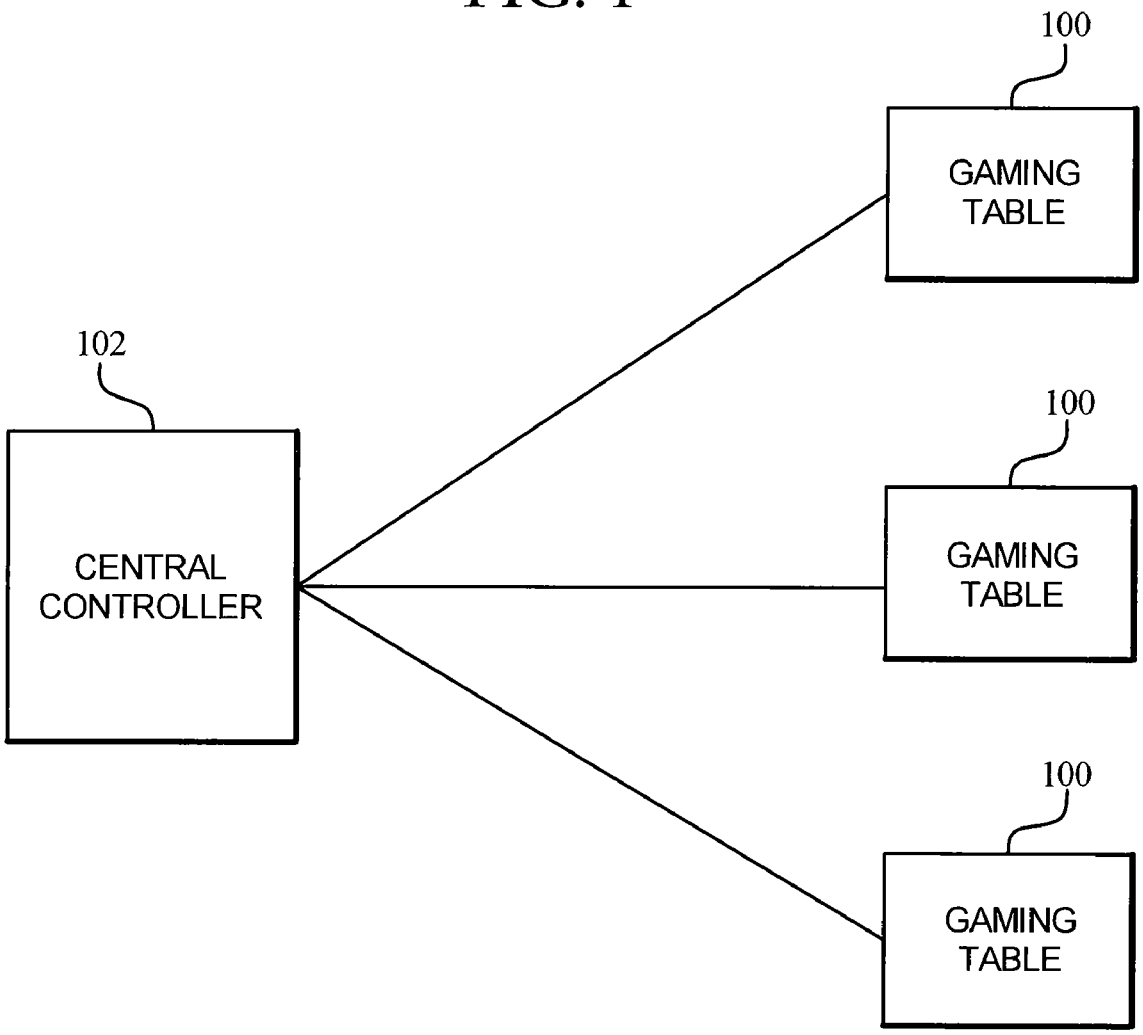
FIG. 1 is a schematic diagram of the central controller in communication with a plurality of gaming tables.

Referring now to FIG. 1, in one embodiment a plurality of gaming tables 100 are in communication with or linked to a central server or processor 102. The central server or controller may be any suitable server or computing device which includes a processor and a memory or storage device. In alternative embodiments, the central server is a progressive controller or a gaming machine. The game programs determine the parameters and scoring of one or more tournament games that are playable on the plurality of the gaming tables. The memory device also stores other data such as image data, event data, player input data, paytable data or information and applicable game rules that relate to the play of the tournament game. In one embodiment, the memory device includes random access memory (RAM). In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming system disclosed herein.

In one embodiment, the data network is a local area network (LAN), in which one, more or each of the gaming tables are substantially proximate to each other and an on-site central server or controller as in, for example, a gaming establishment or a portion of a gaming establishment. In another embodiment, the data network is a wide area network (WAN) in which one, more or each of the gaming tables are in communication with at least one off-site central server or controller. In this embodiment, the plurality of gaming tables may be located in a different part of the gaming establishment or within a different gaming establishment than the off-site central server or controller. Thus, the WAN may include an off-site central server or controller and an off-site gaming table located within gaming establishments in the same geographic area, such as a city or state. The WAN gaming system may be substantially identical to the LAN gaming system described above, although the number of gaming tables in each system may vary relative to each other.

In another embodiment, the data network is an internet or intranet. In this embodiment, the game operation at each gaming table can be viewed with at least one internet browser. In this embodiment, operation of each gaming table and accumulation of credits may be accomplished with only a connection to the central server or controller (the internet/intranet server), through a conventional phone or other data transmission line, digital subscriber line (DSL), T-1 line, coaxial cable, fiber optic cable, or other suitable connection. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

In one embodiment, one or more gaming tables in the gaming system at least includes at least one processor, such as a microprocessor, a microcontroller-based platform, a suitable integrated circuit or one or more application-specific integrated circuits (ASIC's). In one embodiment, the processor is in communication with or operable to access or to exchange signals with at least one local data storage or local memory device.

In one embodiment, the local memory device stores information about the player's wagers and tournament information. The local memory may also store, at least in part, other data such as image data, event data, player input data, or information and applicable game rules that relate to the play of the gaming table. In one embodiment, the local memory device includes random access memory (RAM). In one embodiment, the local memory device includes read only memory (ROM). In one embodiment, the local memory device includes flash memory and/or EEPROM (electrically erasable programmable read only memory).

Gaming Table

In one embodiment, each of the gaming tables is a conventional table and the chip identification devices are not directly integrated or situated in or on the gaming tables. That is, the chip identification devices of the tracking systems can, for example, be positioned above the table or below the gaming table. In this embodiment, the gaming establishment does not have to purchase new gaming tables. Rather, the gaming establishment may install the chip identifying technology around the gaming tables.

Figure 2:
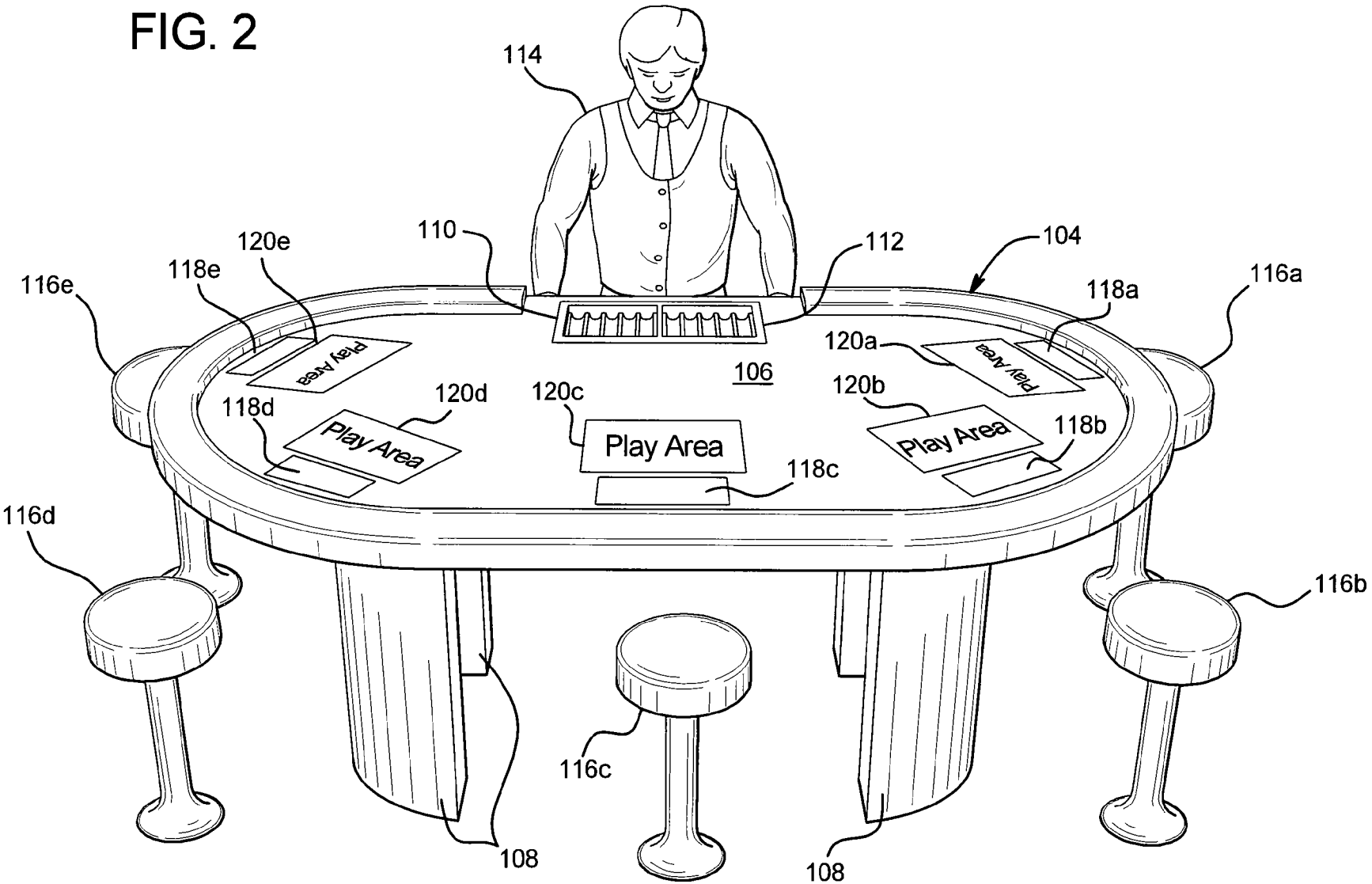
FIG. 2 is a perspective view of one embodiment of a gaming table of the present disclosure.

In one embodiment, as illustrated in FIG. 2, the gaming table 104 includes a suitable support structure 108, such as one or more legs, a playing surface 106 and a dealer position 114. In one embodiment, the dealer position includes two different chip trays 110 and 112 for holding several stacks of the dealer's chips. The dealer may use the chip trays 110 and 112 to collect and store tournament and non-tournament chips, to make change for a player or allow a player to buy into a game or a tournament. The gaming table includes a plurality of player stations or seats 116*a*, 116*b*, 116*c*, 116*d* and 116*e*. In this example, there are five player stations or seats. It should be appreciated that the gaming table may accommodate any suitable number of player positions and players so as not to interfere with game play. In one embodiment, the gaming table includes a plurality of chip holding areas 118*a*, 118*b*, 118*c*, 118*d* and 118*e* where the players hold their chips. In certain embodiment, the gaming tables include wagering areas (not illustrated) where players place their bets. It should be appreciated that the gaming table may also include a community wagering area (not illustrated) where all players place their wager. In one embodiment, the gaming table also includes a plurality of playing areas 120*a*, 120*b*, 120*c*, 120*d* and 120*e* associated with each of the player stations. In one embodiment, cards are dealt by the dealer substantially within the respective playing areas, such that cards dealt to a first player position are not confused with cards dealt to a second different player position. It should be appreciated that tournament and non-tournament games may include other games such as roulette and craps. The gaming tables are operable to include any of the required components of the games. It should be appreciated that the gaming tables may include the same game components or different game components. It should also be appreciated that the gaming tables may include any suitable game components or apparatuses.

Central Controller in Communication with Different Systems

Figure 3:
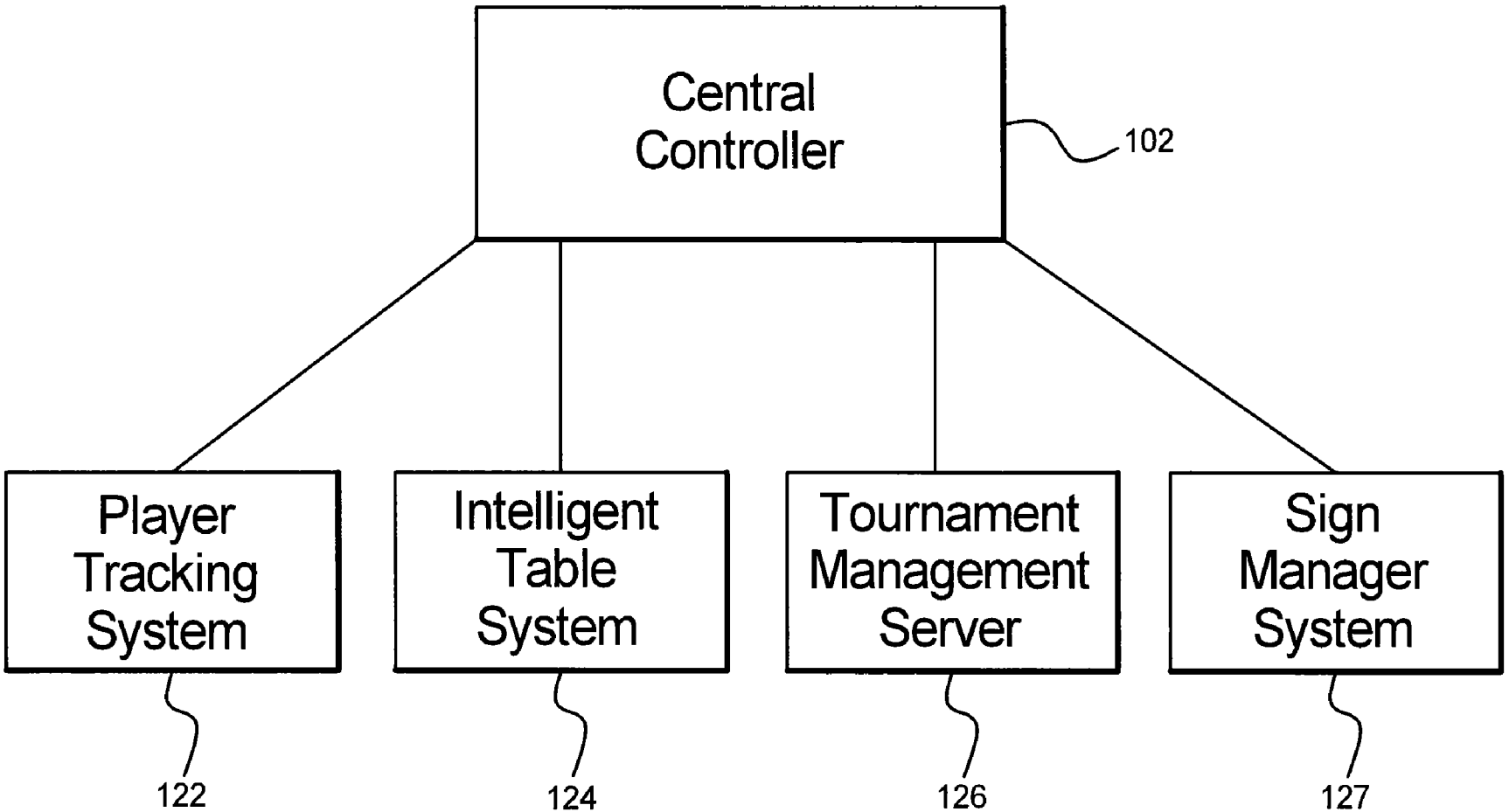
FIG. 3 is a schematic block diagram of an electronic configuration of one embodiment of the gaming system disclosed herein.

As illustrated in FIG. 3, in one embodiment, the central controller includes, is in communication with or is integrated with a plurality of different gaming servers or systems. It should be appreciated that the central controller may include each of these gaming systems or perform one, a plurality or all of the functions of each of these gaming systems. In one embodiment, the central controller 102 is integrated with a player tracking system 122, an intelligent table system 124 and a tournament management system or server 126 and a sign manager system 127.

Tournament Tracking System-Player Tracking System

The gaming system is integrated with one or more player tracking systems. In this embodiment, the gaming system and/or player tracking system is operable to track any participating player's gaming activity at each gaming table of the gaming system that the player plays. In one such embodiment, the gaming system and/or the associated player tracking system timely tracks when a player inserts their playing tracking card to begin a gaming session and also timely tracks when a player removes their player tracking card, stops playing at the gaming table or cashes out when concluding play for that gaming session. That is, in one embodiment, the gaming system, the individual player station and/or the associated player tracking system tracks card-in/card-out for each gaming session. In another embodiment, the dealer logs the player in and out. In one such embodiment, at the start of a gaming session, the player hands the player's tracking card to the dealer and the dealer logs the player in and out for a gaming session. In different embodiments, the gaming system works in accordance with the player tracking system to maintain data about players including, but not limited to: the player's account number, a player's identification number, the player's card number, the player's first name, the player's surname, the player's preferred name, the player's player tracking ranking, any promotion status associated with the player's player tracking card, tournament information, information about the player used for statistical analysis, the player's address, the player's birthday, the player's anniversary, the player's recent gaming sessions, or any other data deemed suitable by the gaming establishment operator.

In other embodiments, rather than requiring a player to insert a player tracking card or enter identifying information, the gaming table utilizes one or more portable devices carried by a player, such as a cell phone, email communication device, a radio frequency identification tag or any other suitable wireless device to track when a player begins and ends a gaming session. In other embodiments, the gaming table utilizes any suitable biometric technology or ticket technology to track when a player begins and ends a gaming session.

Each of these player tracking data may be used for any purpose in non-tournament game play and in tournament game play. For example, player tracking data may be used to determine qualification for the tournament. The player tracking data may also be used to determine who is likely to accept a tournament invitation and come to the tournament.

Each of the gaming tables may include any suitable number of player tracking input devices, such as card readers or key pads to enter identification numbers. In one embodiment, each player station or seat includes an individual player tracking input device. In another embodiment, a gaming table includes a single player tracking input device. In another embodiment, only a dealer has access to the player tracking input device and inputs all of player's information.

Tournament Tracking System-Intelligent Table System

The intelligent table system 124 may include any suitable components or devices to monitor the players' gaming activity. That is, intelligent table systems are able to track how much a player wagers or how many chips a player wagers, how much a player has won or lost, how many chips the player has on the gaming table, or any other desired tracking information. In one embodiment, the intelligent table system is able to track this information for each and every game played by the player. In one embodiment, the intelligent table system is integrated directly with the player tracking system to enable players to be identified. In another embodiment, the communication from the intelligent table system and the player tracking system is controlled through the central controller 102. The intelligent table system may include any suitable gaming table areas with chip identification devices, any suitable method of identifying the tournament chips, and may use any suitable chip reading technology.

Types of Chips

The present system can be configured such that all chips in the gaming establishment where the tournament is conducted include chip identification tags. In one such embodiment, all of the chips are tracked and identified. That is, the gaming system tracks and identifies all of the chips in the gaming establishment and some chips are identified as tournament chips and some chips are identified as regular or non-tournament chips by the gaming system. In one such embodiment, chips may be identified as tournament chips for a certain period of time, such as during a tournament. When the tournament is complete, the chips then are identified as regular chips. That is, the tournament parameters determine when a tournament is being played. When a tournament is being played, the regular chip is tracked as a tournament chip. It should be appreciated that the tournament chips may be identified in any suitable manner.

In another embodiment, only certain tournament chips include chip identification tags. The gaming system may only track or identify designated tournament chips.

Chip Identification by Chips Wagered

In another such embodiment, the gaming system determines whether a chip is a tournament chip or a non-tournament chip based on the chip wagered by the player. More specifically, certain chips are identified by the gaming system as tournament chips and certain chips are identified by the gaming system as non-tournament chips. In one embodiment, the chips are similar and the chips are operable to change based on the chips the player's wager. That is, each chip may be identified as a non-assigned chip, which is neither a tournament chip nor a non-tournament chip. Each chip may be tagged or assigned an identity as a tournament chip or a non-tournament chip. This embodiment enables players to play a tournament at a gaming table where players are playing non-tournament games in a self-scheduled tournament without identifying themselves as tournament players. That is, tournament chips do not have to be readily identifiable to other players.

Figure 4A:
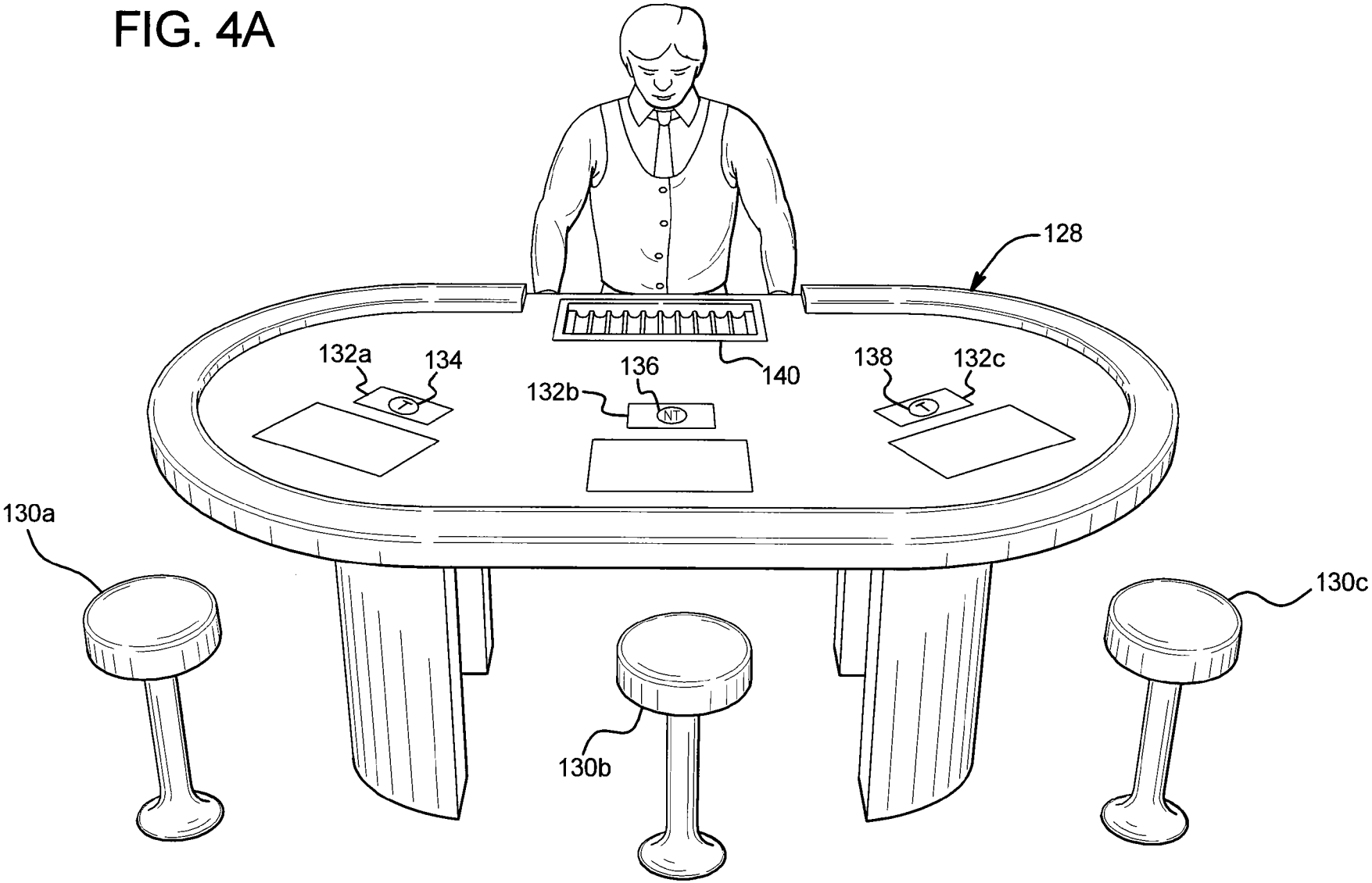
FIGS. 4A and 4B are perspective views of one embodiment of a gaming table with tournament chip identification or non-tournament chip identification based on the chips wagered by the players.

For example, as illustrated in FIG. 4A, a gaming table 128 includes a dealer station 140 that includes a single chip holder. The gaming table includes a plurality of player stations 130*a*, 130*b* and 130*c* which each include a wagering area 132*a*, 132*b* and 132*c*. In one embodiment, the chips are not assigned chips (NA) which have not been identified as a tournament chip or non-tournament chip. The players have non-tournament chips (NT) and tournament chips (T). When a dealer presents a win to the player, the gaming system assigns the chip the same identification as the chip wagered by the player.

As illustrated in FIG. 4A, the player at the first player station 130*a* wagers a tournament chip 134 in the wagering area 132*a*. The player at the second player station 130*b* wagers a non-tournament chip 136 in the wagering area 132*b*. The player at the third player station 130*c* wagers a tournament chip 138 in the wagering area 132*c*. The chips of the dealer are not assigned a tournament identification or a non-tournament identification.

Figure 4B:
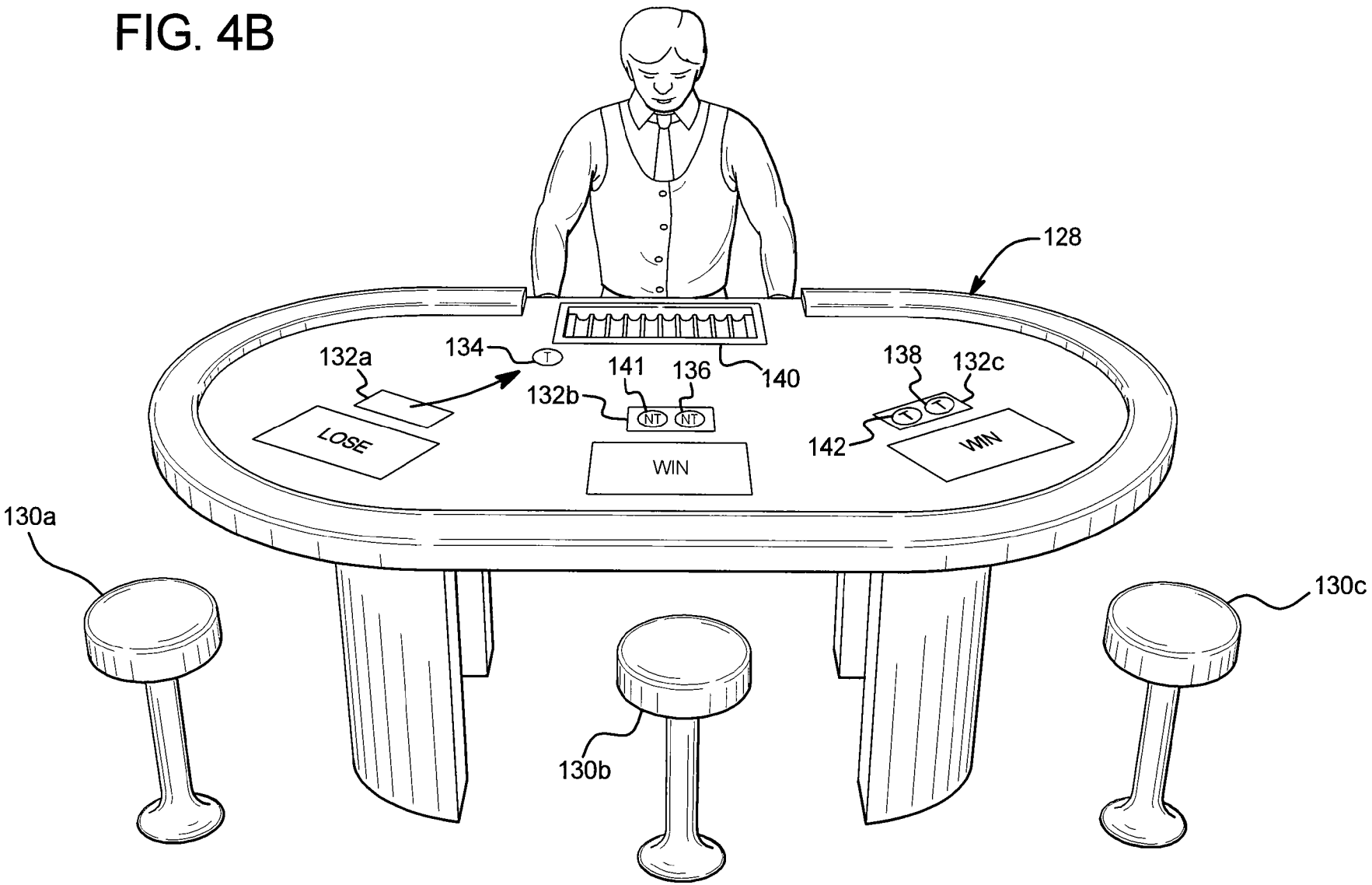

As illustrated in FIG. 4B, the player at the first player station 130*a* does not win. The player at the second player station wins and therefore, the dealer places a chip 141 in the wagering area 132*b*. The gaming system identifies the chip as a non-tournament chip because the player wagered a non-tournament chip. The player at the third player station wins and therefore, the dealer places a chip 142 in the wagering area 132*c*. The gaming system identifies the chip as a tournament chip because the player wagered a tournament chip. In this embodiment, the dealer's burden is reduced because the dealer does not have to determine which chips to provide the player. Additionally, in one example of this embodiment, a player may play a tournament without other players readily identifying the chips and knowing that they are playing in a tournament.

It should be appreciated that values may be assigned to tournament and non-tournament chips in any suitable manner. In one embodiment, different denominations of chips are visually different, such as having the value displayed on the chip. It should also be appreciated that the chips may be any suitable type and size of chip.

Values of Chips

It should be appreciated that chips may have any suitable value. In one embodiment, each tournament chip is worth a same value, such as every player receives 100 one dollar chips for a tournament. The intelligent table system then identifies the total number of chips that each player has.

In another such embodiment, each chip is associated with one of a plurality of different values. The intelligent table system identifies the individual chips. The intelligent table system determines the placement of each chip and sends the information to the player tracking system or central controller about each of the specific chips. The intelligent table system therefore determines or identifies the placement or location of the chip and communicates this information to the central server. In one embodiment, the central server associates the value of the chip with the player tracking account.

For example, as illustrated in the table 144 of FIG. 5, in one embodiment, each of the chips has or is associated with an identification number. It should be appreciated that the chips may be identified in any suitable manner. The intelligent table system determines the chip identification number upon play or win of a chip or upon the evaluation of all of the chips in a player's chip identification area. The intelligent table system sends the chip information to the central server. The gaming system associates the chip number with the amount and the player. For example, a first player's chip identification area includes chip number 876543 which is associated with the value of $1, 876545 which is associated with the value of $5 and 876547 which is associated with the value of $10. The intelligent table system determines which chips are in which identification area and sends the information to the central server. The gaming system associates the chip numbers with their value and uses the information to determine the winner of the tournament.

Technology for Tracking Chips

Intelligent table system can use a variety of types of technology to track player activity. More specifically, in one embodiment, the intelligent table system is operable to include one or more chip identifying devices. In one embodiment, the intelligent table system uses Infra-red signals received from table game chips to track activity. In another embodiment, the intelligent table system employs radio frequency identification (RFID) to track chip activity. The RFID is a system that uses a small electronic device that includes a small chip and an antenna. The chips are scanned at the gaming table to retrieve the identifying information. In another embodiment, the gaming system uses optical technology. The gaming system may use any suitable other chip identification devices, which may use any suitable chip identification technology, to determine player gaming table wagering activities. The chips are tracked for total chip movement or wins and losses. When each chip is placed in a chip identification area, such as a betting circle or in a player's betting or wagering area, chip identification devices recognizes the chip and intelligent table system value and relays this data to the intelligent table system.

Chip Identification Areas

Figure 6:
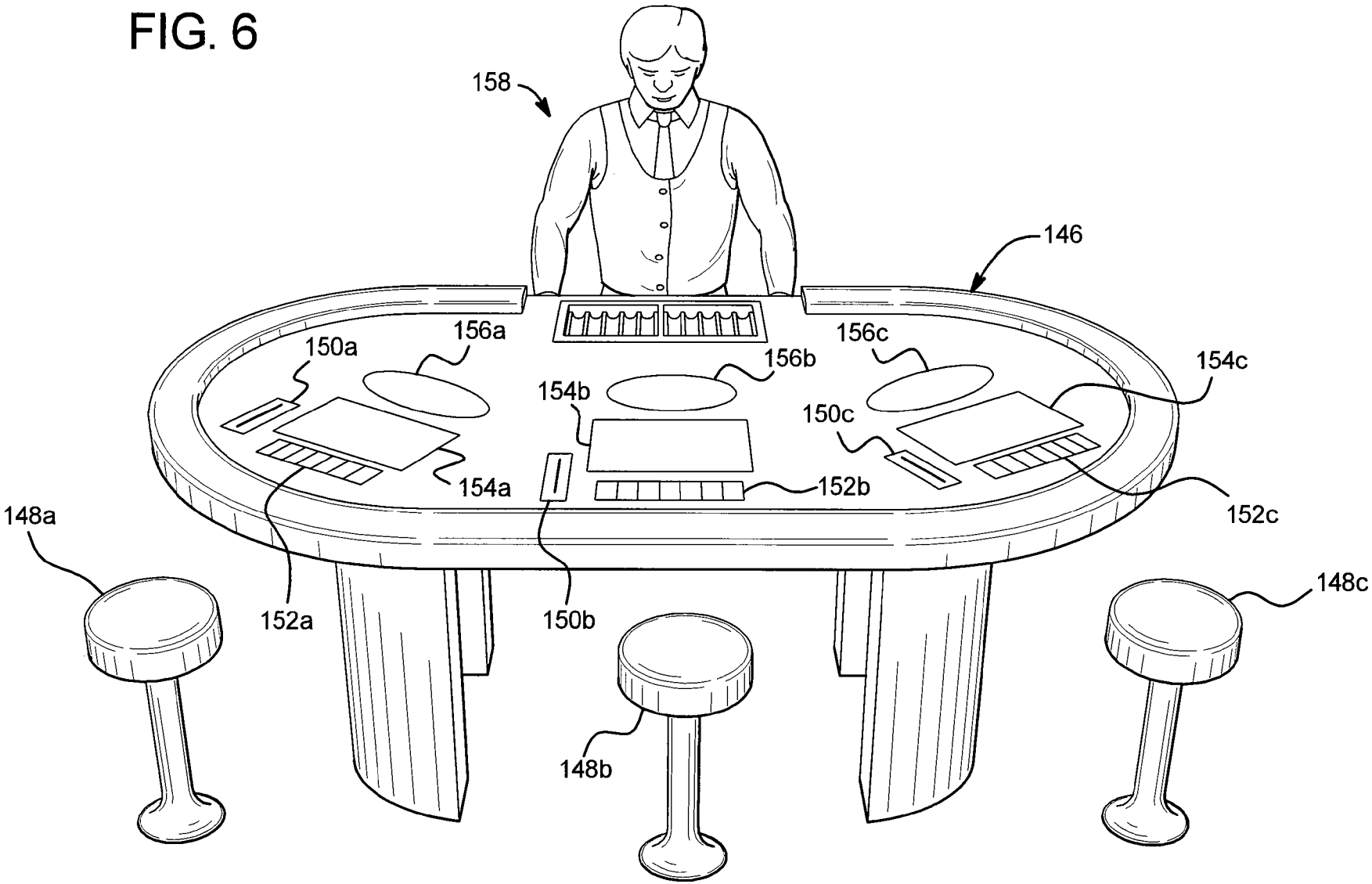
FIG. 6 is a perspective view of one embodiment of a gaming table of the present disclosure.

The present disclosure contemplates a plurality of different methods that the chips may be used in tournaments. FIG. 6 illustrates one embodiment of a gaming table. The gaming table 146 includes a plurality of player stations 148*a*, 148*b* and 148*c* and a dealer station 158. In one embodiment, each of the player stations includes or is associated with a player tracking input device 150*a*, 150*b* and 150*c*. Each of the player stations includes a chip holding area 152*a*, 152*b* and 152*c*. Each of the player stations includes a playing area 154*a*, 154*b* and 154*c*. Additionally, in one embodiment, each of the player stations includes a wagering area 156*a*, 156*b* and 156*c*. It should be appreciated that the gaming table may include any suitable chip identification area.

In one embodiment, the chip identification area is a chip holding area. In one embodiment, intelligent table system identifies all of the chips in a player's chip holding area 152*a*, 152*b* and 152*c*. For example, during tournament play, a player is required to have all chips in that player's possession in a chip holding area 152*a*, 152*b* and 152*c* which each include one or more chip identification devices. Upon a tournament checkpoint, upon a triggering event, throughout a player's play of a tournament or at the end of the tournament, the intelligent table system surveys each of the player's chip holding areas to identify the players' chips. The chip information is sent to the central server and the gaming system determines a tournament result.

In one embodiment, the chip identification area is a wagering area. In one embodiment, the gaming system includes chip identification devices in each player's wagering area 156*a*, 156*b* and 156*c*. A player may not necessarily place all of their chips in a chip holding area. The gaming system identifies the either the specific chips wagered and won by that player or the number of chips wagered and won by the player. For example, a player logs into the player tracking system via a card slot at the player's player station at a gaming table. When a player places a chip in the wagering area associated with that player station, the intelligent table system identifies that chip. When a dealer provides a chip to a player for a win, the intelligent table system identifies the chip. The chip information is then used by the gaming system to determine the tournament winner.

In another embodiment, both the chip holding area and the wagering area include chip identification devices. That is, the gaming system is operable to identify chips in both the chip holding area and the wagering area. Therefore, the gaming system double checks or verifies each player's gaming activity.

In another embodiment, each player station includes a tournament chip holding area and a non-tournament or regular chip holding area. The gaming system may include chip identification devices in only the tournament chip holding area or in both the tournament chip holding area and the non-tournament chip holding area. In one embodiment, each player station includes a tournament wagering area and a non-tournament wagering area. The gaming system may include chip identification devices in only the tournament chip wagering area or in both the tournament chip wagering area and the non-tournament chip wagering area.

In one such embodiment, a tournament includes only tournament chips. In one such embodiment, the intelligent table system identifies either the total number of tournament chips in front of a player at certain checkpoints to update tournament rankings or the chips wagered and won by the player.

In another embodiment, a tournament player may have two different types of chips: non-tournament chips and tournament chips. In different embodiments, each of the chips may include chip identification tags. That is, the gaming system is operable to identify every chip because it includes chip identification tags and is identifiable by the gaming system as a tournament chip or a non-tournament chip. In another embodiment, only the tournament chips include chip identification tags.

In one embodiment, the gaming system enables the player to only play a single game as a tournament game or a regular game. That is, a player may not wager tournament chips and non-tournament chips on a same game. In another embodiment, the gaming system enables the player to wager tournament chips and non-tournament chips on a same game. When the player plays a tournament chip, the dealer pays the player back in tournament chips. When the player plays non-tournament chips, the dealer pays the player for wins in non-tournament chips.

In one embodiment, the gaming system associates the gaming activity directly with players via player accounts. For example, at the start of play, the player logs into the player tracking system, such as by inserting a player tracking card into a card reader associated with their player station on the gaming table. The intelligent table system in one embodiment associates any tracked data with the player's specific account. Thus, in certain embodiments, tracking player activity at the gaming table is similar in accuracy and thoroughness to the tracking done at slot machines.

Chip Tracking without Player Accounts

Alternatively, the gaming system determines the chip count at each player station to determine the winner of the tournament and does not associate the information directly with players. That is, the gaming system enables players to play anonymously and be associated with their current place at the table. For example, a player does not have to log in for the tournament but rather remains at a same player station for the tournament. The gaming system associates the chips with the player stations and determines tournament winners without requiring personal information from the player.

For example, in one embodiment, the tournament is a synchronized tournament. In one embodiment, each player randomly sits down in a player station or is assigned a player station. In one such embodiment, an account is associated with each player station. The players are all given a certain number of tournament chips as illustrated in the table 160 of FIG. 7A. The player at Player Station #1 is given five tournament chips. The player at Player Station #2 is given five tournament chips. The player at Player Station #3 is given five tournament chips. The chips are associated with the player station accounts. For example, tournament chips A, B, C, D and E are associated with Player Station #1 at the beginning of the tournament. Tournament chips F, G, H I and J are associated with Player Station #2 at the beginning of the tournament. Tournament chips K, L, M, N and O are associated with Player Station #3 at the beginning of the tournament.

Figure 7B:
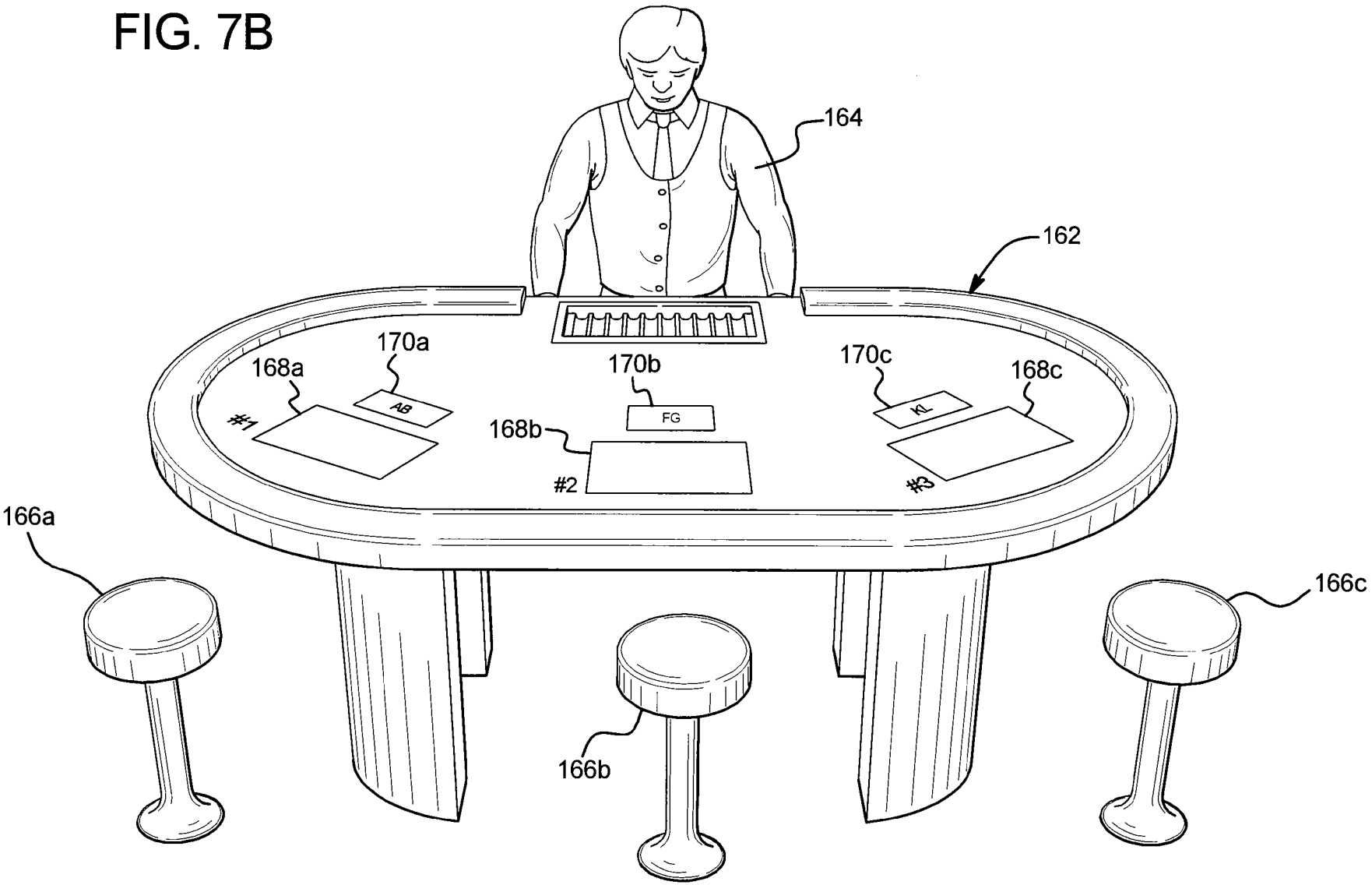
FIGS. 7B and 7C are perspective views of one embodiment of a gaming table illustrating the wagering of some of the tournament chips of FIGS. 7A and 7D.

As illustrated in FIG. 7B, a gaming table 162 includes a dealer station 164 and a plurality of player stations: Player Station #1 166*a*, Player Station #2 166*b*, and Player Station #3 166*c*. Each of the player stations includes a playing area 168*a*, 168*b* and 168*c* and a wagering area 170*a*, 170*b* and 170*c*. As illustrated in FIG. 7B, the players each place a wager. The player at Player Station #1 wagers chips A and B. The player at Player Station #2 wagers chips F and G. The player at Player Station #3 wagers chips K and L.

Figure 7C:
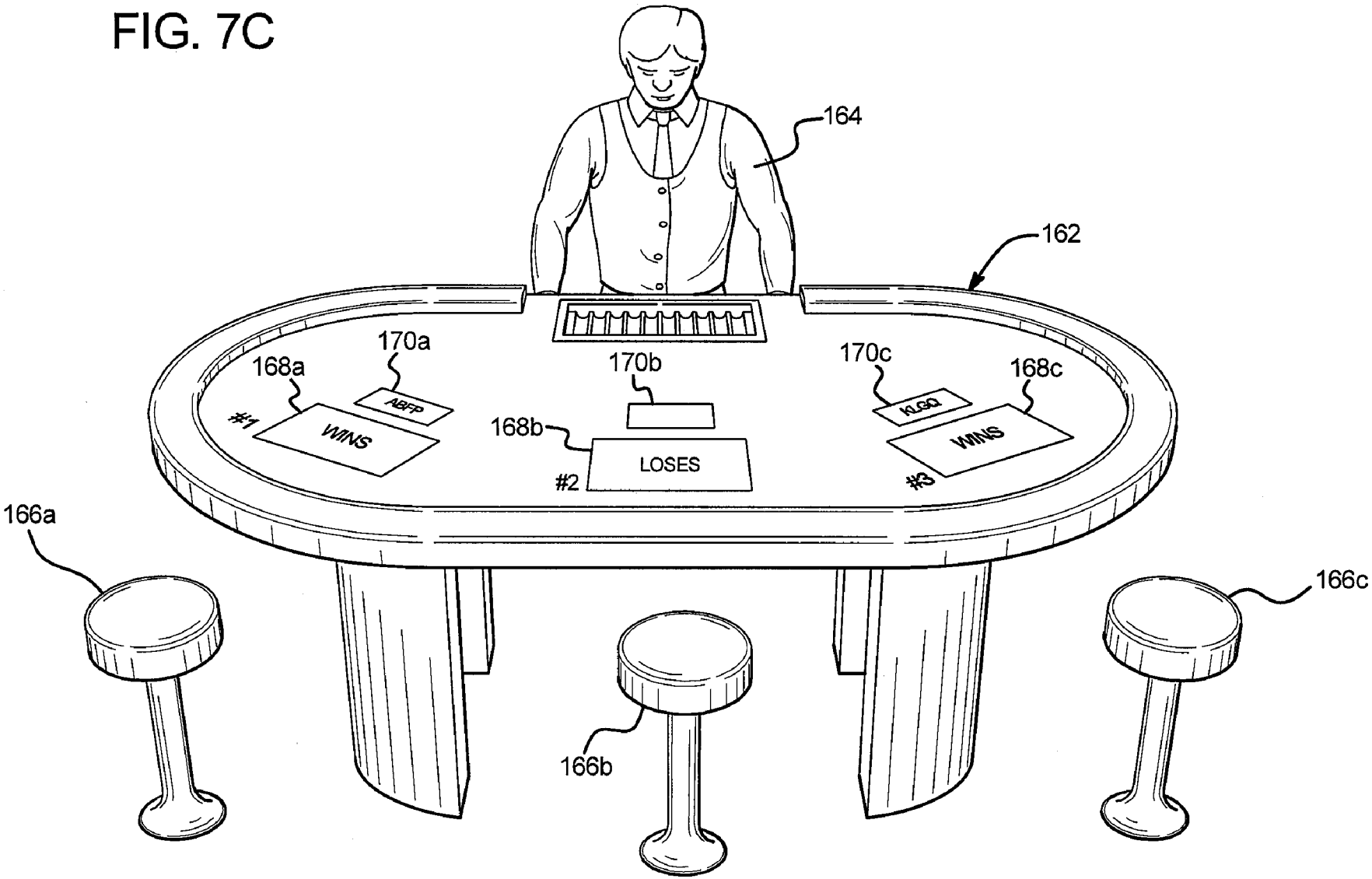

As illustrated in FIG. 7C, the players at Player Station #1 and Player Station #3 both win. The player at Player Station #2 loses. The dealer then takes one of the chips, the F chip, from the player at Player Station #2 and gives it to the player at Player Station #1 in addition to a P chip to pay the player for the win. The dealer then takes one of the chips, the G chip, from the player at Player Station #2 and gives it to the player at Player Station #3 in addition to a Q chip to pay the player for the win.

As illustrated in the table 160 of FIG. 7D, the player station determines which chips are at which player station through the chip identification devices and stores the chip information. For example, tournament chips A, B, C, D, E, F and P are now associated with Player Station #1. Tournament chips H, I and J are now associated with Player Station #2. Tournament chips K, L, M, N, O, G and Q are now associated with Player Station #3. Play continues and the gaming system determines an anonymous winner at the end of the tournament.

Card Reading System

In certain embodiments, the intelligent table system includes one or more card readers or a card reading system. The card reading system knows what card comes out of the shoe and is dealt to what player. In one embodiment, the card reading system is a part of the intelligent table system. In another embodiment, the card reading system is separate from the intelligent table system and in association with the intelligent table system detects betting patterns and decisions to provide to the player tracking system. Such betting patterns and decisions may qualify the player for a tournament or aid in the awarding of comps. The card reading system can also reduce dealer error and or possible corruption by making sure that the players are paid properly for each and every hand. In certain embodiments, the intelligent table system knows the player cards, the dealer cards, and the bet, the intelligent table system is able to determine correct payouts for each and every player at the gaming table. In certain embodiments, the gaming system employs safeguards to make sure the correct payout is made. For example, the gaming system can send a halt play signal if an error is detected. It should be appreciated that in different embodiments the card reading system and the intelligent table system are integrated with or included in one or more tracking systems or player tracking systems. In one embodiment, the gaming system does not include a chip tracking system but tracks the cards to determine tournament results.

In different embodiments, the intelligent table system can be used to detect betting patterns and decisions to aid in the awarding of comps. The card reading system can also reduce dealer error and/or possible corruption by making sure that the players are paid properly for each and every hand. In certain embodiments, the intelligent table system monitors the dealer cards and the bet, so the gaming system is able to determine correct payouts for each and every player at the gaming table and can employ safeguards to make sure the correct payout is made.

Tournament Management and the Tournament Management Modules

Certain gaming establishments include a number of different systems or sub-systems of an overall gaming system that are largely separate. For example, a few of the systems may include a player tracking system, an accounting system, a cage and credit system, as well as a number of other systems. In one embodiment, the tournament management server is in communication with a number of these systems. In one embodiment, the tournament management system is integrated with the other systems via the central controller.

Figure 8:
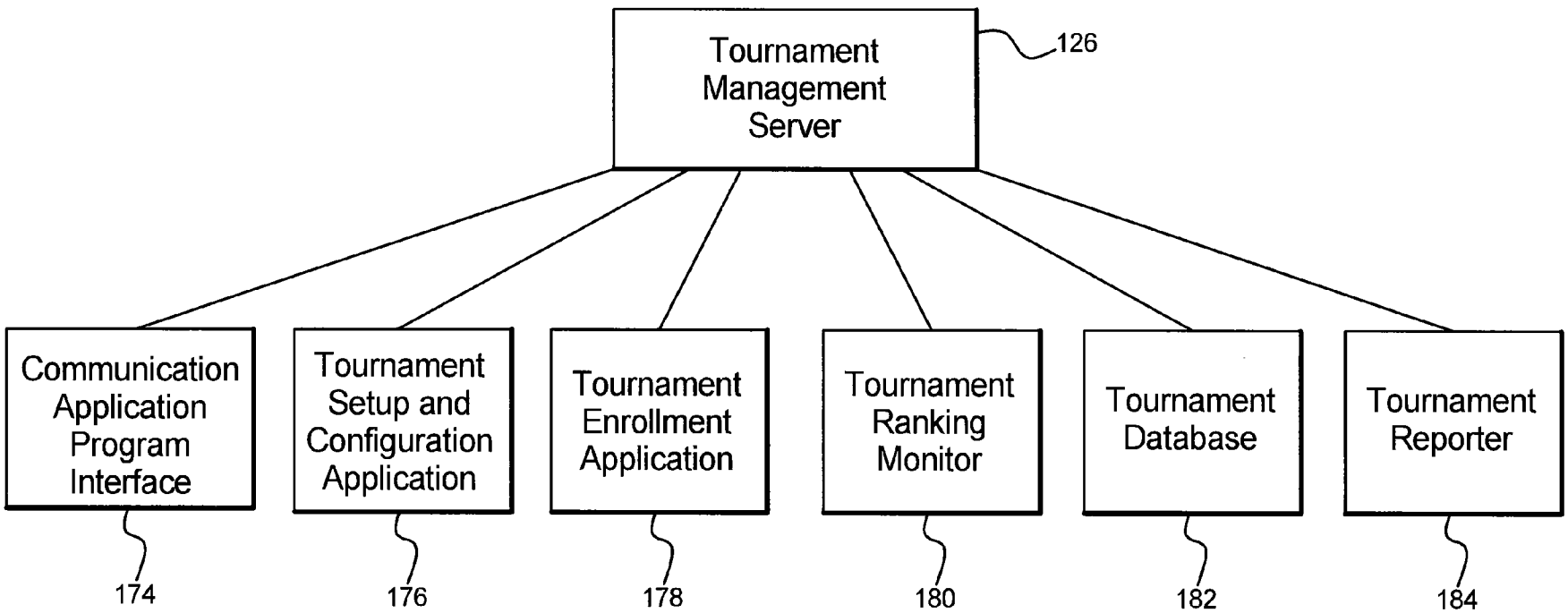
FIG. 8 is a schematic block diagram of an electronic configuration of one embodiment of the tournament management system of the gaming system disclosed herein.

As illustrated in FIG. 8, in one embodiment, the tournament management server or tournament server 126 includes a plurality of different modules. In one embodiment, the tournament management server 126 includes a communication application program interface 174, a tournament setup and configuration application 176, a tournament enrollment application 178, a tournament ranking monitor 180, a tournament database 182, and a tournament reporter 184. It should be appreciated that the tournament management server may include any suitable number of modules.

In one embodiment, a module is a communication application program interface 174. The communication application program interface is in charge of communication with the intelligent table system to gather all of the data associated with table tournament play. In one embodiment, the communication application program interface is also in charge of communication with the player tracking system in order to obtain required player data and perform authentication. That is, in certain embodiments, the communication application program interface communicates with the tournament tracking system to gather all of the data for the tournament. In one embodiment, the communication application program interface of the tournament management server receives information from the casino's player tracking system in order to set up a tournament. For example, the player tracking system may provide a list of all players that qualify for the tournament, such as all gold ranked players. Through communication with other parts of the tournament management server, the gaming system would then be able to set up a tournament, and the communication application program interface would exchange data with the intelligent table system to monitor the tournament results. That is, in one embodiment, the communication application program interface enables or facilitates communication that is required to set up the tournament. In one embodiment, the tournament management server routes the data obtained to the other servers. In one embodiment, the communication application program interface is in communication with an accounting system to provide information on the tournament outcome and what was paid out. In one embodiment, the communication application program interface authenticates participants and tracks outcomes. Through communication with the intelligent table system, the communication application program interface has a direct link into game play at each table. In other embodiments, other systems may need to be interfaced with the communication application program interface based on the needs of the gaming system.

In one embodiment, the communication between the communication application program interface module and other modules in the gaming system is two way, such that activity is freely be sent back and forth between the modules to facilitate the setup of the tournaments, operation of the tournaments, management of the tournaments, and other tournament functions. Data for the gaming system can be monitored, stored and processed in any number of suitable systems.

In one embodiment, the tournament management server includes the tournament setup and configuration application module 176. In one embodiment, this tournament setup and configuration application module is a backend interface to enable users to set up and configure one or more table games in a tournament. In this configuration application module, a gaming establishment employee is enabled to set up, configure, or modify a number of different tournaments. In this configuration application module, the employee can define a number of parameters related to the tournament. It should be appreciated that in different embodiments, the gaming system enables the tournament to be configured by a gaming device distributor, a gaming establishment operator or in an alternative embodiment, by a player. The gaming system may enable any suitable tournament parameters to be configured. For example, as discussed below, in different embodiments, the tournament parameters include tournament type, tournament time, tournament length, eligible players, eligible tables, rounds, prizes, or any other information deemed pertinent to the tournaments operation.

In one embodiment, the tournament management server includes the tournament enrollment application module 178. This tournament enrollment application module is an interface to enroll players into a tournament. The tournament enrollment application module may be displayed on a number of different interfaces, such as a monitor, a kiosk, a handheld device, a gaming machine, a hotel television, a point of sale receipt or any other suitable display devices. In one embodiment, through this tournament enrollment application module, a player is given limited access to the tournament system. The gaming system enables the players to directly enroll in the tournament. In one embodiment, the gaming system enables the player to use an input device, such a touch screen device, at the gaming table to enter the tournament. In one embodiment, the gaming system enables the player to enter their information and request enrollment in the tournament. Depending on the type of tournament, in one embodiment, the gaming system enables the player to initiate play, pause play, or re-initiate play (such as with a "number of hands" tournament). In certain embodiments, the gaming system only enables the player to initiate play at a single input device or gaming table of the gaming system (such as with a time based tournament). In other embodiments, only gaming establishment employees are given access to the tournament management system. In these embodiments, the gaming establishment employees enter the players into a tournament or register or enroll the players.

In one embodiment, the tournament management server includes a tournament ranking monitor module 180. In one embodiment, this tournament ranking monitor module is a display interface that allows the players to view the current tournament standings. In one embodiment, the tournament ranking monitor is integrated with or in communication with the sign manager in a local area or though-out a gaming establishment. In another embodiment, the tournament ranking monitor is not integrated with the sign manager. In one embodiment, once data from the tournament is collected and assessed, the results are displayed and provided to the players almost instantly. That is, in one embodiment, the gaming system includes or is integrated with one or more display devices that provide the players the tournament results as the tournament happens in real-time or substantially close to real-time. In one embodiment, as each new entry into the tournament is received, the results are updated in the gaming system and the new output would be immediately displayed to the players. This immediate calculation and display of the tournament standings, enables players to know the status of the tournament and see their standings and results almost immediately after posting them. This creates an excitement as the tournament's progress can be easily monitored and followed by everyone in the gaming establishment.

It should be appreciated that any number of different display devices may be used in the gaming system including overhead signage, table signage, monitors, handheld devices, or any other appropriate display device. The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, a display device includes a touch-screen with an associated touch-screen controller. The display devices may be of any suitable size and configuration, such as a square, a rectangle or an elongated rectangle. In one embodiment, at least one display device may be a mobile display device, such as a PDA or tablet PC. In one embodiment, the gaming establishment provides the tournament players with one or more portable display devices to enable them to travel around the gaming establishment and still view their scores.

In one embodiment, one or more display devices displaying the tournament information are localized to the specific area in which the tournament occurs. These display devices enable the players to view the results as they play or immediately after. In another embodiment, display devices are strategically placed around the gaming establishment and are updated on a regular basis for players to view. This dissemination of tournament information is useful when a tournament spans a wider area or lasts for long periods of time. This dissemination of tournament information also enables players to move around the gaming establishment throughout the tournament and still be able to view their tournament standings. These display devices may also serve as digital glass operable to advertise games or other aspects of the gaming establishment.

In one embodiment, the tournament management server includes a tournament database module 182. In one embodiment, the tournament database module stores details of each tournament. For example, the tournament database may store tournament length, tournament type, tournament time or any other tournament parameters. In one embodiment, this tournament database module stores and associates player identification to tournaments and provides historical and current tournament data for display and reporting. In one embodiment, when a player is entered into the system, the gaming system assigns the player identification, such as a player identification number or name. In one embodiment, anytime a player with a player identification participates in a tournament, their player identification is associated with the tournament. Based on the type of tournament being played, in different embodiments, different information and results are stored, such as number of chips won, type of game being played, total hands played, etc. This information can then be used by the other modules to report the outcome and display the standings. It should be appreciated that any number of parameters or fields related to the tournament or gaming establishment may be stored in the database and used for a variety of purposes (i.e., for displays, accounting, tracking, etc.).

In one embodiment, the tournament management server includes a tournament reporter module 184. This tournament reporter module reports status or results for each of the individual tournaments. In one embodiment, the tournament reporter module provides summary and detail reports for each individual tournament or for all of the tournaments. In one embodiment, through communication with the tournament database module and the tournament setup module, the tournament reporter is operable to access data regarding the tournament and provide reports on the tournament. For example, a gaming establishment employee could query the reporter for the outcome of the last 15 tournaments. This provides the employees with the ability to easily peruse and assess tournament performance. In one embodiment, the tournament reporter is integrated with a variety of systems. For example, the tournament reporter may be in communication with the player tracking system, the accounting system, and cage and credit system or any other system desired by the gaming establishment. By communicating with these systems, the tournament reporter can update the status of the tournament and provide relevant data those systems need and use.

In one embodiment of the tournament management server, the communication application program interface receives data from the intelligent table system, the player tracking system, and accounting systems related to the tournament. The tournament setup and configuration module is used to create a tournament and communicates with one or more other modules to receive information related to the tournament, such as eligible players, eligible tables or other pertinent information. The "created" tournament information is sent into the one or more of the systems or modules where it would be routed to the intelligent table system. The "created" tournament would also be in communication with the enrollment application which would enable players to enter or be entered in the tournament through a number of external devices.

Sign Manager System

In various tournaments, the central server or controller broadcasts performance messaging to one or more devices in the gaming system. In one embodiment, the central controller is incorporated with a sign manager which integrates with the central controller to display any suitable information.

By utilization of the central server to communicate with each sign controller, the gaming system presents a wealth of information to the player about not only tournaments the player is participating in, but also other tournaments or jackpot awards that may be available to the player. Furthermore, the central server and sign controller configuration enables for the signs to be custom tailored to the player who is playing each player station to provide the player with information that will be most beneficial to their gaming session. The messaging system facilitates complete customization of the tournament at the gaming establishment level and tournament level.

The sign controller is central to the sign integration used with the tournament system. This sign integration provides players with important information regarding the tournaments. A sign module in the central server communicates with the sign controllers of selected display devices/signs (determined by any number of factors) on the gaming floor. For example, if a tournament is available only from gaming tables in a specific section of a gaming establishment, only signs and display devices in that specific section provide and display tournament information.

The signs/display devices may broadcast information such as player scores or standings. The signs/display devices can provide real time tracking to the player as to the status of the tournament. The signs/display devices help a player determine their standing in the tournament, what the player needs to try to achieve to win, as well as specific tournament information, such as when the tournament is over and what is required to participate in the tournament. Frequently, to broadcast tournament information, gaming establishments employ constant audio announcements through out the gaming establishment regarding the tournament information. The ability to provide this information over a sign controller provides stream lined and non-invasive tournament messaging.

Tournament Configuration

In one embodiment, prior to tournament game play, the tournament must be configured. The gaming system is operable to be configured in a plurality of methods. However, it should be appreciated that different embodiments of this gaming system may include any single suitable configuration method or any combination of suitable configuration methods.

The gaming system is operable to upload one or more pre-configured tournament programs. That is, a distributor, such as a gaming machine distributor, manufactures and sells a plurality of different pre-configured tournament programs. The gaming system is operable to upload one of the pre-configured programs to the central controller and to create a programmed table game tournament.

The gaming system is operable to upload a pre-configured game program that is operable to be modified or customized. That is, a distributor, such as a gaming machine distributor, manufactures and sells a plurality of different pre-configured table tournament game programs. A gaming establishment may purchase one or a plurality of these pre-configured table tournament game programs and upload these table tournament game programs to the central server. However, one or a plurality of tournament parameters of these table tournament game programs are customizable. Therefore, if the gaming establishment operator wants to change a parameter of the tournament, for example, the theme of the tournament, the pre-configured table tournament game programs enable the gaming establishment operator to customize the tournament in one or a plurality of ways. That is, the gaming establishment operator inputs one or more configuration guidelines that control one or more elements of the tournament.

The configuration guidelines may be used to define the actual game play or structure of the tournament. Additionally, the configuration may be used to customize a tournament for advertising purposes. For example, the gaming establishment operator can include the name of the gaming establishment and a name for the tournament in the customization process. The tournament may be customized to have a certain theme.

The theme and title of the tournament may reflect the advertising of one or more tournament sponsors. For example, if Company A is a vehicle company that sponsors the tournament, the prizes from the tournament may be vehicles from Company A and the tournament may include advertising and promotion for Company A.

The customization of the tournament enables the gaming establishment to pursue any suitable advertisements. For example, during a tournament, the gaming establishment may promote the next tournament to increase player awareness and participation in the next tournament. The tournament may be used for other gaming establishment and hotel promotion, such as advertisements for the restaurant in the gaming establishment or shops in the hotel. Additionally, the gaming establishment may run advertisements for other, non-affiliated corporations during the tournament.

In one embodiment, after one of the pre-configured modifiable table tournament game programs is uploaded in the gaming system, the gaming system provides menu choices displayed on a display device linked to the central controller to enable the gaming establishment operator to easily input one or a plurality of the tournament parameters. The ability for the gaming establishment operator to configure the tournament is beneficial for creating customized tournaments. That is, such a configuration enables the gaming establishment to create, edit, and modify tournaments based on their specific needs.

Figure 9:
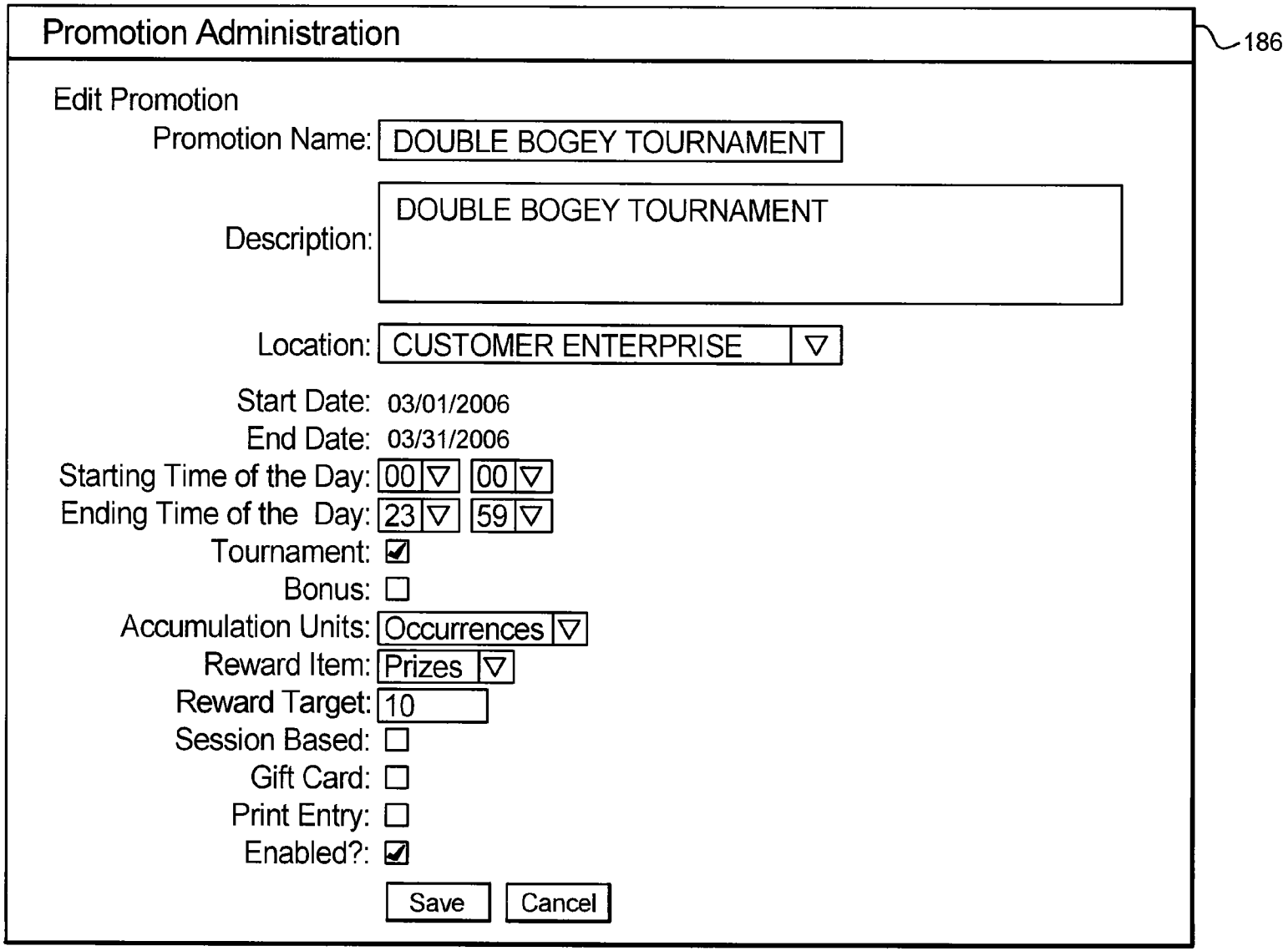
FIG. 9 is a screen shot of certain tournament parameters that are customizable for a tournament in accordance with one embodiment disclosed herein.
Figure 10:
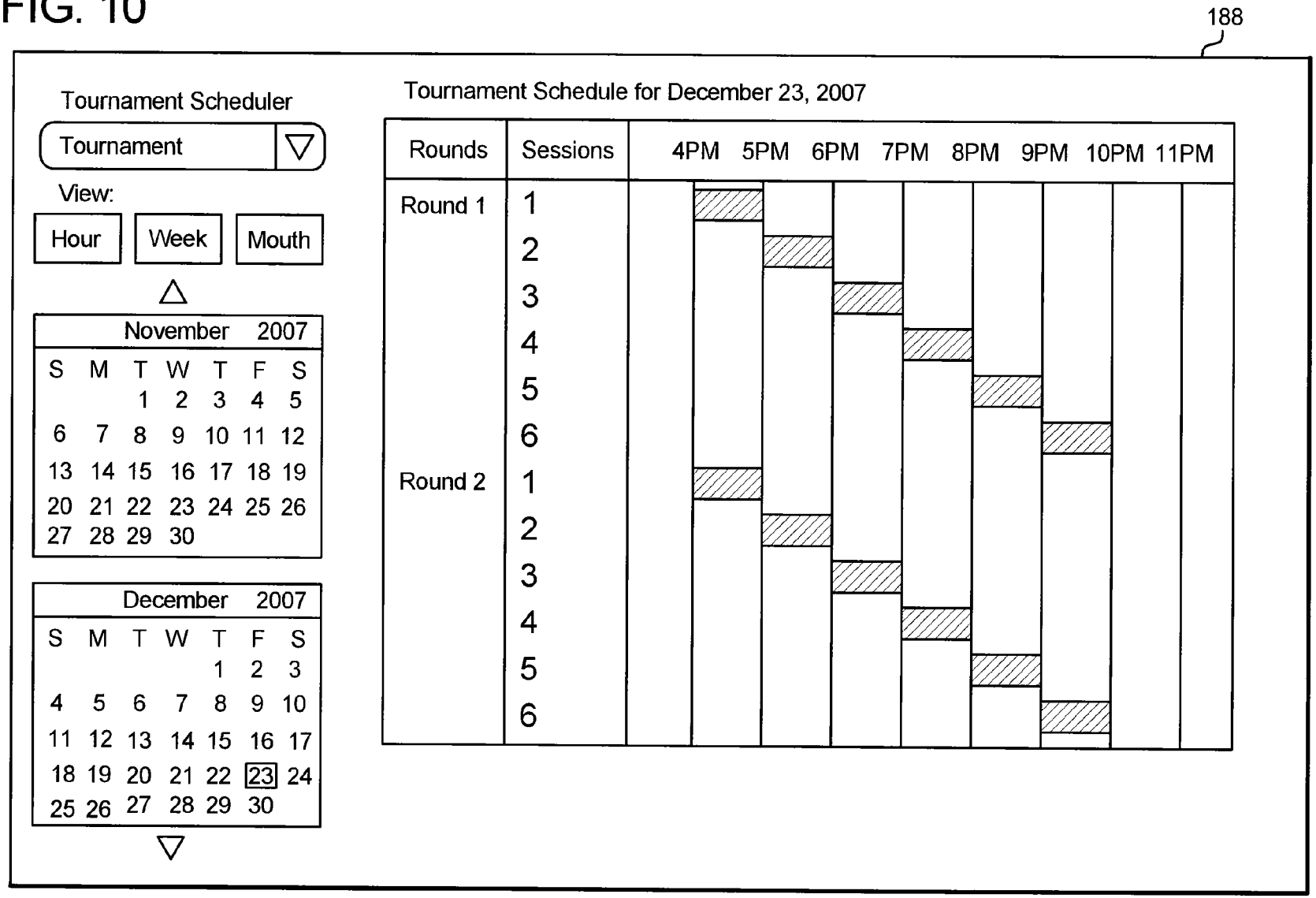
FIG. 10 is a screen shot of certain tournament parameters that are customizable for a tournament in accordance with one embodiment disclosed herein.

FIGS. 9 and 10 illustrate example screen shots from one of the customizable game programs. As illustrated in the screen shot 186 of FIG. 9, certain elements of the tournament are customizable. That is, the table tournament game program may include a default tournament name. However, the gaming establishment operator may change that parameter of the table tournament as illustrated in FIG. 9. The screen shot 188 of FIG. 10 illustrates a customizable tournament schedule. It should be appreciated that this type of input screen may be used to modify any customizable tournament parameter.

In one example of customization of a tournament gaming system, the gaming system enables a gaming establishment operator to retrieve or pull up one or more configurable tournament game programs via the central controller or server. For example, if the gaming establishment operator wants to create a new tournament, the gaming system enables the gaming establishment operator to enter information pertinent to the tournament, such as a tournament name, a tournament description, location, start date, end date, start time, end time, prize information, tournament format, or any other desired information. The table tournament game program further enables the gaming establishment operator to enter or input information to further customize the tournament (such as the number of rounds, rounds allowed per day, the time between different sessions, player qualification information, maximum number of players, machine information, maximum number of player stations or tables, buy-in information, number of winners, length of tournament, paytable, advertising and theme information or any other desired information). The gaming establishment operator can also further integrate the table tournament with the display devices via the sign manager. The gaming establishment operator can also further integrate the table tournament with other devices, such as gaming machines of the gaming establishment, kiosks, or other devices to advertise the tournament. For example, upon tournament configuration completion, the gaming establishment operator may choose to advertise the tournament on display devices through-out the gaming establishment via the sign manager system, which is a system that integrates the display devices of the gaming system. The gaming establishment operator may use information from the player tracking system to contact, such as by email, all of the players of the last three tournaments to advertise the newly configured tournament. It should be appreciated that upon tournament configuration, the gaming establishment may advertise the tournament in any suitable manner.

This customization functionality provides the gaming establishment with maximum flexibility to create tournaments, almost instantaneously, modify parameters of the tournament, advertise the created tournament, and easily customize the tournament to meet the gaming establishment's current needs.

Additionally, the gaming system is operable for the gaming establishment operator to completely customize an entire tournament. That is, the gaming system is operable for the gaming establishment operator to configure every aspect of a table tournament to create a new and unique tournament based on one or more gaming establishment operator selectable tournament configurations or tournament elements.

Figure 11:
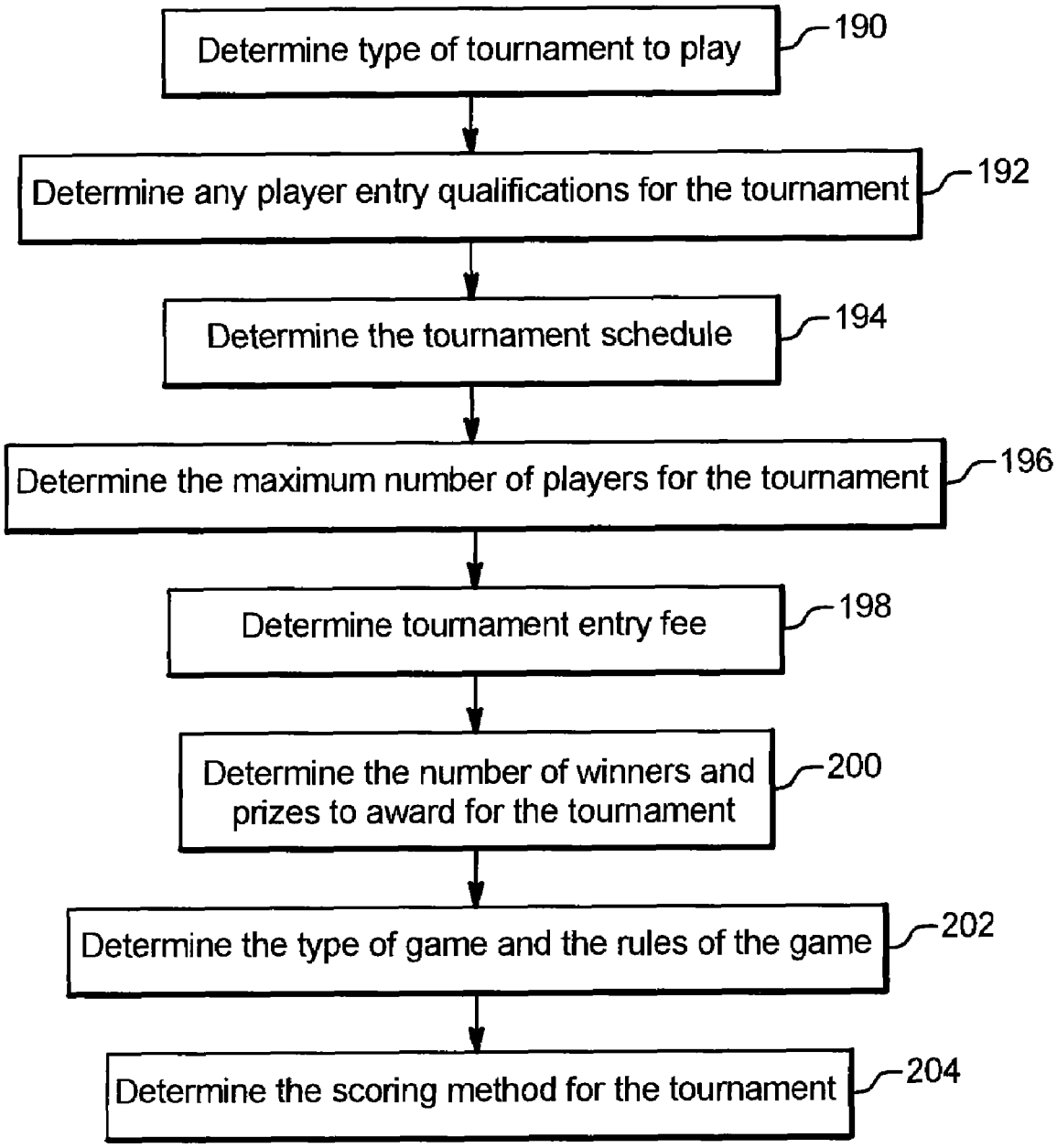
FIG. 11 is a flow chart of one method of one embodiment of tournament configuration.

FIG. 11 illustrates one embodiment of the method of configuration of a table tournament of the present disclosure. The gaming system makes the decisions of how to run the table tournament based on information input into the gaming system via uploading a game program and/or via input from a gaming establishment operator.

As illustrated in block 190, one of the tournament parameters is the type of tournament to play. It should be appreciated that the tournament may be any suitable type of tournament, such as an invited guest tournament, an automatic bonus tournament or an on-demand tournament, as discussed in more detail below. The invited guest tournament is a tournament that has a predetermined list of players that may play in the tournament. Only players on the guest list may play in the tournament but in some embodiments, players may quickly be added to the guest list. In this embodiment, the guest list is uploaded into the gaming system or manually entered into the gaming system. For an automatic bonus tournament, any number of players may play the automatic tournament upon meeting certain eligibility or qualification requirements, which are further discussed below. In an on-demand tournament, a player may request to play in a tournament.

The gaming system determines whether the tournament will be manually started by a gaming establishment operator or if the gaming system will automatically start the tournament. In one embodiment, the central controller is operable to send a signal to the intelligent table system to automatically start and end the gaming tournament. That is, the intelligent table system monitors and records game play and then stops monitoring and recording game play to create the tournament. In another embodiment, the gaming system or operator notifies each of the dealers of the time to start the tournament. In a self-scheduled tournament, the gaming system program in combination with the servers and sub-systems of the gaming system starts and stops the tournament.

In one embodiment, the gaming system determines what type of sessions and rounds the tournament will include. In a synchronized tournament a plurality of players each play the tournament at the same time, frequently in a relatively same location. If there are more players for a round than the number of designated player stations or seats, that round of a tournament is played in multiple sessions, with a certain number of players simultaneously playing each session. For example, if three hundred players are participating in a round of the synchronized tournament and the tournament includes one-hundred player stations at the designated gaming tables, the tournament must include three sessions of the tournament for each round (300/100) to enable each participating player to participate in the round. Therefore, one-hundred players will simultaneously participate in the gaming tournament during each session. In one embodiment, the gaming system has appropriate checks to make sure a player is not allowed to play more than one session per round.

In another embodiment, the tournament is a self-scheduled tournament. The self-scheduled tournament includes a plurality of players participating in a round of a tournament according to the tournament parameters that determine a time to play the tournament within a range of designated times. That is, a player can individually participate in the tournament at a different time than the other players. If a tournament has more than one round, the gaming system may provide the participating players with a certain date/time to complete each of the rounds. The self-scheduled tournament provides players the flexibility of deciding when to play the tournament and what gaming table and player station to play the tournament on.

As illustrated in block 192, the gaming system determines the qualifications for the player to play in the tournament. It should be appreciated that any suitable qualifier or qualification or combination of qualifications may be employed to determine eligibility for tournament play. FIG. 12 includes a table 206 that illustrates a plurality of possible player entry qualifications for a tournament.

As illustrated in FIG. 12, in certain types of tournaments, a method or characteristic of a player's game play qualifies the player for tournament entry. In one embodiment, the amount a player wagers determines whether the player is qualified for the tournament. The wager qualification amount may be measured in any suitable manner.

In certain types of tournaments, the wager qualification amount is determined by the amount a player wagers (i.e., a player's total wagers) on at a single gaming table during uninterrupted game play. In another embodiment, the wager qualification amount is determined by the amount the player wagers at any of the gaming tables in an allotted time period, such as 24 hours. In another embodiment, the wager qualification amount is based on a total amount a player wagers in a gaming establishment. For example, the player may wager at any location in the gaming establishment and play any type of game at the gaming establishment (i.e., gaming tables, slot machines and the sports book). This total amount determines player qualification for a tournament. In another embodiment, the wager qualification amount is determined by the amount wagered at particular gaming tables or at particular gaming establishments. In another embodiment, the tournament qualifier is based on the average wager per play of a game.

In one embodiment, the amount a player wins determines whether the player qualifies for the tournament entry. The qualification win amount may be measured in any suitable manner. In one type of tournament, the qualification win amount is determined by the amount a player wins on a single gaming table during uninterrupted game play. In another embodiment, the qualification win amount is determined by the amount the player wins in an allotted time period, such as 24 hours. In another embodiment, the qualification win amount is determined by the amount the player wins at a certain type of game for a certain amount of time, such as the amount of blackjack games over a week or the amount wagered at slot machines over a week.

In one embodiment, the amount of jackpot awards won by a player or winning a particular jackpot award determines whether the player qualifies for the tournament entry. In one embodiment, winning a designated jackpot qualifies the player for tournament entry. In another type of tournament, winning a certain amount from one or more jackpots qualifies the player for tournament entry. It should be appreciated that a jackpot qualifier may be determined in any suitable manner.

In one embodiment, the total amount lost by a player over a certain time period determines whether the player qualifies for the tournament entry. In one embodiment, losing a designated amount qualifies the player for tournament entry. In another type of tournament, losing a certain number of games in a row qualifies the player for tournament entry. This creates a type of "loser's tournament" and provides players incentive to continue playing after hitting a period of bad luck. It should be appreciated that a tournament qualifier may be determined in any suitable manner.

In various types of tournaments, certain or designated games qualify the player for entry into the tournament. In one embodiment, achieving a certain game score qualifies the player for tournament entry. In another embodiment, playing a game for a certain amount of time qualifies the player for tournament entry. In one embodiment, the gaming system provides the player a tournament entry as a bonus in a table game or a slot machine game. That is, a player may win a free entry into a tournament as an award in a game and the player plays the tournament on the gaming tables. It should be appreciated that the gaming system may determine tournament qualification based on any element or combinations of elements in any game.

In one embodiment, the intelligent table system recognizes one or a plurality of each of these qualifying events and the gaming system routes the qualification information to the player account accordingly. In one embodiment, the player tracking system recognizes one or a plurality of each of these qualifying events and sends the qualification information to the player account accordingly. Alternatively, a tournament server or central server may qualify the player based on the raw data received from any suitable system. For example, if a player needs 10 hands of 21 in a blackjack game to qualify for a tournament, the intelligent table system in conjunction with the card manager identify when a blackjack is received by the player and sends the information to the player's account which tracks the information.

In certain tournaments, the gaming system determines a designated time period that a player can qualify for the tournament. For example, the gaming system may determine a certain day for tournament qualification which may be advertised to players. In one embodiment, the gaming system determines particular days and/or time periods in certain days where one or more of the player qualifications count or accrue for player entry into a tournament.

In one embodiment, the qualifier is determined based on one or more characteristics from a player tracking system or account. For example, all players of a certain rank or level may qualify for tournament entry. In another embodiment, all new members to a player tracking system or gaming establishment receive an automatic tournament entry. In another embodiment, upon a player's birthday, the gaming system provides the player a tournament entry. In another embodiment, upon a player's anniversary in the player system, the gaming system provides the player a tournament entry. In one embodiment, a player tracking system includes point intervals and each time a player reaches a point interval, the player receives entry into a tournament.

In another embodiment, qualification for a tournament is based on a score or win in a previous tournament. That is, a player may win entry into a tournament from previous tournament play.

In one embodiment, the gaming system determines when the tournament will be available to a player. For example, upon tournament qualification, the gaming system may enable the player to immediately play a tournament, participate in a tournament a certain number of hours after qualifying for the tournament or participate in a scheduled tournament.

As illustrated in block 194, the gaming system determines the date or dates of the tournament. The gaming system determines the start date and end date of the tournament. In order to determine the dates of the tournament, the gaming system determines the number of rounds of the tournament. If the tournament is a synchronized tournament, the gaming system determines a date and time for each round of the tournament. Additionally, if the tournament is a synchronized tournament, the gaming system determines a maximum number of sessions a round may have. If there are multiple sessions, the gaming system determines a time and date for each session of each round. If the tournament is a self-scheduled tournament, the gaming system determines certain days and times that the players may play the tournament rounds.

As illustrated in block 196 of FIG. 11, the gaming system determines maximum number of players for the tournament. In one embodiment, when the maximum number of players either register for the tournament or accept the offer for the tournament, the tournament closes. The gaming system determines the maximum number of gaming tables to participate in the tournament or which gaming tables will participate in the tournament.

In certain tournaments, the gaming system determines the entry fee of the tournament for the player as illustrated in block 198. In one embodiment, the gaming system requires the player to pay a certain amount of money or credits to enter the tournament. It should be appreciated that the entry fee may be any suitable form of payment. In one embodiment, the gaming system requires the player to pay a certain amount of promotional credits which are gaming establishment funded wagering credits to enter the tournament. In another embodiment, the gaming system requires the player to pay a certain amount of coupons, which are redeemable and offered to the general public to enter the tournament. For example, in the hotel affiliated with the gaming establishment, players receive coupons to enter the tournament. In another embodiment, the gaming system requires the player to pay a certain amount of gift certificates to enter the tournament. In another embodiment, the gaming system requires the player to pay a certain amount in vouchers to enter the tournament. Vouchers are a more secure form of credit than coupons. In another embodiment, a player may use player tracking points to enter a tournament instead of paying a fee to enter the tournament. In one embodiment, player tracking points are the only way to enter a tournament. It should be appreciated that the player may pay the entry fee for the tournament directly prior to the tournament, for example, by using a credit card. In another embodiment, the player is not required to pay an entry fee.

In one such embodiment, the entry fee award is only available to players that have previously qualified for a tournament. In another embodiment, a player may win the tournament entry fee when they are not qualified for a tournament but may then attempt to either win tournament qualification or play a tournament not requiring tournament qualification, such as an on-demand tournament.

It should be appreciated that the gaming system may implement any buy-in or entry fee for the tournament in any suitable manner. It should also be appreciated that in one embodiment, some players must pay an entry fee but other players do not. In one embodiment, the amount of the tournament entry fee is based on the player's rank in a player tracking system. For example, a player of a platinum rank in a player tracking system does not have to pay an entry fee and a player of a gold rank must use 50 player points to enroll in the tournament.

In one embodiment, the entry fee for the tournament may change over time based on tournament enrollment. For example, when the gaming system opens up a tournament for registration, the entry fee is $50. If the tournament is not half full within a week, the gaming system lowers the entry fee to $40.

In one embodiment, the entry fee or buy-in is not required to be paid in advance of the tournament. Rather, the fee is automatically deducted from the player's account upon the play of the tournament or the player pays the dealer upon the start of the tournament. In one embodiment, this automated buy-in is an option that a player may select when registering for the tournament.

In one embodiment, the player is not required to make a separate buy-in or pay an entry fee to play the tournament. In one such embodiment, the player's account has a separate account used for the buy-in of tournaments. In one such embodiment, a certain percentage, such as 1%, of all credits wagered by a player or coin-in for a certain time period is dedicated to this tournament credit account. For example, if the time period is a year and the player wagers $5000 over the year, the player will have a $50 tournament credit account. In one such embodiment, the buy-in for the tournament is deducted from this tournament credit account. For example, if the entry cost to the tournament is $25, that amount is automatically deducted from the tournament credit account upon registration. In another embodiment, the amount in the tournament account affects the player's qualification for the tournament. For example, only if the player has $100 or more in the tournament credit account is the player eligible to play in the tournament.

It should be appreciated that the qualifications and entry fees of the tournament may be based any suitable elements and may be configured in any suitable manner.

As illustrated in block 200 of FIG. 11, the gaming system determines the number of winners and the prizes to award each winner. It should be appreciated that the prizes for the tournament may be any suitable prize including but not limited to cash, a physical prize, such as a car or different type of prize, such as a vacation or a free night at the gaming establishment's hotel. In another embodiment, the prize or the award for the tournament is not disclosed to the players. That is, the prizes are a mystery to the players. In one embodiment, the top prize of the tournament is a mystery. In another embodiment, the tournament includes a mystery secondary prize. In another embodiment, a player may win player tracking points. In another embodiment, the gaming system provides gaming establishment money to a player. That is, the player receives a certain amount of money that may only be spent at the gaming establishment. In one embodiment, instead of cash, the prize is a gift certificate for a certain amount of money to be played at the gaming establishment hosting the tournament. In one embodiment, the player may use the gaming establishment money at other venues, such as hotels and restaurants, affiliated with the hosting gaming establishment.

In one embodiment, each session and/or round includes prizes for the players; therefore the tournament includes multiple award levels. That is, an award or a prize is awarded to other players in addition to the overall tournament winner. In one embodiment, the tournament is a synchronized group tournament which includes multiple rounds and multiple sessions for each round. In one embodiment, the tournament provides awards for each session and each round. That is, for each session, one or more players receive an award based on the session score. Each session is thus a sub-tournament of the larger tournament. In another embodiment, the gaming system provides a prize for each round winner. In another embodiment, the player with the lowest score receives a prize, such as an entry into another tournament.

In one embodiment, the tournament is funded by wagers placed for a certain time period. For example, a percentage of the wagers at a plurality of designated gaming tables fund a tournament pool that provides the prize for the tournament. In one such embodiment, the gaming system messages the current tournament award levels to the players. For example, a large sign displays the tournament jackpot and changes as more money is added to the tournament jackpot.

As illustrated in FIG. 11 at block 202, the gaming system determines the game or the type of game and the rules for the game of the tournament. In one embodiment, the rules of the game are the same for each player. In another embodiment, the rules of the game may be different for players. For example, in a live money embodiment, if players are wagering on gaming tables of different denominations, the scoring may be different. The scoring may be different for players for any suitable reason, such as but not limited to, player tracking status, player tracking points, time of tournament entry, or any other suitable reason.

The gaming system determines the method of scoring for the tournament as illustrated in FIG. 11 at block 204. Any appropriate scoring method may be used to determine the outcome of the tournament. The gaming system determines if the tournament is based on points or wager amounts. In one embodiment, the gaming system determines a tournament score for each participating player based on the score of each game played by the player in the tournament. In another embodiment, the gaming system determines a tournament score for each participating player based on the best game score for each round. In another embodiment, the gaming system determines a tournament score for each participating player based on a certain number of game scores, such as the top three game scores for the entire tournament. In another embodiment, one or more scores of a round qualifies the players for a final round. In one such embodiment, the winner of the final round wins the tournament.

In an alternative embodiment, the gaming system requires players in a tournament to compete with their own money in the competition. For example, a player is given a tournament time limit of an hour. During that hour, a player may try to win the most chips or highest value of chips possible using the player's own money. In one embodiment of a live money tournament, a player is required to wager throughout the entire tournament. The wager may be a set wager. In this instance, players are ranked by total winnings at the end of the tournament. Alternatively, if players are enabled to choose their wager, a weighting may be used in ranking in order to ensure equality among participants in their performance.

It should be appreciated that a live money tournament may be grouped by any suitable wagering factor or determined in any suitable manner. For example, gaming tables frequently have different wagering denominations such as $5 and $10. For a live money tournament, in one embodiment, the tournament is grouped by the denominations of the gaming tables. For example, all of the $5 gaming tables are grouped together for a first group of awards and the $10 gaming tables are grouped together for a second group of awards. In another embodiment, gaming tables of different denominations are not separated, and the player playing the higher denomination gaming table therefore has a benefit over a player playing a lower denomination gaming table. In another embodiment, the tournament includes an equalizer such as a suitable math model or algorithm to even out the point distribution between gaming tables of different denominations. For example, if a first player is playing a $5 gaming table and a second player is playing a $10 gaming table, the tournament includes a point multiplier for the player of the $5 gaming table to even the chances of achieving points in the tournament. In another embodiment, the tournament includes another equalizer or mechanism to create substantially equal competition in a live money tournament which includes different denomination tables. For example, a $10 gaming table includes fifteen winning card combinations and a $25 gaming table includes only twelve card combinations. Therefore, while a player at the $25 gaming table may receive more points for a winning card combination than a $10 gaming table, the player at the $10 gaming table may have a higher probability of obtaining a winning card combination.

In another embodiment, the gaming system enables the player to select the tournament game to play from a plurality of tournament games. In one embodiment, certain of the tournament games are available to the player. For example, if the player is given the choice of Game A (i.e., blackjack) and Game B (i.e., poker). The player may play the game that they are more skilled at.

In one embodiment, the gaming system determines which gaming tables will participate in the tournament. In one embodiment, all of the gaming tables in a gaming establishment are operable to participate in the tournament. In another embodiment, only certain of the gaming tables are operable to participate in the tournament. For example, only certain tables are equipped with intelligent table systems.

In certain embodiments, the gaming system determines how the player seats or player stations are assigned to each player. In one embodiment, the gaming establishment operator enters all of the names of the participating players and the gaming system randomly determines and assigns a tournament eligible player station to that person. That is, the gaming system determines and assigns a player station for each player of the tournament. In another embodiment, the gaming establishment operator enters all of the players into the gaming system and the gaming establishment operator determines and enters a player station for each player. That is, the gaming establishment operator determines and assigns a player station for each player of the tournament. In another embodiment, a participating player may determine or choose that player's station. For example, in a synchronized tournament, a player may enter a player tracking card into at a player station the player wants to play on. In a self-scheduled play tournament, a player may enter a user card into any participating gaming table or player station and play the tournament during the specified time period. In one embodiment, a set order is used to determine how players are able to choose their tournament player station. The order may be first come, first served. Alternatively, the order may be based on player ranking with higher ranking players given priority in choosing their player stations. In one embodiment, it is preferred that the assignment process keeps a "touch and see" feel. A gaming establishment may implement any appropriate or player station determining randomization process. Players may choose to witness the assignment of the player stations. For example, a name of a registered player may be drawn by a gaming establishment employee and a drawing may be held to determine the player station for that player. For example, ping pong balls with player stations numbers are drawn from a cage to match each player to a player station.

Tournament Registration

Upon the configuration of the tournament, players are invited to be in the tournament based on the configured qualification criteria. In one embodiment, the gaming system informs the player of a tournament qualification on the internet, such as by posting a list of eligible tournament players or sending the eligible players an email informing them of their invitation to join a tournament. In another embodiment, upon qualification due to a game outcome or bonus game at a gaming machine or a gaming table, the gaming machine or the gaming table immediately invites a player to the tournament. In different embodiments, the gaming establishment may invite the player to enter the tournament through mobile devices, postal mail, a gaming machine, a hotel television, a point of sale receipt or flyers. Alternatively, the casino can use personal LCD screens mounted at each player station, overhead plasmas, controlled through a sign manager, through the dealer, or through a status light button at the player station. For example, a status light turns green when the player can play a tournament. In other embodiments, certain of these means can be used to communicate more information such as when the tournament begins, what type of tournament it is, how a player can become eligible for the tournament, or other pertinent tournament information.

In one embodiment, the gaming system is operable to track players' trends to determine how many players that are invited to the tournament will actually play in the tournament. For example, in one embodiment, the gaming system uses player tracking information, such as the players' sex, home town, wagering information and other suitable information to estimate how many players will show up for a given tournament. The gaming system would use a suitable mathematical model or algorithm, such as regression analysis, to predict how many players will play the tournament. Using such math models, the gaming system can determine who to invite, how many players to invite and market the tournament to the actual, potential players. In one embodiment, the gaming system has an automated process for estimating who will come to the tournament and how to invite the players. It should be appreciated that tournament participation predictions may be completed by the gaming system in any suitable manner.

Figure 13:
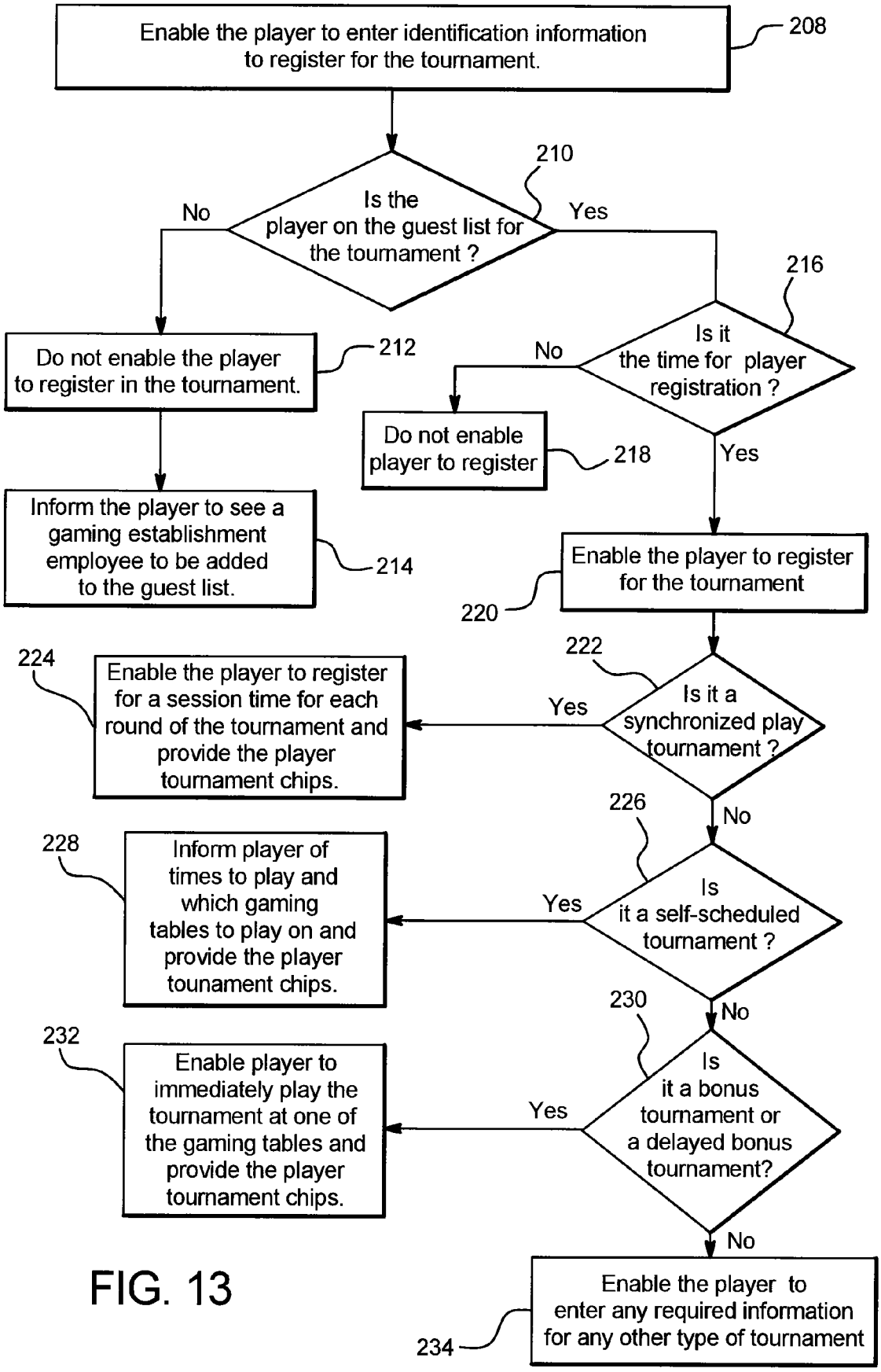
FIG. 13 is a flow chart of the method of one embodiment disclosed herein, illustrating the gaming system enabling player self-registration for the tournament.

In one embodiment, the gaming system enables a player to self-register for a tournament at a kiosk, at a gaming machine or on the internet, without the aid of a gaming establishment worker for a guest list tournament. FIG. 13 illustrates one embodiment of a method of self-registration for a tournament. As illustrated in FIG. 13, the gaming system enables the player to enter a tournament using an input device. The gaming system enables the player to enter identifying information as illustrated in block 208. In one such embodiment, the gaming system enables the player to swipe a player card to enter the tournament.

The gaming system determines if the player is on the guest list for the tournament or if the player is qualified for the tournament as illustrated in diamond 210. If the player is not on the guest list, in one embodiment, the gaming system does not enable the player to register for the tournament as illustrated in block 212. In one embodiment, the gaming system informs the player to see a gaming establishment employee to be added to the guest list as illustrated in block 214. If the player is on the guest list, the gaming system determines if it is the time period configured for player registration as illustrated in diamond 216. In one embodiment, one of the configuration requirements for the tournament is setting a time period (e.g., dates and times) for the player to accept an invitation by registering for the tournament. If it is not the time period configured for player registration, the gaming system does not enable the player to register for the tournament as illustrated in block 218. It should be appreciated that the gaming system may provide the player with any other appropriate messaging. In one embodiment, if the player is registering at the wrong time, the gaming system informs the player of the correct time for registration. The gaming system may provide any messaging to a player such as how to enter the tournament, how to register the tournament, information about future tournaments, the tournament location and times and any other suitable information.

If it is the time period for configuration, the gaming system enables the player to register for the tournament as illustrated in block 220.

In one embodiment, the gaming system determines the configured type of play of the tournament. As illustrated in diamond 222, the gaming system determines if the tournament is a synchronized tournament. If the tournament is a synchronized tournament, the gaming system enables the player to register for a session time for each round of the tournament and provides the player tournament chips as illustrated in block 224. The gaming system determines if the tournament is a self-scheduled tournament as illustrated by diamond 226. If the tournament is a self-scheduled tournament, the gaming system informs the player of the times the player may play and which gaming tables the player may play on and provides the player tournament chips illustrated in block 228. If the tournament is not a self-scheduled tournament, the gaming system determines if the tournament is configured as a bonus tournament, as illustrated in diamond 230. In one embodiment, if the tournament is a bonus tournament, the gaming system enables the player to immediately play the bonus tournament at one of the gaming tables upon registration and provides the player tournament chips as illustrated in block 232. Therefore, the player may immediately register for the tournament upon the bonus tournament win at a gaming table and then immediately play the tournament at that gaming table. Additionally, if the player decides to delay the play of the bonus tournament and play the tournament a different date, upon registration at one of the gaming tables for the tournament on the subsequent date, the player immediately plays the bonus tournament at one of the gaming tables. That is, in one embodiment upon registration, a player may automatically use the bonus entry to play the tournament. In another embodiment, the gaming system enables the player to register for a delayed bonus tournament and pick a time to play the bonus tournament. If the tournament is not a self-scheduled tournament, a synchronized tournament, or a bonus tournament, the gaming system enables the player to enter any required information for any other type of tournament as illustrated in block 234.

Figure 14:
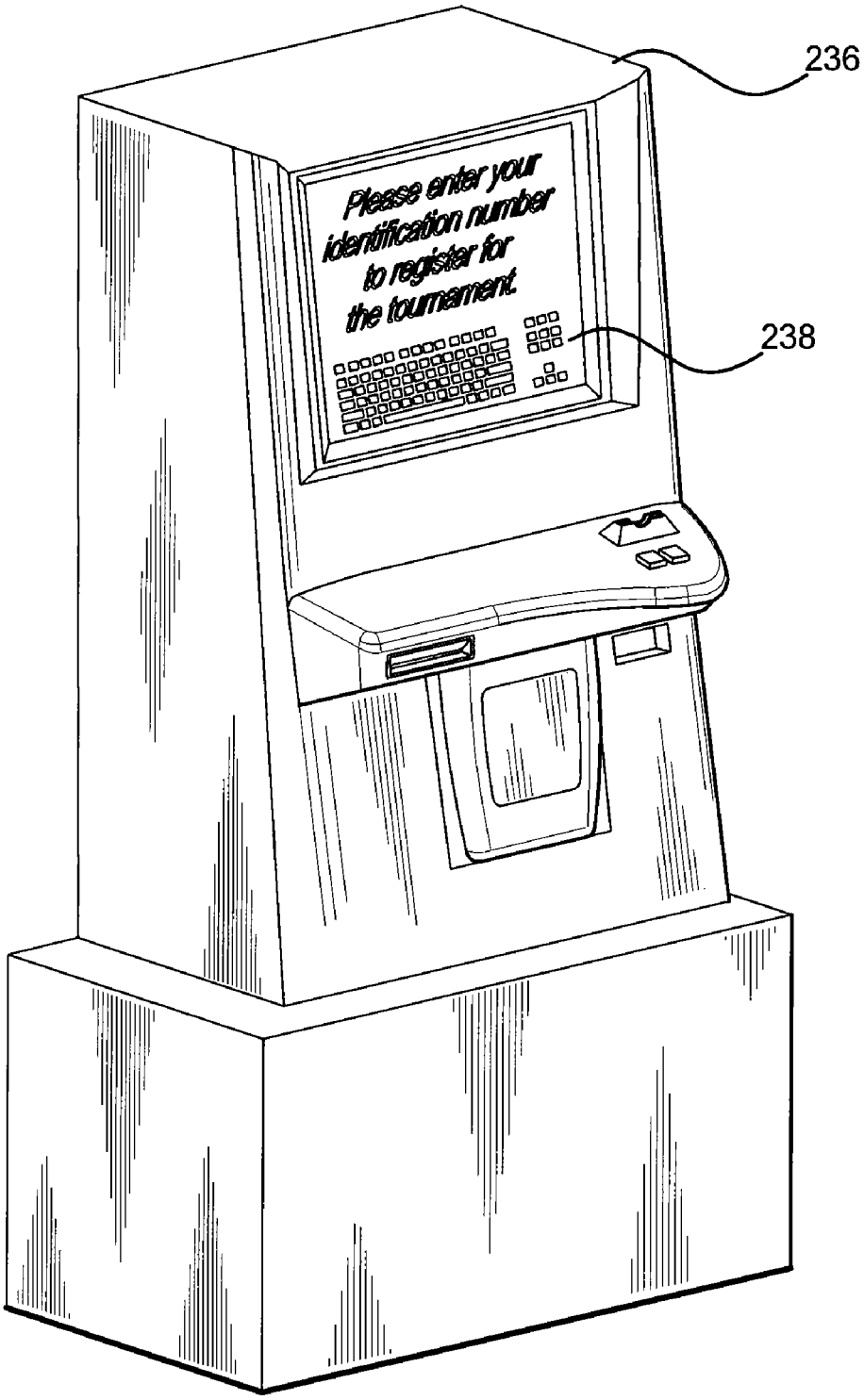
FIG. 14 is front perspective view of one embodiment of a kiosk of the gaming system disclosed herein enabling player self-registration for the tournament.

FIG. 14 illustrates one embodiment of self-registration where an apparatus such as a kiosk 236 enables the player to self-register by entering pertinent information into a kiosk. In the illustrated embodiment, the kiosk enables the player to enter information via display device 238 including a touch screen keyboard. The kiosk enables the player to enter any information for registration for the tournament, such as a player name, player nickname, an identification number, a player tracking number or any other information. In one embodiment, the gaming system also enables the player to submit other information at the kiosk during player registration. For example, the player may select which future tournaments to receive information on, how they want information displayed to them during the tournament, or any other suitable information. In another embodiment, the gaming system enables the player to select how to receive reminders for the tournaments. For example, a player may select to be emailed a reminder or immediately print a reminder.

In another embodiment, the player registers for the tournament using biometric registration, such as by a finger print or hand print. In another embodiment, the tournament is an anonymous tournament where registration is based on some factor that is not matched to a player. For example, a non-logged in player at a gaming table wins a tournament entry and the gaming table via the dealer or a display device provides the player an identification number to register for the tournament. The player can therefore register for the tournament without revealing his or her identify.

Figure 15:
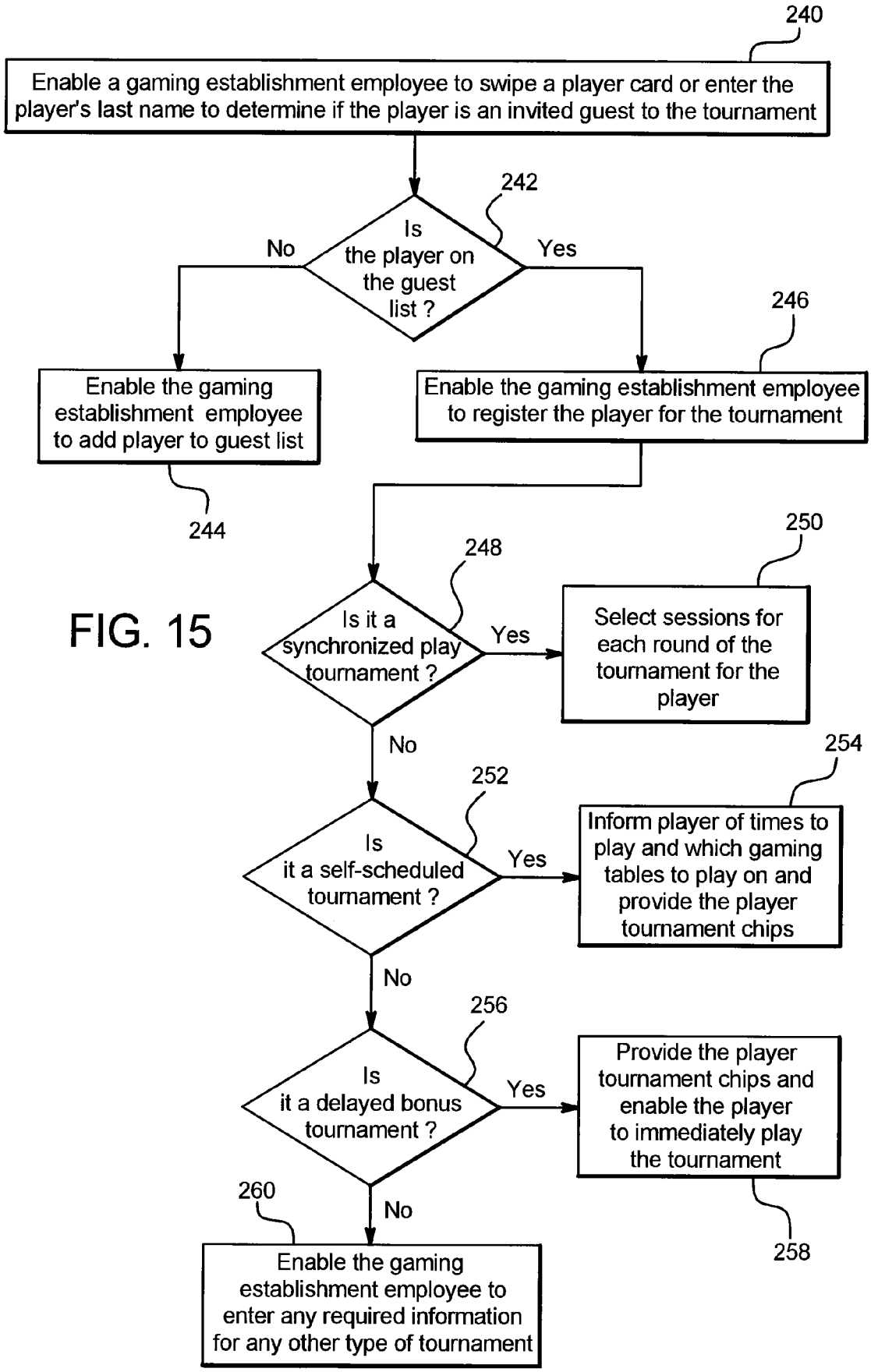
FIG. 15 is a flow chart of the method of one embodiment disclosed herein, illustrating the gaming system enabling a gaming establishment employee to register a player for the tournament.

As illustrated in FIG. 15, in one embodiment, the gaming system enables a gaming establishment employee to register the guests of an invited guest tournament.

As illustrated in FIG. 15, the gaming system enables a gaming establishment employee to swipe a player card or enter a player's name to determine if the player is on the guest list for the tournament as illustrated in block 240. The gaming system determines if the player is on the guest list as illustrated in diamond 242. If the player is not on the guest list, in one embodiment, the gaming system enables the gaming establishment employee to add the player to the guest list as illustrated in block 244. If the player is on the guest list, the gaming system enables the gaming establishment employee to register the player for the tournament as illustrated in block 246. If the player is on the guest list, the gaming system determines if the tournament is configured as a synchronized tournament as illustrated in diamond 248. If the tournament is a synchronized tournament, the gaming system enables the employee to select the sessions for each round of the tournament for the player as illustrated in block 250. In one embodiment, the gaming system provides the player the tournament chips at the table immediately prior to the tournament. If the tournament is not a synchronized tournament, the gaming system determines if the tournament is configured as a self-scheduled tournament as illustrated in diamond 252. If the tournament is a self-scheduled tournament, the gaming system informs the gaming establishment employee and/or the player of the dates and times for the tournament and provides the player tournament chips as illustrated in block 254. In one embodiment, if the tournament is a self-scheduled tournament, the gaming system informs the gaming establishment employee and/or player that are operable to participate in the tournament as illustrated in block 254 If the tournament is not a self-scheduled tournament, the gaming system determines if the tournament is configured as a delayed bonus tournament as illustrated in diamond 256. In one embodiment, if the tournament is a delayed bonus tournament, the gaming system enables the player to immediately play the tournament at one of the tables as illustrated in block 258. Alternatively, if the tournament is a delayed bonus tournament, the gaming system enables the player to play the tournament upon an appropriate bonus trigger. If the tournament is not a self-scheduled tournament, a synchronized tournament, or a delayed bonus tournament, the gaming system enables the gaming establishment employee to enter any required information for any other type of tournament as illustrated in block 260. It should be appreciated that a player may receive the tournament chips upon registration in any suitable manner. In one embodiment, the player registers and receives the chips from a gaming establishment employee during registration at a tournament registration desk.

It should be appreciated that the gaming system is operable to cause a kiosk, a gaming machine or printer at a gaming table to print a ticket with any pertinent information on it upon registration. For example, if the player is assigned an identification number for the tournament, the gaming system may print a ticket including the information. In one embodiment, if the player registers for the tournament at a kiosk, the kiosk prints a reminder such as the date and time of the tournament. It should be the player may register for the tournament and be reminded of the tournament in any suitable manner.

It should be appreciated that during registration, a player or a gaming establishment employee may enter any information necessary or required by the tournament. The gaming system may be operable to receive a nickname or name for the player to display on a scoreboard for the tournament or any player card information for the tournament. In one embodiment, the gaming system is operable to upload and display a scanned image or an icon for the tournament. In one embodiment, the player enters a nickname and an icon which represents the player on one or more of the display devices during the tournament. In one such embodiment, a gaming establishment worker and/or the gaming system may scan and/or censor nicknames and icons that will be displayed to the general public. Additionally, if the tournament is conducted over the internet or other data network, the gaming system may include a program to ensure that information displayed during the tournament conforms to current industry censorship standards.

It should be appreciated that the gaming system may be used to reschedule, cancel and add players to the tournament in any suitable manner. For example, if a player is late to a tournament the player may register for another session or another tournament through any appropriate method. Additionally, if a player wants to join a tournament when the player is not registered, the gaming system may enable the player to quickly join the tournament through self-registration or registration through a gaming establishment employee. The gaming system enables a player who has not yet started playing the tournament, to change session times or to cancel participation in the tournament.

In one embodiment, a number of seats at gaming tables in synchronized tournaments are reserved for each tournament. When the session for the synchronized tournament is full, the gaming system enables the player to use a reserved seat. In one embodiment, this option to use a reserved seat is limited to certain players, such as players at a certain rank or level.

Types of Tournaments

The tournament may be any suitable type of tournament. In one embodiment, the tournament is a time based tournament. In this type of tournament, the player is given a set amount of time in which they are active in the tournament. The player may play as many or as little hands or games as they wish during this time and the player with the most chips at the end of the time period wins. In different embodiments, this type of tournament may be synchronized or self-scheduled. For example, if a tournament has an allotted time period of 40 minutes and the tournament begins at 11:00 am and ends at 3:00 pm, the players can play their hands or their game at anytime within that window and still be entered in the tournament. The player indicates they are playing a tournament for the next twenty minutes, the intelligent table system sends the outcome data to the central server or tournament manager and the player's results are recorded. In one embodiment, the tournament may include real-time updating of player standings throughout the day with the winner announced at the tournament's close.

In another embodiment, the tournament is a hand based tournament or a game based tournament. In this type of tournament, the player is given a set number of hands or games in which the player can play in the tournament. The player may play these hands over as short or as long of a time period as they wish. In different embodiments, this type of tournament may be synchronized or self-scheduled. For example, if a tournament has an allotted hand count of 20 hands and the tournament begins at 11:00 am and ends at 3:00 pm, the players can play their hands or games at anytime within that window and still be entered in the tournament. The player indicates they are playing a tournament for the next hand, hands, game or games, such as through an input device or notifying the dealer, the intelligent table system sends the outcome data to the tournament server and the player's results are recorded upon completion of all hands and games. The tournament may include real-time updating of player standings throughout the day with the winner announced at the tournament's close.

In another embodiment, the tournament is a round based tournament. In this type of tournament, the player is given a set amount of time or hands or games to play in each round. In certain embodiments, this type of tournament may be synchronized or self-scheduled, as long as they complete the rounds by the specified time. It should be appreciated that the different rounds may be in different tournament formats. For example, a first round may be a game based tournament and a second round may be a time based tournament. In another embodiment, a first round may be a synchronized tournament and a second round may be a self-scheduled tournament.

The tournaments may be scheduled in any suitable manner. In a synchronized tournament a plurality of players each play the tournament at the same time, frequently in a relatively same location. The synchronized tournament may include multiple rounds and multiple sessions in each round. A self-scheduled tournament includes a plurality of players participating in a tournament according to the configured tournament parameters that determine a time to play the tournament within a range of designated times. Self-scheduled tournaments may include the same games or different games. For example, in one tournament, the players may only play poker. In another embodiment, the players may play roulette, craps, poker and/or blackjack for the tournament.

Figure 16:
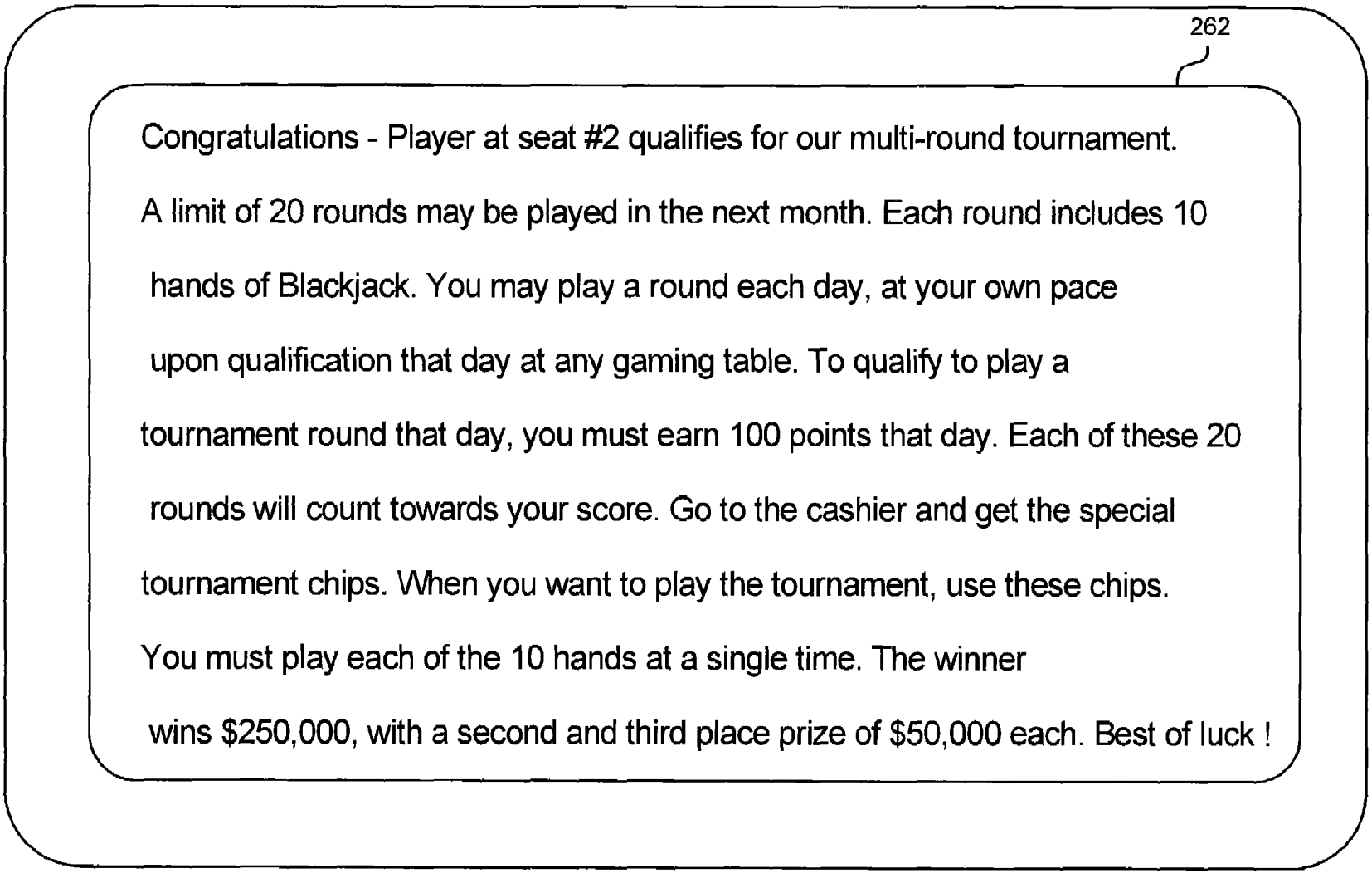
FIG. 16 is an enlarged exploded view of one embodiment of a display device displaying a player's invitation to play one of the embodiments of a multi-round synchronized tournament.

The tournaments may be single round tournaments or multi-round tournaments. The tournaments may be configured in any suitable manner. For example, in another embodiment, the table tournament is a multi-round tournament where the score for each round of the tournament counts towards a final score. FIG. 16 illustrates a screen shot 262 of a player receiving an entry into this cumulative multi-round tournament via a display device at one of the gaming tables. The tournament may include any number of rounds and the tournament may be configured using any suitable specifications. The rounds may include any suitable number of hands or any suitable length of time. In the illustrated embodiment, the tournament is for the duration of a month. During that month, the player may play any suitable number of rounds. In the illustrated embodiment, the player may play a limit of 20 rounds. Each round includes 10 hands of blackjack. The player may play only one round a day or any other criteria assigned by the operator. To qualify to play a tournament round that day, the player must earn 100 points that day. Any suitable gaming table in communication with the central controller is operable to enable the player to play the tournament. In one embodiment, the player is provided tournament chips from a cashier. When the player wants to play the tournament, the player uses the tournament chips. For example, in one embodiment, each of these 20 rounds will count towards the player's final tournament score. Alternatively, only a set number of the player's best rounds will count towards their final tournament score. In the illustrated embodiment, the winner wins $250,000 and the players in second and third place each wins an award of $50,000.

In another self-scheduled multi-round tournament, as illustrated in the screen shot 264 of FIG. 17, the tournament rounds include a plurality of preliminary tournament rounds and a final round. These preliminary tournament rounds qualify the player to play a final round to determine the tournament winner(s). In the illustrated embodiment, additional players are selected at random to participate for the final round of the multi-round tournament. This self-scheduled multi-round tournament lasts for a certain duration, such a week. The player has a limited number of rounds that the player may play in the time period, such as five. The player plays the tournament at the player's leisure upon qualification that day. In one embodiment, upon qualification, the player must go to a kiosk to receive the chips to play the tournament. To qualify to play a tournament round that day, a gaming establishment may set and determine any suitable required tournament entry fee, such as paying money for an entry fee or paying with player points. In the illustrated embodiment, the player must earn 50 player points that day. One, a plurality or all of the gaming tables are operable to enable the player to play in the tournament round. Each of these 5 rounds will count towards a final preliminary round score. The top fifteen players and five randomly chosen players will qualify to play a final round to determine a winner based on the final preliminary round scores. This final round determines the big prize winner. The winner wins $150,000, with two $30,000 prizes provided to the preliminary round winners.

It should be appreciated that this final round may be any suitable type of tournament. In one embodiment, the final round is a self-paced tournament. In another embodiment, the final round is in the synchronized tournament format. That is, the final round is a synchronized tournament where all players play at a certain time and a certain location which enables spectators to watch the final tournament.

It should be appreciated that in these multi-round embodiments, each score of each round does not always count towards the player's final tournament score or round score. It should be appreciated that in various embodiments, the player's tournament score may be based on a single score from a single game round, a single score from each round of a plurality of rounds, each score of each round, or each score of certain rounds. For example, in one embodiment, only the top score of the all of the player's rounds count towards the final score. In another embodiment, only the top three scores count towards a final preliminary round score to compete in a final tournament session. It is possible for a player to play as few as three different rounds and still be able to submit a final score (or preliminary round score). However, a player increases their chance of getting a better score by playing more rounds and submitting up to the limit of twenty scores (of which their top three will be entered).

An example of one embodiment of this type of tournament is illustrated in the table 266 of FIG. 18. A player is informed that a tournament will run from May 1st to May 31st and a final score will comprise the top three tournament entries from a limit of up to twenty tournament entries. A player is allowed to play once a day during the tournament run. Upon being qualified, a player may make an entry into the tournament up to twenty times. FIG. 18 illustrates an example of the play of three players, with each player's top three best scores indicated in bold.

As illustrated, even though Player A made the twenty maximum number of entries into the tournament, Player A's score was lower by Player B's score who only made five tournament entries. Thus, Player B wins the tournament.

It should be appreciated that the above tournament example may include multiple rounds. Additionally, the above tournament example may include a top number of qualifying players advancing to a final tournament round.

In another embodiment, the gaming system is operable to conduct a synchronized instant tournament one, a plurality or every day of the week. The instant tournament creates spontaneous excitement. In one embodiment, any carded player or logged on player can qualify to be a contestant by meeting specific tournament criteria and will instantly be entered into a tournament. Alternatively, any player can qualify by meeting specific tournament criteria.

Figure 19A:
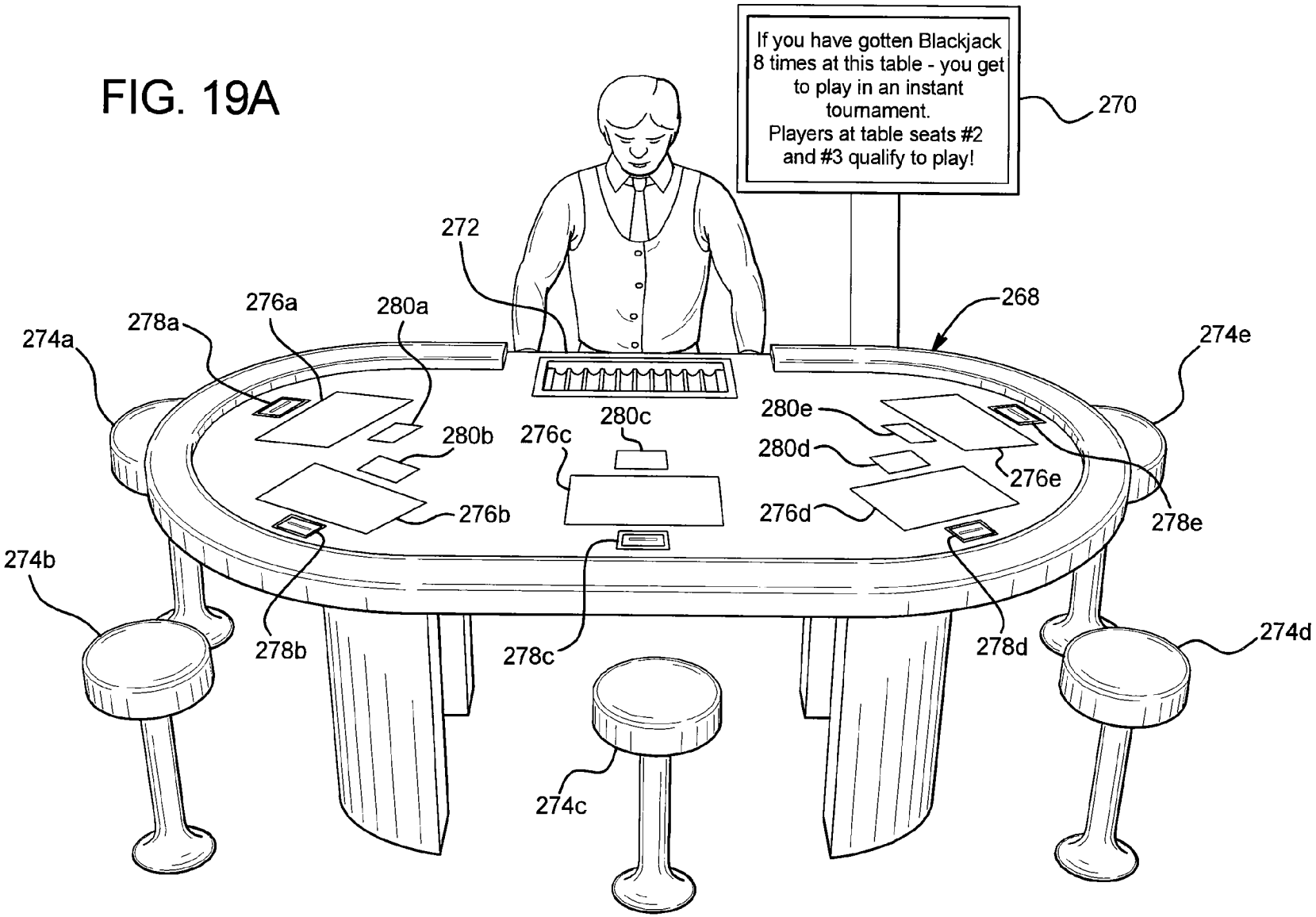
FIGS. 19A, 19B and 19C are perspective views of one embodiment of an instant synchronized tournament.
Figure 19B:
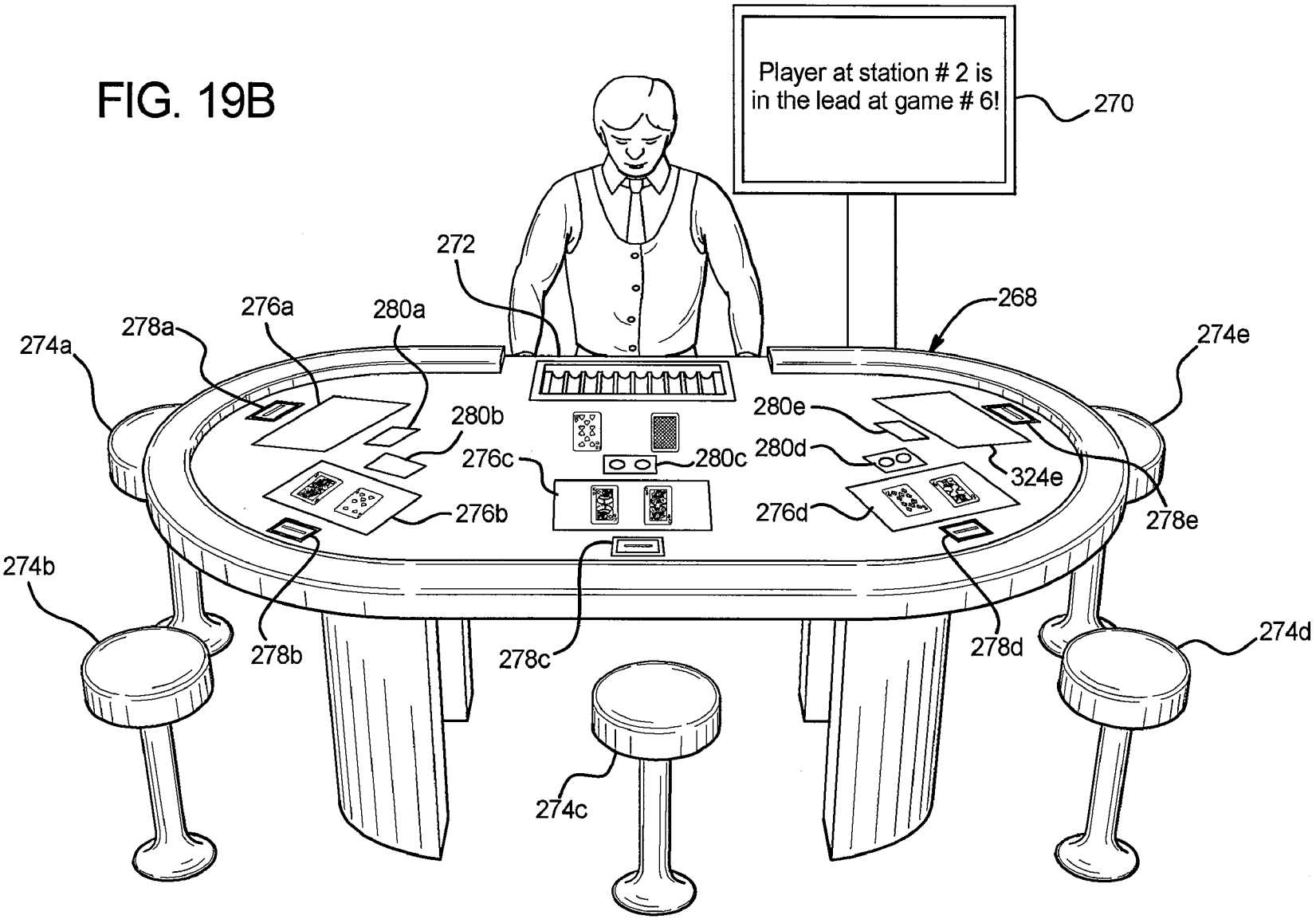
Figure 19C:
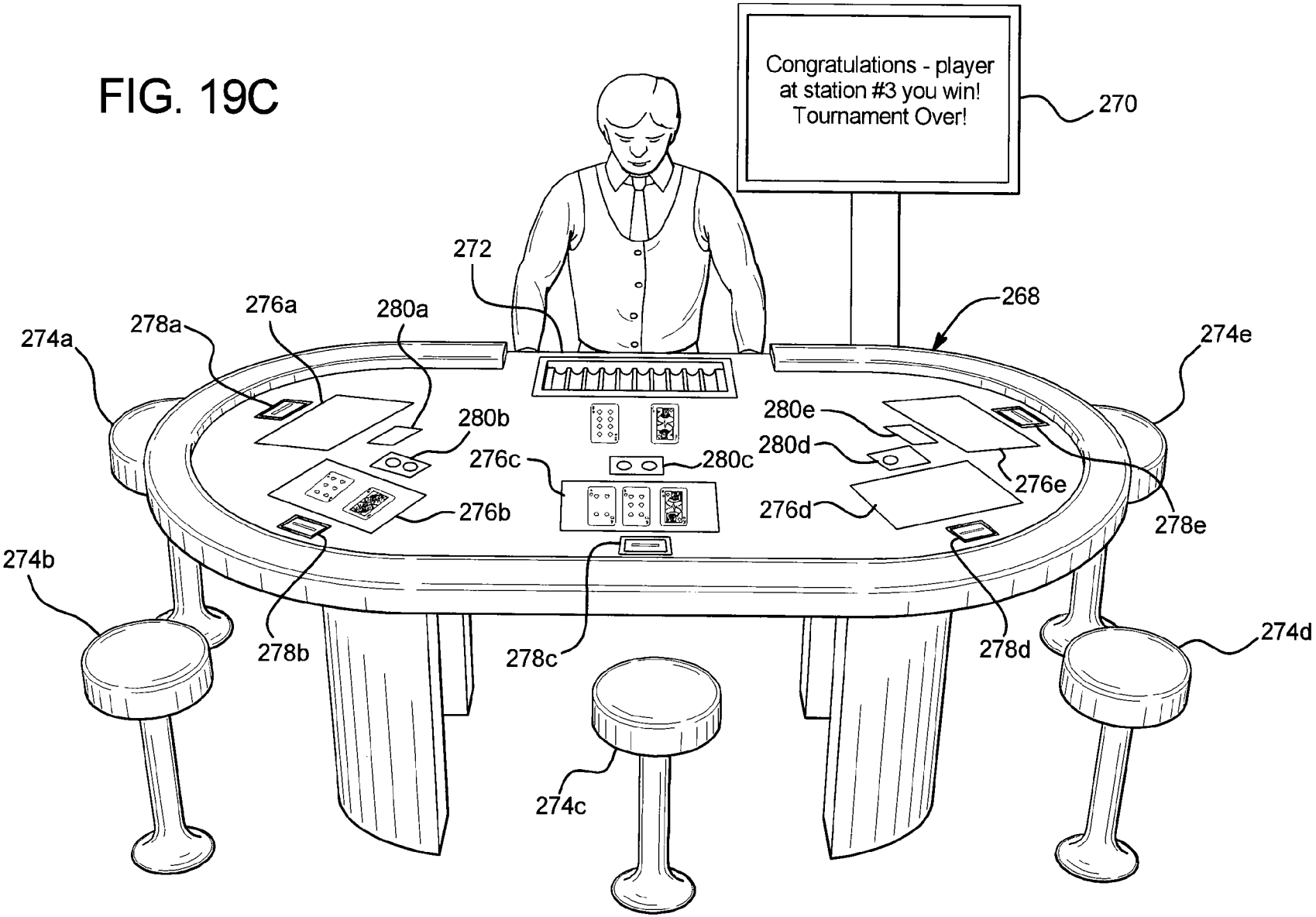

As illustrated in FIGS. 19A, 19B and 19C, and the instant tournament may provide a player a chance to play in a tournament on that day upon qualification. In one embodiment, the gaming system includes a gaming table 268, a dealer position 272, a display device 270 and a plurality of player seats or stations 274*a*, 274*b*, 274*c*, 274*d* and 274*e*. In one embodiment, each player station 274*a*, 274*b*, 274*c*, 274*d* and 274*e* includes a player tracking input device, such as player card reader, 278*a*, 278*b*, 278*c*, 278*d* and 278*e*, a betting or wagering area 280*a*, 280*b*, 280*c*, 280*d* and 280*e* and a playing area 276*a*, 276*b*, 276*c*, 276*d* and 276*e*. As illustrated in FIG. 19A, in one embodiment, the qualifier is winning blackjack 8 times while at that gaming table. At a certain time or at random times, the instant tournament begins and any player who has won blackjack 8 times gets to play. In this embodiment, the tournament randomly occurs. Upon qualification, the player is instantly registered for the tournament and the dealer provides the players the tournament chips.

As illustrated in FIG. 19A, players at the second and third player stations 274*b* and 274*c* qualify to play the tournament. The player at the fourth player station 274*d* does not qualify to play the tournament but continues playing blackjack. In this illustrated embodiment, the gaming system enables the qualifying players to play the tournament while other players are simultaneously playing non-tournament games at the same gaming table.

As illustrated in FIG. 19B, the gaming system updates the display device to display the current scores of the players. Currently, at game 6 of the tournament, the player at the second player station is ahead.

As illustrated in FIG. 19C, the player at the third player station wins. It should be appreciated that the gaming system may immediately provide the player an award, provide the player an award ticket to take to a cashier or in any other suitable manner. Additionally, the real time scoring updates may be displayed in any suitable manner.

It should be appreciated that instant tournaments may be offered in any suitable number at any suitable time of the day. For example, a gaming establishment may offer an instant synchronized tournament every two hours, increasing the likelihood that a player will continue playing at that gaming table until the next tournament. In another embodiment, a gaming establishment offers instant tournaments based on a predetermined triggering event or a random determination. That is, the gaming system notifies any currently eligible players by displaying information or making an audio announcement that a tournament begins in a certain number of minutes. At that time, the gaming system initiates the instant synchronized tournament.

In another embodiment, the initiation of the instant tournament is based on an amount of a tournament jackpot. For example, the tournament jackpot is a progressive jackpot where a portion of each wager funds the tournament jackpot which is displayed to the players. When the jackpot reaches a certain amount, such as $1000, an instant tournament begins. The display of the jackpot amount creates anticipation for players waiting to play the tournament.

In one embodiment, the initiation of the instant tournament is based on the current number of eligible players. For example, when fifty players join the tournament, the tournament begins. In one such embodiment, the instant tournament is funded through a progressive jackpot system. In one such embodiment, the gaming system initiates the tournament only when the number of players reaches a designated number and when the tournament jackpot reaches a designated amount. In another embodiment, the player may have to pay an entry fee to enter the tournament. The timing of an instant tournament may also be based on the gaming establishment's data trends, such as having a tournament when the gaming establishment is known to have a "low traffic" lull, such as Tuesday mornings.

For example, upon a certain trigger, an instant tournament is initiated. Any qualified player, based on any suitable number of qualifying criteria, is alerted about the tournament initiation. In one embodiment, a message appears on one or more displays located through-out the gaming tables prompting the player to join the tournament. The player may then be given the opportunity to enroll and register in the tournament in any suitable manner. Upon a second trigger, the tournament will begin and all qualified and registered players play in the tournament instantly. This type of tournament creates spontaneous excitement across the floor by offering instant, high frequency tournaments.

In another embodiment, the tournament is a multi-round, self-scheduled tournament, where upon qualification and registration, the gaming system informs the players of the number of rounds of the tournament and dates and times for each round. The gaming system enables qualified players to play the rounds at the player's leisure within scheduled times. For example, a self-scheduled tournament first round is between 9 am and 12 pm on Saturday, the second round is between 1 pm and 3 pm on Saturday and the third round is between 4 pm and 6 pm on Saturday. In this self-scheduled tournament mode, the gaming system enables the player to play games in non-tournament mode at a gaming table, make an input to play the tournament at that same gaming table, to play the tournament at that same gaming table and then switch back to non-tournament play and continue playing regular games at that same gaming table. This setup provides for the player privacy to play the tournament without having to leave a gaming table to go to a tournament area.

For example, in one embodiment, the operator sets up a day or dates for the tournament times. Players are qualified based on any number of determined criteria. Qualified players are alerted of their status and can play rounds at their leisure within the set up time parameters. For example, a first player may play round one at 9 am, round two at 1 pm, and round three at 5 pm. A second player may player round one at 12 pm, round two at 3 pm and round three at 4 pm. This setup gives players the flexibility to play when they want and how they want. This self-scheduled setup also provides them with the ability to play in the player order they want in the tournament (i.e., one of the first players or one of the last players). In an alternative embodiment, a final round may also be played with the top contestants (and possibly random wild cards) from the prior rounds.

In one embodiment, the tournament is an on-demand tournament. In the on-demand tournament, the player may selectively request to play a tournament via the dealer or at a kiosk or other suitable input area which may provide the player with tournament chips. It should be appreciated that the gaming system may enable players to select to play the tournament game in any suitable manner and through the use of any suitable input device.

It should be appreciated that any tournaments may be completed in the self-scheduled format. That is, instead of a same time where every player is required to play the tournament, select times and dates may be offered to the player to complete rounds of the tournament. In one embodiment of the self-scheduled tournament, a player may play at the player's decided time after a certain increment of time, such as 45 minutes after qualifying to play in the tournament. Each day, the gaming system determines one or more winners and awards one or more prizes.

In another embodiment, the tournaments are smaller, micro-tournaments that take less time to play. The micro-tournament is a tournament with a shorter duration than a regular or typical tournament. For example, the micro-tournament may last less for only one hand of a game. In the micro-tournaments, upon a suitable triggering event, such as a time of day or a number of players joining the tournament, the gaming system initiates a tournament. The micro-tournament may be synchronized and played as a group or individually played. That is, other players may play the micro-tournament at the same time or individually. In one embodiment, these micro-tournaments are regularly scheduled and the prizes are smaller than for the regular tournaments. In one embodiment, a micro-tournament begins upon a triggering event, such as by the number of wins or losses at a table. At a micro-tournament end triggering event, such as a time period, the gaming system determines a winner (instantly or upon an end event for a synchronized tournament or upon an end event for an individual tournament) and instructs one or more dealers to provide the winners an award. If the player is still logged on to the gaming system, the gaming system may directly provide the player the credits or a ticket for the award. If the player is no longer playing at the gaming table, the gaming system messages the player, such as via mail or email, regarding the player's win. In one embodiment, a player is not limited to a single micro-tournament entry but may participate in a play of the micro-tournament after each occurrence of the triggering event. Thus, players may have multiple entries into the micro-tournament.

In another embodiment, any tournament may be played as an on-demand self-scheduled tournament. In one embodiment of an on-demand tournament, the players do not have to qualify for the tournament but may register to play a tournament. In one such embodiment, the players may immediately play a tournament and the scores are compiled over a certain time period, such as a week. At the end of the time period, the gaming system determines the tournament winner. In another embodiment, upon registration for an on-demand tournament, the player has to wait for a certain number of players to register to play in that tournament. For example, a tournament does not begin until 40 players have registered for the tournament. In one such embodiment, the winner is chosen from those 40 players and a prize is awarded. In one such embodiment, the players must pay an entry fee for the tournament. If entry is free, pending players may leave the gaming establishment off-setting the number of tournament players. The tournament in one embodiment provides an incentive to participate in the tournament.

In another embodiment, the player may challenge another player to a tournament. For example, a player may type in a player's name or nickname at a kiosk to challenge the player to the tournament. The players may be assigned a gaming table or the players may play the tournament in the self-scheduled format.

In one embodiment, players may join a synchronized tournament at the same time. Alternatively, in one embodiment, the gaming system enables players to elect to join the synchronized tournament at particular times, in addition to the tournament start time. The gaming system may communicate the times to the players in any suitable manner, such as display the times on one or more display devices or signs, make an announcement in the gaming establishment, or through player tracking. This mode enables players to enter the tournament at multiple times.

The gaming system may create equivalence for players joining the tournament at a later time to enable the players to catch up in points to the earlier joined tournament players in any suitable manner. In one embodiment, all of the points or chip values are doubled for the later joining players. In another embodiment, the gaming system enables the later joining player to place a higher wager, increasing possible points for winning combinations. In another embodiment, one or more game outcomes are multiplied for the later joining players. In another embodiment, the gaming system provides the later joining player one or more extra hands. The gaming system may employ any suitable method to create parity for the later joining tournament players.

In one type of tournament, the gaming system enables players to choose a tournament game. That is, the tournament may include any suitable game such as blackjack games, poker games, or baccarat games. In one embodiment, the tournament program then scores these games to have the same odds. In another embodiment, the tournament is a total wager tournament. For example, the tournament is based on how much a player wins in a 24 hour period. In one such embodiment, the player may choose which table games to play and the tournament is based on who wins the most and no parity is created among the games.

In one embodiment, the gaming system enables teams to play tournaments. That is, a plurality of players either form a team to play a tournament or are assigned as a team by the gaming establishment operator or randomly by the central server. Team play may be incorporated into the scoring of the tournament by utilizing (a) each player's score in the tournament team rank determination; (b) a player's highest score for each team in the tournament team rank determination; or (c) only select scores from one or more of the players for each team in the tournament team rank determination.

In one embodiment, the gaming system enables players at different locations or gaming establishments to compete against each other. In one such embodiment, the players compete against every other player in the tournament to win the prize. That is, the player plays against other players in the gaming establishment the player is playing in, and additionally plays against other players at other gaming establishments.

In another multi-property embodiment, teams are formed by the players' locations. These teams then compete against each other for the tournament prize. For example, five players are on a team and six gaming establishment locations have a team. Each of the six teams competes against each other for a prize.

In another team tournament embodiment, the tournament is a multi-round tournament. In the first round, each of a plurality of players plays on a same team in a preliminary round. In the final round, each member of the qualifying teams plays individually to win the grand tournament prize. For example, Team A includes Players 1, 2, and 3 and Team B includes players 4, 5, and 6. For the first round, the players of Team A compete against the players of Team B to advance to the final round of the tournament as a team. Team A advances to the final round. In the final round, the players of Team A, Players 1, 2, and 3, individually play the tournament. That is, each of the players competes against each and is no longer on a team.

In another embodiment, the tournament makes game pays from tournament wins. That is, upon a tournament win, the gaming system credits the player's tournament account or credit meter. The gaming system then enables the players to use the tournament win to wager on non-tournament games at the same gaming table. In another embodiment, the dealer provides the player with chips from a win.

It should be appreciated that the gaming system of the present disclosure may operate over a wireless gaming system. Any aspect or step of the tournament or regular game play may be accomplished through wireless game play, including the functions of the gaming establishment operator. For example, the gaming establishment operator may start the tournament round or session from a wireless apparatus or a player may play a round or session from a wireless apparatus. Wireless apparatuses may display any suitable type of information to the players, to the public and/or to the gaming establishment operators such as, a list of qualified players, the scores of a tournament, the rules of the tournament and any other suitable information.

In one embodiment, the gaming system enables one or more players to make one or more side bets on one or more player's tournament performance. In this embodiment, the player is enabled to place a side bet, or side wager on the outcome of one or more tournament player's games. Once the player places a side bet for a designated player performance, the gaming system provides the player an outcome based on that side wager or side bet. In one embodiment, the gaming system enables the player to wager on his or her own performance. In one embodiment, the gaming system enables non-tournament players' to place side wagers. In one embodiment, the gaming system only enables players to wager on player performance prior to the start of the tournament. In another embodiment, the gaming system enables players to wager on player performance while the tournament is occurring but stops the wagering upon a triggering event. In this embodiment, the gaming system is constantly recalculating odds and associated payout based on current performance. It should be appreciated that the gaming system may enable a player to make a side wager at any suitable location, such as at a gaming table, at a kiosk or at with a cashier.

Such side wagers may be used in any sort of proposition wagering. For example, side wagers may be made on where a certain player is going to finish (i.e., the lower half or the upper half of the tournament players). The side wagers may be made on a final point total for a player (i.e., point total over 1000 points). Additionally, the side wagers may be placed on the age of the winner, whether the winner may be male or female or any other type of proposition betting.

In one embodiment, the tournament offers insurance to a player that they will make it to a final round or win a prize in the tournament. That is, for a monetary fee, a player can win money for not winning the tournament. For example, a player may buy insurance for a set fee, $5, and if the player does not win an award in the tournament, the player receives a certain award, such as $10 back. However, if the player wins the tournament, the player does not receive the insurance back. It should be appreciated that insurance may be used in any suitable aspect of tournament play.

The points earned in a tournament may be used by the gaming system in any suitable manner. In one embodiment, the tournament points are added to a player's account. In another embodiment, tournament points qualify players for one or more other tournaments. In another embodiment, collecting a certain number of tournament points within a specified time period enters the player in a drawing for a prize.

In one embodiment, the player stations available for a tournament or enrolled in a tournament identify themselves to potential tournament players and gaming establishment workers. This identification may be completed in any suitable manner.

Figures 20, 20A, 20B:
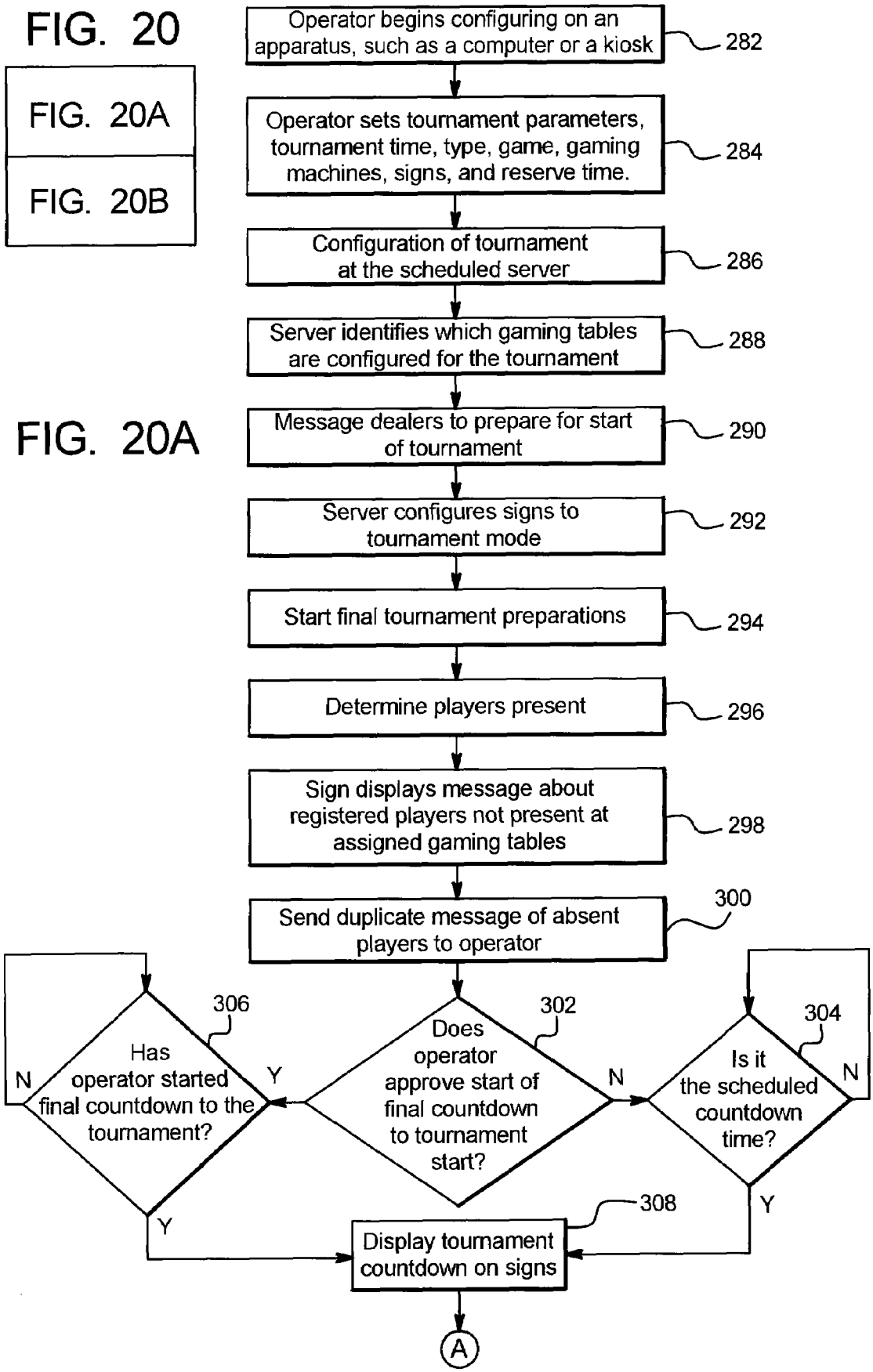
FIGS. 20, 20A and 20B are one embodiment of a flow chart of one method of one embodiment of a tournament disclosed herein.
Figure 20B:
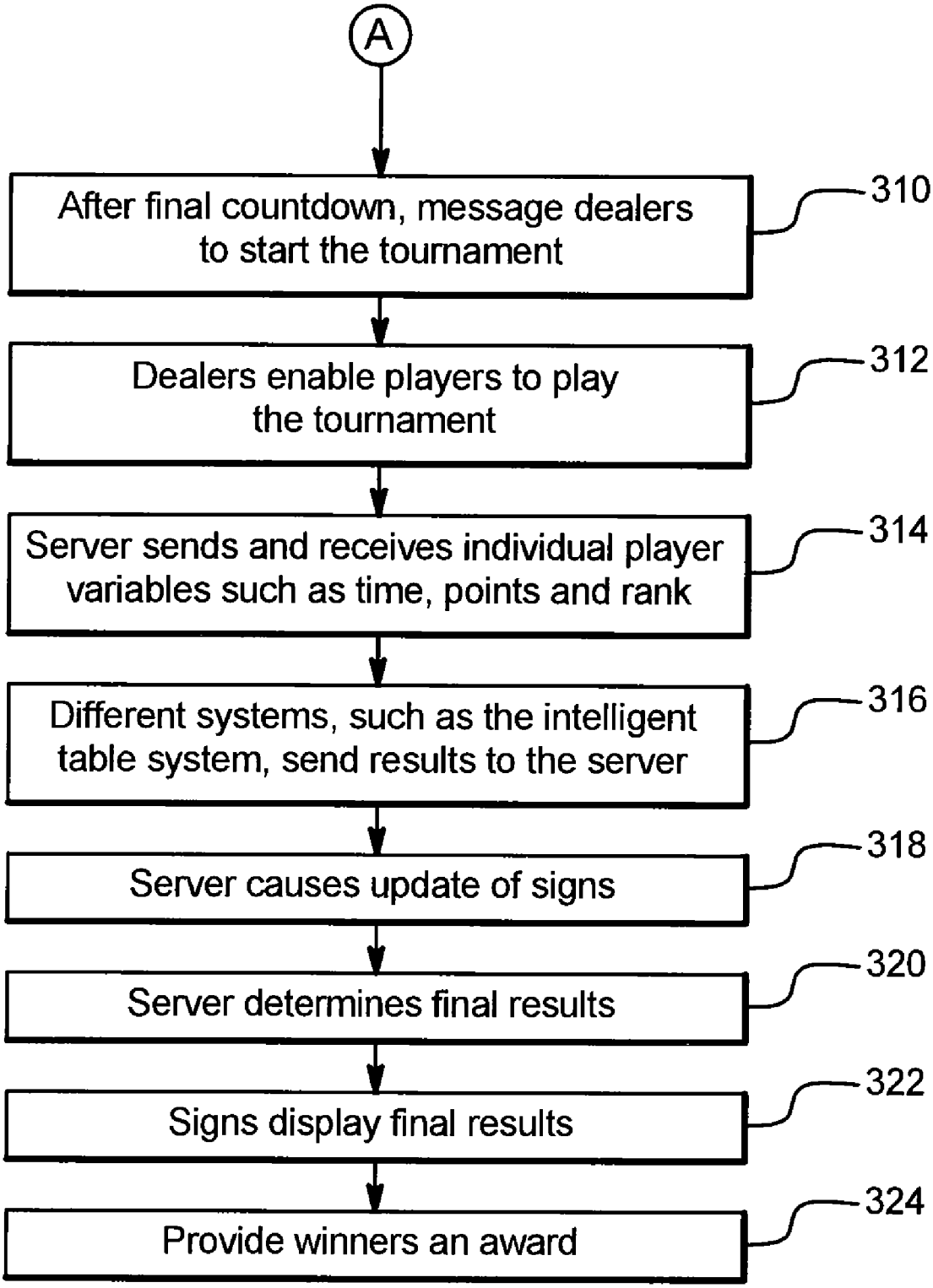

FIGS. 20A and 20B illustrate one method of a tournament. As illustrated in FIG. 20A, the operator opens the tournament on an apparatus such as a personal computer to configure the tournament, as illustrated in block 282. The operator determines and sets any suitable tournament parameters as illustrated in block 284. For example, the operator may set any of the parameters previously discussed, such as the tournament time, the type of tournament, the tournament game, the gaming tables, the affiliated signs and the time of the tournament. As illustrated in block 286, the gaming system configures at the tournament at the scheduled server. The gaming system identifies which gaming tables are configured for the tournament as illustrated in block 288.

As illustrated in FIG. 20A, the server messages dealers to prepare for the start of a tournament as illustrated in block 290. The server configures the signs of the gaming system to tournament mode as illustrated in block 292. The gaming system starts final tournament preparations as illustrated in block 294.

In one embodiment, once a sufficient number of player seats are reserved or occupied by tournament players, the server begins the final tournament preparations. The gaming system determines which players are present as illustrated in block 296. The server causes the sign displays to message about registered players not present at their assigned gaming tables, as illustrated in block 298. As illustrated in block 300, the server sends a duplicate message of which players are absent to the operator of the tournament.

The gaming system determines if the operator approves the start of the final countdown to the tournament start as illustrated in diamond 302. If the operator does not approve the start of the final countdown to the tournament start, the server determines if is the time for the final countdown scheduled time as illustrated in diamond 304 If it is the scheduled time, the server causes the countdown to be displayed on the signs as illustrated in block 308. If the operator determines it is time to start the scheduled countdown, the server determines if the operator has started the final countdown to the tournament as illustrated in diamond 306. If the operator has not started the final countdown, the server continues to determine if the operator has started the final countdown as illustrated in diamond 306. If the server determines that the final countdown has started, the server messages the signs to display the final countdown to the tournament as illustrated in block 308. After the final countdown, as illustrated in FIG. 20B, the server messages the dealers to start the tournament as illustrated in block 310.

As illustrated in FIG. 20B, block 312, the gaming system enables players to play the tournament. The server sends and receives individual player variables such as time, points and rank as illustrated in block 314. The different systems, such as the intelligent table system send the game results and other information to the server as illustrated in block 316. That is, the server receives messages regarding the players of each of the gaming tables. The server then sends that message to the signs as illustrated in block 318. The server causes the signs to display updates with messages and player rankings. Upon the tournament conclusion, the server determines the final tournament results as illustrated in box 320. The server causes the signs to display the final results as illustrated in block 322. These results confirm the tournament game results for that player. The gaming system provides the winners an award as illustrated in block 324. In one embodiment, the dealer provides the winner an award. In another embodiment, the dealer provides the player a ticket to redeem for an award. In another embodiment, the gaming table includes an award ticket printer, which prints the award for the player.

It should be appreciated that any suitable element of any of the examples disclosed herein may be combined. It should be understood that various changes and modifications to the presently preferred embodiments described herein will be apparent to those skilled in the art. Such changes and modifications can be made without departing from the spirit and scope of the present subject matter and without diminishing intelligent table system intended advantages. It is therefore intended that such changes and modifications be covered by the appended claims.

The invention is claimed as follows:

1. A table tournament gaming system for facilitating a table tournament including a plurality of players using a plurality of chips to play the table tournament, said tournament gaming system comprising:

a central server;

a tournament tracking system in communication with the central server, said tournament tracking system including a chip tracking system and a player tracking system; and said central server and said tournament tracking system configured to:

(a) enable at least one player to play the table tournament at a gaming table and simultaneously enable at least one other player to play a non-tournament game at the gaming table, (b) for each player playing the table tournament at the gaming table:

(i) enable the player to identify themselves through the player tracking system, (ii) maintain an identification of each chip the player starts the table tournament with, (iii) maintain an identification of each chip the player wins during the table tournament, and (iv) maintain an identification of each chip the player loses during the table tournament, (c) for each player playing the non-tournament game at the gaming table:

(i) maintain an identification of each chip the player wins during said non-tournament game, and (ii) maintain an identification of each chip the player loses during said non-tournament game, (d) for each chip, if one of the players loses said chip playing the tournament game, change the identification of said chip from a tournament identification to a non-tournament identification such that said chip has the non-tournament identification if said chip is won as by one of the players as a result of playing the non-tournament game;

(e) for each chip, if one of the players loses said chip playing the non-tournament game, change the identification of said chip from the non-tournament identification to the tournament identification such that said chip has the tournament identification if said chip is won by one of the players as a result of playing the tournament game;

(f) upon completion of the table tournament, automatically determine at least one winner of the table tournament based on the identification of each of said chips, and (g) cause a notification of the winner of the table tournament.

2. The table tournament gaming system of claim 1, wherein the chip tracking system is configured to identify chips in a chip holding area of the gaming table.

3. The table tournament gaming system of claim 1, wherein the chip tracking system is configured to identify chips in wagering areas of the gaming table.

4. The table tournament gaming system of claim 1, wherein the player tracking system is configured for each player of the table tournament to store player chip information in a player account for that player.

5. The table tournament gaming system of claim 4, wherein the tournament tracking system automatically determines the winner of the table tournament based on the information stored in the player accounts.

6. The table tournament gaming system of claim 1, wherein the table tournament is a synchronized table tournament.

7. The table tournament gaming system of claim 1, wherein the table tournament is a bonus table tournament.

8. The table tournament gaming system of claim 1, wherein said central server and said tournament tracking system are configured to determine which players qualify to play in the table tournament based on information stored about the players in the player tracking system.

9. The table tournament gaming system of claim 1, wherein the table tournament can be played at a plurality of different types of gaming tables.

10. The table tournament gaming system of claim 1, wherein said central server and said tournament tracking system are configured for each player playing the table tournament at the gaming table to enable the player to identify themselves through the player tracking system using a player tracking card.

11. A table tournament gaming system for facilitating a table tournament including a plurality of players using a plurality of chips to play the table tournament at at least one gaming table, each gaming table including a plurality of player stations and at least one chip identification area for each player station, said tournament gaming system comprising:

a central server;

a tournament tracking system operable to identify the chips located in each of the chip identification areas; and said central server and said tournament tracking system configured to:

(a) for each player station:

(i) maintain an identification of each chip the player at said player station starts the table tournament with, (ii) maintain an identification of each chip the player at said player station wins during the table tournament, and (iii) maintain an identification of each chip the player at said player station loses during the table tournament, (b) enable at least one of the players playing the table tournament at one of the player stations to play non-tournament games during the table tournament at said player station;

(c) for each chip, if one of the players loses said chip playing the table tournament, change the identification of said chip from a tournament identification to a non-tournament identification such that said chip has the non-tournament identification if said chip is won by one of the players as a result of playing one of the non-tournament games;

(d) for each chip, if one of the players loses said chip playing one of the non-tournament games, change the identification of said chip from the non-tournament identification to the tournament identification such that said chip has the tournament identification if said chip is won by one of the players as a result of playing the table tournament;

(e) upon completion of the table tournament, use a determination of each chip of the table tournament at each player station to automatically determine at least one winner of the table tournament based on said determination, and (f) cause a notification of the winner of the table tournament.

12. The table tournament gaming system of claim 11, wherein the at least one chip identification area is a plurality of chip holding areas.

13. The table tournament gaming system of claim 11, wherein the at least one chip identification area is a chip holding area.

14. The table tournament gaming system of claim 11, wherein the at least one chip identification area is a wagering area.

15. The table tournament gaming system of claim 11, wherein the at least one chip identification area is a plurality of wagering areas.

16. The table tournament gaming system of claim 11, wherein the table tournament is a self-scheduled table tournament.

17. The table tournament gaming system of claim 11, wherein the table tournament is a synchronized tournament.

18. The table tournament gaming system of claim 11, wherein the table tournament is a bonus tournament.

19. The table tournament gaming system of claim 11, wherein said central server and said tournament tracking system are configured to determine which players qualify to play in the table tournament based on information stored about the players in the player tracking system.

20. The table tournament gaming system of claim 11, wherein said central server and said tournament tracking system are configured to enable a plurality of players to play tournament games at a plurality of gaming tables.

21. A method of operating a table tournament, said method comprising:

(a) enabling at least one player to play a tournament table game at a gaming table and simultaneously enabling at least one other player to play a non-tournament table game at said gaming table;

(b) tracking the chips played at the gaming table including the chips each player wagers, the chips each player wins, and the chips each player loses;

(c) for each chip, if one of the players loses said chip playing the tournament table game, change the identification of said chip from a tournament identification to a non-tournament identification such that said chip has the non-tournament identification if said chip is won by one of the players as a result of playing the non-tournament table game;

(d) for each chip, if one of the players loses said chip playing the non-tournament table game, change the identification of said chip from the non-tournament identification to the tournament identification such that said chip has the tournament identification if said chip is won by one of the players as a result of playing the tournament table game;

(e) upon completion of the table tournament, determining each chip each player in the table tournament has to automatically determine at least one winner of the table tournament based on said determination; and (f) causing a notification of the winner of the table tournament.

22. The method of claim 21, which includes identifying chips in a chip holding area of the gaming table.

23. The method of claim 21, which includes identifying chips in a wagering area of the gaming table.

24. The method of claim 21, which includes for each player in the tournament, storing player chip information in a player account for that player.

25. The method of claim 24, which includes automatically determining the winner of the table tournament based on the information stored in the player accounts.

26. The method of claim 21, wherein the table tournament is a synchronized tournament.

27. The method of claim 21, wherein the table tournament is a self-scheduled tournament.

28. The method of claim 21, wherein the table tournament is a bonus tournament.

29. The method of claim 21, which includes determining which players qualify to play in the table tournament based on information stored about the players in a player tracking system.

30. The table tournament gaming system of claim 1, wherein for each chip:

(i) if one of the players loses said chip playing the tournament table game, the identification of said chip is changed from the tournament identification to the non-tournament identification when said chip is provided to said player as the result of playing the non-tournament table game, and (ii) for each chip, if one of the players loses said chip playing the non-tournament table game, the identification of said chip is changed from the non-tournament identification to the tournament identification when said chip is provided to said player as the result of playing the tournament table game.

31. The table tournament gaming system of claim 11, wherein for each chip:

(i) if one of the players loses said chip playing the table tournament, the identification of said chip is changed from the tournament identification to the non-tournament identification when said chip is provided to said player as the result of playing one of the non-tournament games, and (ii) for each chip, if one of the players loses said chip playing one of the non-tournament games, the identification of said chip is changed from the non-tournament identification to the tournament identification when said chip is provided to said player as the result of playing the table tournament.

32. The method of claim 21, which includes for each chip:

(i) if one of the players loses said chip playing the tournament table game, changing the identification of said chip from the tournament identification to the non-tournament identification when said chip is provided to said player as the result of playing the non-tournament table game, and (ii) for each chip, if one of the players loses said chip playing the non-tournament table game, changing the identification of said chip from the non-tournament identification to the tournament identification when said chip is provided to said player as the result of playing the tournament table game.

33. The table tournament gaming system of claim 1, wherein for each of a plurality of the chips, the identification of said chip includes an identification number.

34. The table tournament gaming system of claim 33, wherein for each of said plurality of the chips, the identification of said chip includes the tournament identification or the non-tournament identification.

35. The table tournament gaming system of claim 11, wherein for each of a plurality of the chips, the identification of said chip includes an identification number.

36. The table tournament gaming system of claim 35, wherein for each of said plurality of the chips, the identification of said chip includes the tournament identification or the non-tournament identification.

37. The method of claim 21, wherein for each of a plurality of the chips, the identification of said chip includes an identification number.

38. The method of claim 37, wherein for each of said plurality of the chips, the identification of said chip includes the tournament identification or the non-tournament identification.

39. A table tournament gaming system for facilitating a table tournament including a plurality of players using a plurality of chips to play the table tournament at a gaming table, said gaming table including a plurality of player stations, said tournament gaming system comprising:

a central server; and a tournament tracking system operable to identify the chips located at each of the player stations, said central server and said tournament tracking system configured to:

(a) for each chip that is received with the tournament identification, change the assigned identification of said chip from the tournament identification to the non-tournament identification if said chip is transferred to one of the players as a non-tournament chip; and b) for each chip that is received with the non-tournament identification, change the assigned identification of said chip from the non-tournament identification to the tournament identification if said chip is transferred to one of the players as a tournament chip.

40. The table tournament gaming system of claim 39, wherein said central server and said tournament tracking system are configured for each player station to: (i) assign a tournament identification to each chip the player at said player station starts the table tournament with, (ii) assign the tournament identification to each chip the player at said player station wins during the table tournament, and (iii) assign the non-tournament identification to each chip the player at said player station wins during a non-tournament game.

41. The table tournament gaming system of claim 39, wherein upon completion of the table tournament, said central server and said tournament tracking system are configured for each player station to use the identification of each chip at each player station to automatically determine at least one winner of the table tournament.

42. The table tournament gaming system of claim 39, wherein for each of a plurality of the chips, the identification of said chip includes an identification number.

43. The table tournament gaming system of claim 42, wherein for each of said plurality of the chips, the identification of said chip includes the tournament identification or the non-tournament identification.

* * * * *

UNITED STATES PATENT AND TRADEMARK OFFICE

CERTIFICATE OF CORRECTION

PATENT NO. : 7,690,996 B2
APPLICATION NO. : 11/556919
DATED : April 6, 2010
INVENTOR(S) : Iddings et al.

It is certified that error appears in the above-identified patent and that said Letters Patent is hereby corrected as shown below:

In Claim 1, Column 42, line 61, delete "as".

In Claim 19, Column 44, line 42, replace "the player tracking system" with --a player tracking system--.

Signed and Sealed this

Thirteenth Day of July, 2010

David J. Kappos

David J. Kappos
*Director of the United States Patent and Trademark Office*